US006677706B1

(12) United States Patent
Hara et al.

(10) Patent No.: US 6,677,706 B1
(45) Date of Patent: Jan. 13, 2004

(54) ELECTRON EMISSION APPARATUS COMPRISING ELECTRON-EMITTING DEVICES, IMAGE-FORMING APPARATUS AND VOLTAGE APPLICATION APPARATUS FOR APPLYING VOLTAGE BETWEEN ELECTRODES

(75) Inventors: Toshitami Hara, Tokyo (JP); Kazuya Miyazaki, Atsugi (JP); Akihiko Yamano, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/045,026

(22) Filed: Mar. 20, 1998

(30) Foreign Application Priority Data

Mar. 21, 1997 (JP) ..... 9-068174
Mar. 19, 1998 (JP) ..... 10-070535

(51) Int. Cl.[7] ..... H01J 1/62

(52) U.S. Cl. ..... 313/496; 313/495; 313/310; 315/169.1

(58) Field of Search ..... 313/495, 496, 313/497, 422, 292, 498, 309, 310, 311; 250/214 TV; 315/161.1, 169.3

(56) References Cited

U.S. PATENT DOCUMENTS

| | | | | |
|---|---|---|---|---|
| 4,417,184 | A | 11/1983 | Takesako et al. | 315/366 |
| 5,066,883 | A | 11/1991 | Yoshioka et al. | 313/309 |
| 5,225,820 | A | 7/1993 | Clerc | 340/752 |

(List continued on next page.)

FOREIGN PATENT DOCUMENTS

| | | |
|---|---|---|
| EP | 0 286 188 | 10/1988 |
| EP | 0 404 022 A | 12/1990 |
| EP | 0 404 022 | 12/1990 |
| EP | 0 523 702 A | 1/1993 |
| EP | 0 690 467 | 1/1996 |
| EP | 0 739 029 | 10/1996 |
| JP | 57-118355 | 7/1982 |
| JP | 61-124031 | 6/1986 |
| JP | 61-131056 | 8/1986 |
| JP | 8-180821 | 7/1996 |
| JP | 8-236047 | 9/1996 |
| JP | 8-329867 | 12/1996 |
| JP | 9-7532 | 1/1997 |
| WO | WO 94/15350 | 7/1994 |
| WO | WO 96/30926 | 10/1996 |

OTHER PUBLICATIONS

European Search Report dated Aug. 14, 1998.

I. Brodie "Advanced Technology: Flat cold–cathode CRT's," Information Display, 89, 17 (1989).

"The experimental physics course No. 14: Surface/fine particle" (Ed. K. Kinoshita; Kyonitu Publ., Sep. 1, 1986, pp. 195, 11.22–26.

"Hayashi's Ultrafine Particle Project," Ultrafine Particle Creative Science & Technology, ed. Chikara Hayashi, R. Veda, & A. Tazaki; Mita Publication, 1988, pp. 2, 11.1–4.

*Primary Examiner*—Nimeshkumar D. Patel
*Assistant Examiner*—Karabi Guharay
(74) *Attorney, Agent, or Firm*—Fitzpatrick, Cella, Harper & Scinto

(57) ABSTRACT

An electron emission apparatus effectively suppresses the adverse effect of electric discharges that can take place between the oppositely disposed electrodes of the apparatus to which a high voltage is applied by dividing the electrode adapted to have a higher electric potential into segments in order to reduce the electrostatic capacitance between the electrodes. In the case of an electron emission apparatus comprising electron-emitting devices, a plurality of electron-emitting devices are disposed such that the direction along which those that can be driven simultaneously are arranged is not parallel with the direction along which the electrode is divided into the electrode segments in order to reduce the variable range of the electric current that can flow in the segments.

19 Claims, 34 Drawing Sheets

U.S. PATENT DOCUMENTS 5,532,548 A * 7/1996 Spindt et al. ..... 313/422
5,561,339 A 10/1996 Jones et al. ..... 313/309
5,592,056 A 1/1997 Peyre et al. ..... 315/169.1
5,594,296 A * 1/1997 Mitsutake et al. ..... 313/309
5,608,285 A 3/1997 Vickers et al.
5,675,212 A * 10/1997 Schmid et al. ..... 313/422
5,760,538 A * 6/1998 Mitsutake et al. ..... 313/422
5,764,000 A 6/1998 Mougin et al. ..... 313/496
5,865,930 A * 2/1999 Schmid et al. ..... 156/265
5,905,335 A * 5/1999 Fushimi et al. ..... 313/495
5,916,396 A * 6/1999 Schmid et al. ..... 156/89.16
5,936,343 A * 8/1999 Fushimi et al. ..... 313/495
5,949,184 A * 9/1999 Ohoshi et al. ..... 313/485
5,952,775 A * 9/1999 Sato et al. ..... 313/422
5,985,067 A * 11/1999 Schmid et al. ..... 156/89.16
6,377,002 B1 * 4/2002 Ge et al. ..... 313/422

* cited by examiner

ELECTRON EMISSION APPARATUS COMPRISING ELECTRON-EMITTING DEVICES, IMAGE-FORMING APPARATUS AND VOLTAGE APPLICATION APPARATUS FOR APPLYING VOLTAGE BETWEEN ELECTRODES

BACKGROUND OF THE INVENTION

1. Field of the Invention

This invention relates to an electron emission apparatus comprising electron-emitting devices, an image-forming apparatus and a voltage application apparatus for applying a voltage between electrodes.

2. Related Background Art

Known electron emission apparatus include image-forming apparatus such as an electron-beam display panel realized by arranging in parallel an electron source substrate carrying thereon a large number of cold cathode electron-emitting devices, a metal back or transparent electrode for accelerating electrons emitted from the electron-emitting devices and an anode substrate provided with a fluorescent body and evacuating the inside. An image-forming apparatus comprising field emission type electron-emitting devices is described in I. Brodie, "Advanced technology: flat cold-cathode CRT's", Information Display, 1/89, 17 (1989). An image-forming apparatus comprising surface conduction electron-emitting devices is disclosed in U.S. Pat. No. 5,066,883. A plane type electron-beam display panel can be made lightweight and have a large display screen as compared with currently popular cathode ray tubes (CRTs) and can provide brighter and higher quality images than any other plane type display panels such as plane type display panels using liquid crystals, plasma displays and electroluminescent displays.

FIG. 17 of the accompanying drawings schematically illustrates an electron-beam display panel as an example of an image-forming apparatus comprising electron-emitting devices. Referring to FIG. 17, there is shown a vacuum envelope 48 comprising a rear plate 31 operating as electron source substrate, a face plate 47 operating as anode substrate, an outer frame 42, a glass substrate 41 supporting the rear plate. The vacuum envelope 48 contains therein electron-emitting devices 34, wiring electrodes 32 (scan electrodes) and 33 (signal electrodes) connected to the respective device electrodes. Otherwise, there is shown a glass substrate 46 of the face plate 47, a transparent electrode (anode) 44 and a fluorescent body (fluorescent film) 45. The scan electrodes 32 and the signal electrodes 33 are arranged rectangularly relative to each other to produce a wiring matrix.

The display panel displays an image when selected ones of the electron-emitting devices 34 located at the crossings of the matrix are driven to emit electrons by sequentially applying a given voltage to the scan electrodes 32 and the signal electrodes 33 and the fluorescent body 45 is irradiated with emitted electrons to produce bright spots at locations corresponding to the activated respective electron-emitting devices. A High voltage Hv is applied to the transparent electrode 44 in order to give it a high electric potential relative to the electron-emitting devices 34 and accelerate the emitted electrons so that the bright spots may emit light actively. The voltage applied to the transparent electrode 44 is between several hundred volts to several tens of kilovolts depending on the performance of the fluorescent body. Therefore, the rear plate 31 and the face plate 46 are separated from each other normally by a distance between a hundred micrometers and several millimeters in order to prevent dielectric breakdown of a vacuum (electric discharges) from occurring due to the applied voltage.

While a transparent electrode is used as an acceleration electrode in the above arrangement, alternatively the fluorescent body 45 may be formed directly on the glass substrate 46 and a metal back may be arranged thereon so that a high voltage may be applied to the latter in order to accelerate electrons.

FIGS. 18A and 18B of the accompanying drawings schematically illustrate two possible arrangements of fluorescent film that can be used for an electron-beam display panel. While the fluorescent film comprises only a single fluorescent body if the display panel is used for showing black and white pictures, it needs to comprise for displaying color pictures black conductive members 91 and fluorescent bodies 92, of which the former are referred to as black stripes (FIG. 18A) or a black matrix (FIG. 18B) depending on the arrangement of the fluorescent bodies. Black stripes or a black matrix are arranged for a color display panel in order to make mixing of the fluorescent bodies 92 of the three different primary colors less discriminable and weaken the adverse effect of reducing the contrast of displayed images of reflected external light by blackening the surrounding areas. While graphite is normally used as a principal ingredient of the black stripes, other conductive material having low light transmissivity and reflectivity may alternatively be used.

A precipitation or printing technique can be suitably used for applying a fluorescent material on the glass substrate regardless of black and white or color display. The metal back is provided in order to enhance the luminance of the display panel by causing the rays of light emitted from the fluorescent bodies and directed to the inside of the envelope to be mirror-reflected toward the face plate 47, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and depositing an Al film thereon after forming the fluorescent film.

A transparent electrode (not shown) may be formed on the face plate 47 facing the outer surface of the fluorescent film 45 (the side facing the glass substrate 46) in order to raise the conductiveness of the fluorescent film 45.

Care should be taken to accurately align each of color fluorescent bodies and the corresponding electron-emitting device for a color display.

When a plane type image-forming apparatus using electron beams is made to have a large display screen, structural members called spacers may be required to protect the envelope against the pressure difference between the internal vacuum and the external atmospheric pressure. When spacers are used, they can become electrically charged as some electrons emitted from the electron source at locations near the spacers and/or cations ionized by electrons collide with the spacers directly or after being reflected by the face plate. When the spacers are strongly charged, electrons emitted from the electron source can be deflected to show respective swerved trajectories and get to the target fluorescent bodies at improper spots to display a distorted image having an uneven brightness distribution.

Techniques for solving the problem of electrically charged spacers by causing a small electric current to flow through the spacers have been proposed (see, inter alia, Japanese Patent Applications Laid-Open Nos. 57-118355 and 61-124031). According to one of such techniques, an electrically highly resistive film is formed-on the surface of each insulating spacer to make a slight electric current flow therethrough.

Meanwhile, in an image-forming apparatus of the type under consideration comprising an oppositely disposed positive electrode such as a metal back or a transparent electrode, a high voltage is advantageously applied thereto in order to accelerate electrons emitted from cold cathode electron-emitting devices of the electron source so that the fluorescent bodies are made to emit light to a maximum extent. Additionally, the distance separating the opposite electrode from the electron source should be minimized to display images with an enhanced degree of resolution because otherwise the electron beams emitted from the electron source can be dispersed before they get to the target electrode depending on the type of the electron-emitting devices of the electron source.

Then, a strong electric field is produced between the opposite electrode and the electron source due to the high voltage to give rise to electric discharges that can destruct some of the electron-emitting devices 34 and/or electric currents that can intensively flow through part of the fluorescent bodies to make the display screen partly and irregularly emit light.

Thus, measures should be taken to reduce the frequency of electric discharges and/or prevent electric discharge destructions from taking place.

An electric discharge destruction can occur when a large electric current flows through certain spots of the electron source generates heat that destroys the electron-emitting devices located there or instantaneously raises the voltage being applied to some of the electron-emitting devices to consequently destroys them.

Measures that can be taken to reduce the electric current leading to an electric discharge destruction may include the use of a limitter-resistor inserted in series as shown in FIG. 19. However, such a measure by turn gives rise to another problem when a large number of electron-emitting devices are arranged in rows and columns, for example in 500 rows and 1,000 columns, and connected to a matrix wiring system so that they are driven sequentially on a line by line basis in such a way that as many as 1,000 devices are activated simultaneously. Assume now that about 1,000 devices are activated and each of them generates an emission current of 5 $\mu$A. Then, the electric current flowing through the anodes fluctuates between 0 and 5 $\mu$A depending on the image being displayed. Thus, when a resistor of 1 M$\Omega$ is connected externally in series as shown in FIG. 19, a voltage drop of 0 to 5 kV can take place to give rise to an irregularity of as much as 50% in the brightness for the acceleration voltage of 10 kV.

Additionally, since a high voltage is applied between a pair of oppositely disposed plates, the electric charge that can be accumulated due to the capacitor effect of the display apparatus will be as much as $10^{-6}$ coulombs if the cathode and the anode have a surface area of 100 $cm^2$ and are separated by a distance of 1 mm and the potential difference between them is equal to 10 kV. This means that an electric discharge of 1 $\mu$sec. will cause an electric current of 1 A to flow through a single spot in the display apparatus, which is sufficiently strong to destroy the electron-emitting devices. Thus, the arrangement of an external resistor that is connected in series does not provide any satisfactory solution unless it can solve the problem of uneven brightness.

SUMMARY OF THE INVENTION

Therefore, the object of the present invention is to provide an improvement to the arrangement of voltage application for an image-forming apparatus of the type under consideration.

According to a first aspect of the invention, there is provided an electron emission apparatus comprising a substrate carrying thereon electron-emitting devices, an electrode disposed opposite to said substrate and an acceleration voltage-applying means for supplying a voltage to accelerate electrons emitted from said electron-emitting devices, characterized in that said electrode is divided into a plurality of electrode segments, each being connected to said accelerating voltage-applying means by way of a resistor, and a constant voltage is applied to each and all of said electrode segments.

According to a second aspect of the invention, there is provided an electron emission apparatus comprising a substrate carrying thereon electron-emitting devices, an electrode disposed opposite to said substrate and a power source for supplying a voltage to accelerate electrons emitted from said electron-emitting devices, characterized in that said electrode is divided into a plurality electrode segments, each being connected to said accelerating voltage-applying means by way of a resistor, and a constant voltage is applied to each and all of said electrode segments.

For the purpose of the invention, a constant voltage refers to a voltage that is not subjected to switching between a value representing a clear and substantive operating state and another distinct value or between ON and OFF.

In an electron emission apparatus according to the first or second aspect of the invention, said electrode is arranged on a second substrate disposed opposite to said substrate carrying thereon said electron-emitting devices, or the first substrate and said electron emission apparatus additionally comprises a supporting member for securing a predetermined gap between said first and second substrates. Said support member operates to suppress any variations in the gap between the first and second substrates due to the difference between the pressure between the first and second substrates and the external pressure and maintain the gap between said first and second substrate substantially to a same level.

Said supporting member may be adapted to flow an electric current between said first and second substrates.

Said supporting member may be electroconductive and electrically connected to one or less than one of said electrode segments. That is to say, the supporting member is electrically connected to only one electrode segment or not electrically connected to any of the electrode segments. If such is the case, the supporting member may comprise a first member having a first electroconductivity and a second member having a second electroconductivity and electrically connecting said one or less than one of said electrode segments and said first member.

When the supporting member is electroconductive and connected to two or more than two of the electrode segments, the latter also become electrically connected by way of the former. Therefore, if the supporting member is electroconductive, it should not be connected to any of the electrode segments or should be connected only to one of the electrode segments. If the supporting member is adapted to flow an electric current between the first and second substrates, preferably it is electrically connected only to one of the electrode segments so that the electrode segment may operate as means for flowing an electric current to the supporting member or at least as part of such means to simplify the entire configuration. When, the supporting member is electroconductive, the problem of electric charge can be alleviated on the part of the supporting member if it becomes electrically charged. The degree of electroconductivity of the supporting member should be selected in view of the fact that a reduced electric charge of the supporting member is an offset to its power consumption because the use of a highly electroconductive supporting member results in a high power consumption rate. When the electroconductive supporting member is electrically connected to the electrode, a second member that is more electroconductive than the supporting member may be arranged at the site of connection.

While a rather low level of electroconductivity is selected for the supporting member to reduce its electric charge, taking its power consumption rate into consideration, the supporting member may be made to comprise a second member having a second electroconductivity higher than the electroconductivity of the first member in order to improve the electric connection with the electrode. Then, there arises a problem that the electrode segments can become short-circuited by way of the second electroconductive member. This problem can be solved by arranging the supporting member so as not to bridge a plurality of electrode segments.

In an electron emission apparatus according to the invention and comprising a supporting member disposed between the first and second substrates, the supporting member may be arranged to bridge two or more than two of the electrode segments and include a first member having a first electroconductivity and two or more than two second members having a second electroconductivity, said two or more than two second members being electrically connected respectively to said two or more than two electrode segments, said two or more than two second members being separated from each other, said second electroconductivity being higher than said first electroconductivity.

When the supporting member comprises a first member having a first electroconductivity and a second member having a second electroconductivity arranged at the site of electric connection of the supporting member and the electrode to improve the electric connection and bridges at least two of the electrode segments of the electrode, the electrode segments can become easily short-circuited by the electrically highly conductive second member. This problem can be dissolved by using two or more than two second members having the high second electroconductivity that are separated from each other and electrically connected to the two or more than two electrode segments respectively. Then, the first electroconductivity of the first member may be selected such that the short-circuiting among the plurality of electrode segments can be effectively suppressed below a permissible level. While the first electroconductivity may be selected to be low from the viewpoint of suppressing the power consumption rate of the supporting member, the effect of suppressing the short-circuiting and that of reducing the possible electric charge may also have to be taken into consideration.

When a supporting member is disposed between the first and second substrates of an electron emission apparatus according to the invention, it may be so arranged that the supporting member bridges two or more than two of the electrode segments and includes a first member having a first electroconductivity and a second member having a second electroconductivity, said second member being electrically connected to some of said two or more than two of the electrode segments, said second member being insulated from the rest of said two or more than two electrode segments, said second electroconductivity being higher than said first electroconductivity.

When the supporting member includes a first member having a first electroconductivity and electrically connected to said electrode and a second member having a second electroconductivity arranged at the site of electric connection of the supporting member and the electrode to improve the electric connection and bridges at least two of the electrode segments of the electrode, the electrode segments can become easily short-circuited by the electrically highly conductive second member. This problem can be dissolved by electrically connecting the supporting member to some of the electrode segments at positions abutting the latter whereas it is electrically insulated from the rest of the electrode segments. With this arrangement, the number of electrode segments short-circuited by the second member can be reduced. Preferably, the supporting member is electrically connected to only one of the electrode segments at a position where they but each other. More specifically, this arrangement can be realized by using an electrically conductive adhesive agent for the electric connection and a dielectric adhesive agent for the electric insulation. With this arrangement, the first electroconductivity may be such that the short-circuiting among the plurality of electrode segments can be effectively suppressed below a permissible level. While the first electroconductivity may be selected to be low from the viewpoint of suppressing the power consumption rate of the supporting member, the effect of suppressing the short-circuiting and that of reducing the possible electric charge may also have to be taken into consideration.

When the supporting member of an electron emission apparatus according to the invention includes a first member having a first electroconductivity and a second member having a second electroconductivity, preferably the surface resistance of the second member having the second electroconductivity is between $10^{-1}$ and $10^{-2}$ Ω and that of the first member having the first electroconductivity is between $10^{8}$ and $10^{11}$ Ω.

The electroconductive supporting member of an electron emission apparatus according to the invention may be prepared in various different ways. As a specific example, it may be prepared by forming an electroconductive film on the surface of its substrate. Then, a desired level of electroconductivity can be realized for the supporting member by appropriately selecting the material, the composition, the thickness and the profile of the film.

For the purpose of the invention, the voltage to be applied to each of the electrode segments may be selected appropriately.

According to another aspect of the invention, there is provided an electron emission apparatus comprising a first substrate carrying thereon electron-emitting devices, a second substrate carrying an electrode and disposed opposite to the first substrate, a support member for securing a predetermined gap between said first and second substrates and an acceleration voltage-applying means for supplying a voltage to accelerate electrons emitted from said electron-emitting devices, characterized in that said electrode is divided into a plurality of electrode segments, each being connected to said accelerating voltage-applying means by way of a resistor, and said supporting member is electroconductive and electrically connected to one or less than one of said electrode segments.

According to still another aspect of the invention, there is provided an electron emission apparatus comprising a first substrate carrying thereon electron-emitting devices, a second substrate carrying an electrode and disposed opposite to the first substrate, a support member for securing a predetermined gap between said first and second substrates and a power source for supplying a voltage to accelerate electrons emitted from said electron-emitting devices, characterized in that said electrode is divided into a plurality of electrode segments, each being connected to said power source by way of a resistor, and said supporting member is electroconductive and electrically connected to one or less than one of said electrode segments.

According to a further aspect of the invention, there is provided an electron emission apparatus comprising a first substrate carrying thereon electron-emitting devices, a second substrate carrying an electrode and disposed opposite to the first substrate, a support member for securing a predetermined gap between said first and second substrates and an acceleration voltage-applying means for supplying a voltage to accelerate electrons emitted from said electron-emitting devices, characterized in that said electrode is divided into a plurality of electrode segments, each being connected to said accelerating voltage-applying means by way of a resistor, and said supporting member bridges two or more than two of said electrode segments and includes a first member having a first electroconductivity and two or more than two second members having a second electroconductivity, said two or more than two second members being electrically connected respectively to said two or more than two electrode segments, said two or more than two second members being separated from each other, said second electroconductivity being higher than said first electroconductivity.

According to a further aspect of the invention, there is provided an electron emission apparatus comprising a first substrate carrying thereon electron-emitting devices, a second substrate carrying an electrode and disposed opposite to the first substrate, a support member for securing a predetermined gap between said first and second substrates and a power source for supplying a voltage to accelerate electrons emitted from said electron-emitting devices, characterized in that said electrode is divided into a plurality of electrode segments, each being connected to said power source by way of a resistor, and said supporting member bridges two or more than two of the electrode segments and includes a first member having a first electroconductivity and a second member having a second electroconductivity, and said second member being electrically connected to some of said two or more than two of the electrode segments, said second member being insulated from the rest of said two or more than two electrode segments, said second electroconductivity being higher than said first electroconductivity.

According to a still further aspect of the invention, there is provided an electron emission apparatus comprising a substrate carrying thereon electron-emitting devices, an electrode disposed opposite to said substrate and an acceleration voltage-applying means for supplying a voltage to accelerate electrons emitted from said electron-emitting devices, characterized in that said electrode is divided into a plurality of electrode segments, each being connected to said accelerating voltage-applying means by way of a resistor, and a selected voltage is applied to each of said electrode segments.

According to a still further aspect of the invention, there is provided an electron emission apparatus comprising a substrate carrying thereon electron-emitting devices, an electrode disposed opposite to said substrate and a power source for supplying a voltage to accelerate electrons emitted from electron-emitting devices, characterized in that said electrode is divided into a plurality of electrode segments, each being connected to said accelerating voltage-applying means by way of a resistor, and a selected voltage is applied to each of said electrode segments. For the purpose of the invention, the electrode segments may be connected to respective voltage-applying means or power sources in order to apply selected voltages to the electrode segments respectively.

For the purpose of the invention, the electrode segments and the respective resistors may be connected in various different ways. For example, the electrode segments and the resistors may be arranged on a plane and electrically connected on that plane. Alternatively, the electrode segments may be arranged on the respective resistors as shown in FIG. 21. More specifically, a base electrode is arranged on the substrate for carrying electrode segments and electrically connected to the voltage-applying means or the power source and resistors are arranged thereon before the electrode segments are arranged further thereon. With this arrangement, the electrode segments are connected to the voltage-applying means or the power source by way of the respective resistors and the base electrode. With any arrangement, the electrode segments are connected to the power source by way of the respective resistors and arranged in parallel with each other.

For the purpose of the invention, a plurality of electron-emitting devices are arranged and the fluctuations in the electric current flowing into each of the electrode segments and hence the fluctuations in the voltage drop due to the fluctuations in the electric current can be minimized by arranging the plurality of electron-emitting devices, which may be driven simultaneously, in a direction not parallel with the direction along which the electrode is divided into the electrode segments.

For the purpose of the invention, the resistors have a resistance between 10 kΩ and 1 GΩ, preferably between 10 kΩ and 4 MΩ.

For the purpose of the invention, a plurality of electron-emitting devices are arranged and, if the resistors have a resistance of R, each of the electron-emitting devices shows an emission current of Ie, the electrode applies an acceleration voltage of V and the number of electron-emitting devices emitting one of the electrode segments is n, preferably the relationship as defined below is met.

$$R \leqq 0.004 \times V/(n \times Ie)$$

For the purpose of the invention, the electron-emitting devices are preferably surface conduction electron-emitting devices.

According to a still further aspect of the invention, there is provided an image-forming apparatus comprising an electron emission apparatus according to the invention and an image-forming member, characterized in that images are produced on the image-forming member by electrons emitted from the electron-emitting devices.

For the purpose of the invention, the image-forming member may be an electron emitting body or a fluorescent body that emits light when irradiated with electrons.

Said image-forming member may be arranged on the substrate on which the electrode segments are disposed.

Said electrode segments may include at least one electrode showing a horizontal to vertical dimensional ratio of 4:3 or the assembled electrode segments may show a horizontal to vertical dimensional ratio of 16:9.

According to the invention, there is also provided a voltage application apparatus comprising opposite disposed first and second electrodes and a voltage-applying means for providing said first electrode with a relatively low electric potential and said second electrode with a relatively high electric potential, characterized in that said second electrode is divided into electrode segments and a constant voltage is applied to each and all of the electrode segments.

According to the invention, there is also provided a voltage application apparatus comprising opposite disposed first and second electrodes and a power source for providing said first electrode with a relatively low electric potential and said second electrode with a relatively high electric potential, characterized in that said second electrode is divided into electrode segments and a constant voltage is applied to each and all of the electrode segments.

According to the invention, there is also provided a voltage application apparatus comprising opposite disposed first and second electrodes and a voltage-applying means for providing said first electrode with a relatively low electric potential and said second electrode with a relatively high electric potential, characterized in that said second electrode is divided into electrode segments and a selected voltage is applied to each of the electrode segments.

According to the invention, there is also provided a voltage application apparatus comprising opposite disposed first and second electrodes and a power source for providing said first electrode with a relatively low electric potential and said second electrode with a relatively high electric potential, characterized in that said second electrode is divided into electrode segments and a selected voltage is applied to each of the electrode segments.

DETAILED DESCRIPTION OF THE PREFERRED EMBODIMENTS

Now, the present invention will be described in greater detail in terms of different modes of carrying it out.

Firstly, an electron emission apparatus according to the invention will be summarily described and compared with a known electron emission apparatus by referring to equivalent circuit diagrams for them.

Figure 7:
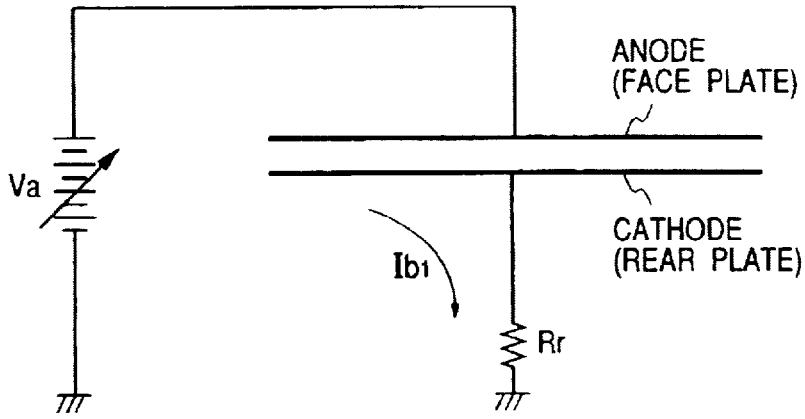
FIG. 7 PRIOR ART
FIG. 7 is a schematic circuit diagram of an equivalent circuit of a known electron emission apparatus, illustrating its operation.

FIG. 7 is a schematic circuit diagram of an equivalent circuit of a known electron emission apparatus comprising a rear plate that carriers thereon a plurality of electron-emitting devices with a matrix wiring arrangement for selectively driving the devices. The rear plate substrate has an electric potential close to that of ground (GND) and, therefore a discharge current $Ib_1$ may be produced to fluctuate the voltage being applied to the devices as a capacitor is substantiated by the face plate and the rear plate of the apparatus as a result of an electric discharge that occurs in the apparatus. While the extent of such fluctuations depends on the configuration of the component circuit (represented by resistor Rr for simplification) on the rear plate side, the electron-emitting devices can be degraded by voltage fluctuations between 1 and 5 volts, or the range in which the typical drive voltage being applied to them is found, if the devices are of the surface conduction type.

Figure 8:
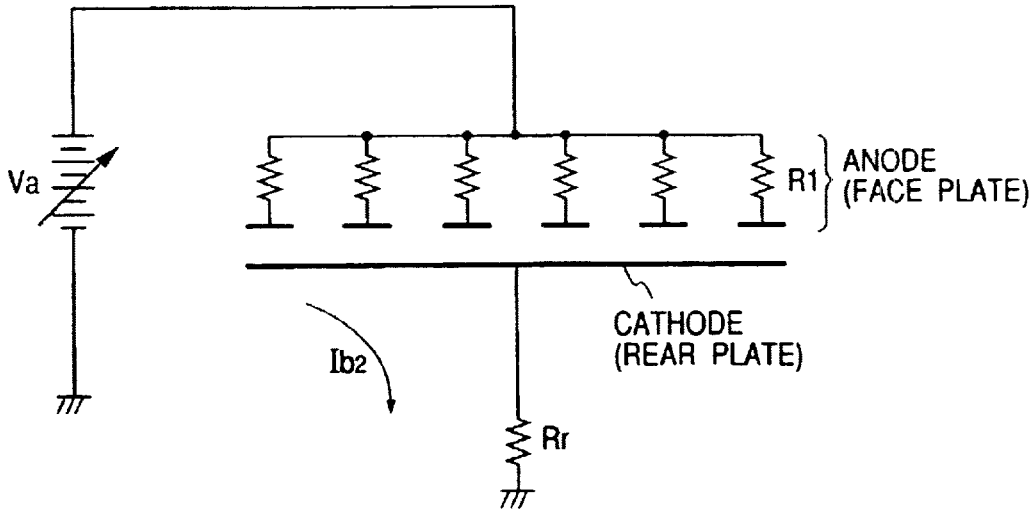
FIG. 8 is a schematic circuit diagram of an equivalent circuit of an electron emission apparatus according to the invention, illustrating its operation.
Figure 17:
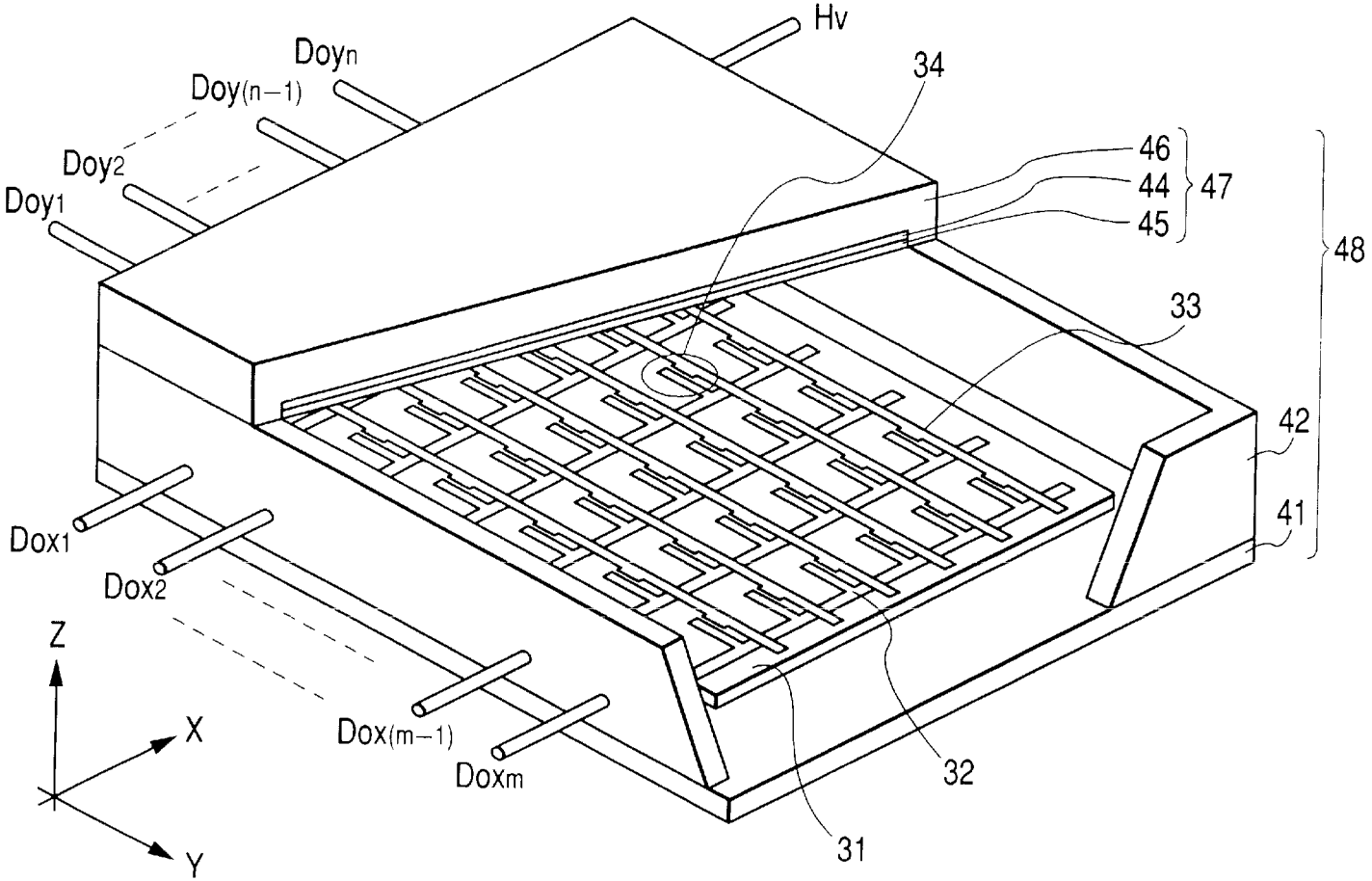
FIG. 17 is a partly cut out schematic perspective view of a plane type display that can be used for the purpose of the invention.
Figure 18A:
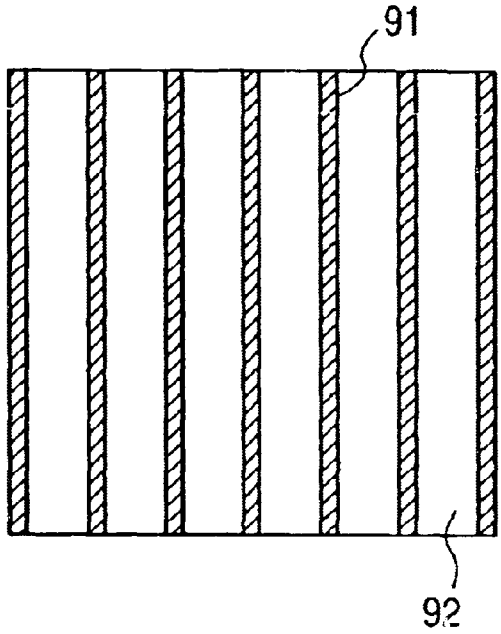
FIGS. 18A and 18B are two alternative arrangements of a fluorescent film that can be used for the purpose of the invention.
Figure 18B:
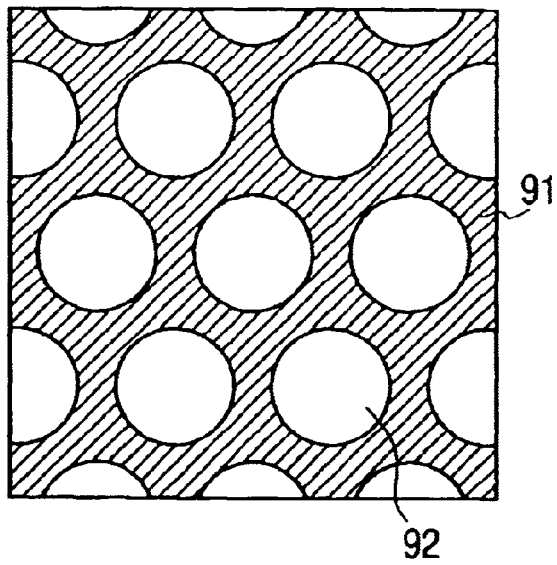
Figure 19:
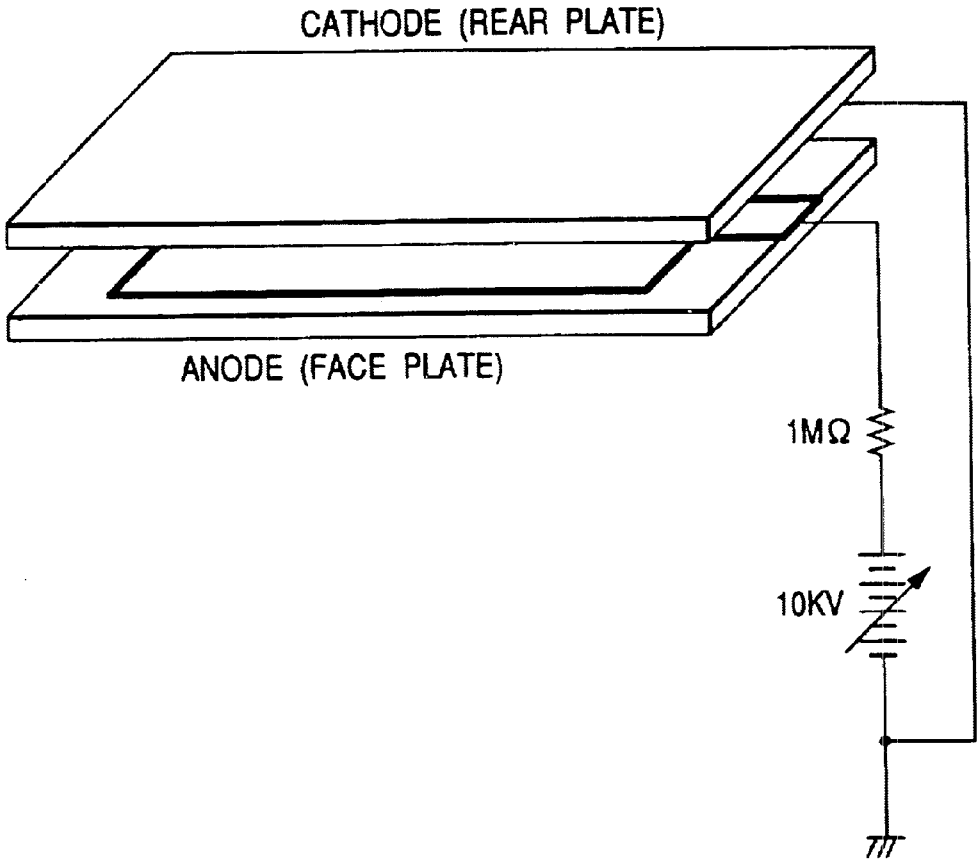
FIG. 19 PRIOR ART
FIG. 19 is a schematic perspective view of an electron emission apparatus.

In an electron emission apparatus according to the invention, the electrode (which may be a transparent electrode 44 as shown in FIG. 17 or a metal back as described earlier) arranged on the face plate side is divided into a number of electrode segments and a resistance $R_1$ is connected to each of them as shown in FIG. 8 to reduced the capacitance of the above capacitor forming part of the apparatus and hence the discharge current $Ib_2$. With this arrangement, the fluctuations in the voltage being applied to the devices due to the discharge current can also be reduced to protect the devices against damages that can occur when a discharge current appears. In FIG. 8, the electrode segments are connected in parallel with each other by way of respective resistors. Thus, this arrangement can advantageously be applied to an electron emission apparatus comprising a large number of electron-emitting devices of the surface conduction type or some other type as they may be selected and driven from the cathode side.

While U.S. Pat. No. 5,225,820 discloses a plurality of anode segments obtained by dividing an anode, they are used to select (address) the fluorescent bodies corresponding to them and make them emit light. Thus, the above identified patent has nothing to do with the components of an electron emission apparatus according to the invention.

Figure 9:
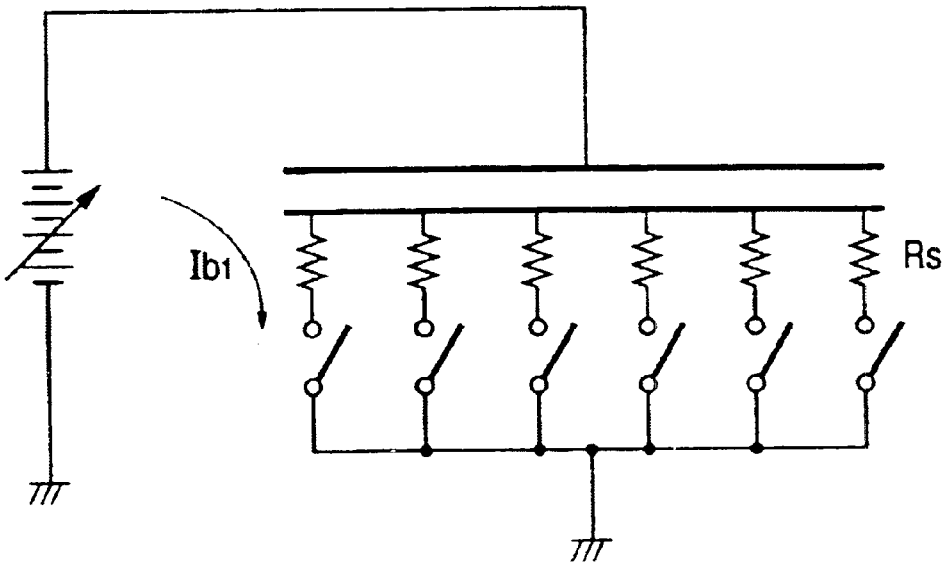
FIG. 9 PRIOR ART
FIG. 9 is a schematic circuit diagram of an equivalent circuit of another known electron emission apparatus, illustrating its operation.
Figure 10:
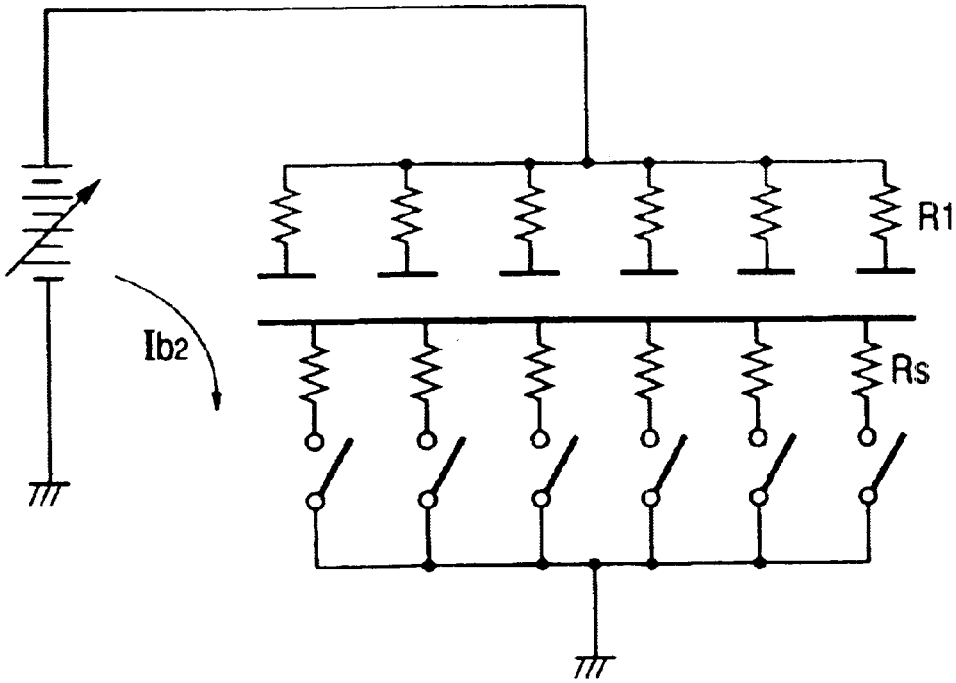
FIG. 10 is a schematic circuit diagram of an equivalent circuit of another electron emission apparatus according to the invention, illustrating its operation.

FIGS. 9 and 10 illustrate in greater detail the component circuit corresponding to the resistor Rr in FIGS. 7 and 8. It will be appreciated that switches for allowing a video signal to enter are connected to the respective elements of the resistor Rs. Destruction on the part of the electron-emitting devices by an electric discharge can take place when the voltage between the opposite ends of the resistor Rs is too large.

As described above, the anode of an electron emission apparatus according to the invention is divided into segments to reduce the electric charge that can be accumulated in a capacitor forming part of the apparatus. When the anode is divided into N segments, then the accumulated electric charge can be reduced to 1/N of the electric charge that will be accumulated when the anode is realized as one piece. Additionally, when the anode is divided along a direction not parallel with the direction along which electron-emitting devices are arranged and driven simultaneously, the electric currents that can flow into corresponding electron-emitting devices simultaneously can be confined within a narrowly limited range of intensity to prevent any significant voltage drop from occurring to them. Particularly, the maximum emission current and hence the voltage drop can be reduced to 1/N when the anode is divided along a direction perpendicular to the direction along which electron-emitting devices are arranged and driven simultaneously. Thus, both the phenomenon of irregular brightness due to the load resistance and the electric charge accumulated in the capacitor forming portion of the apparatus can be reduced simultaneously. In short, the electron-emitting devices can be protected against damages without giving rise to any visually adverse effect to the apparatus.

Figure 11:
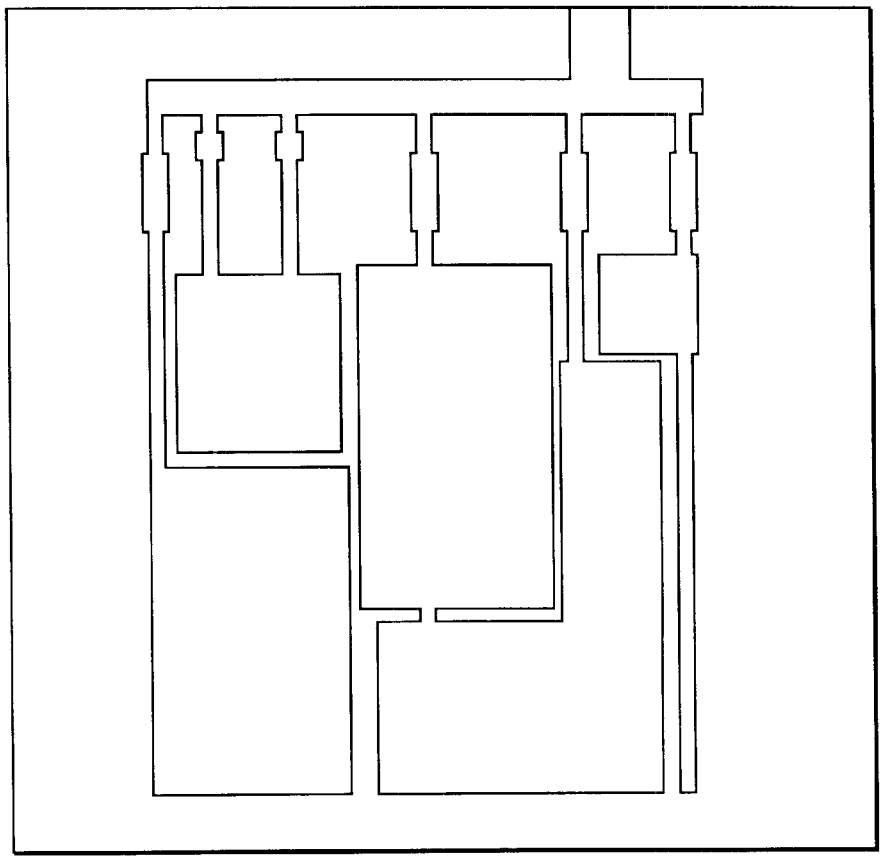
FIG. 11 is a schematic partial plan view of another face plate that can be used for an electron emission apparatus according to the invention.

The produced segments of the anode do not necessarily have a same surface area and the anode may be divided into segments of different sizes as typically shown in FIG. 11.

The effect of the segmentation is raised when a large value is selected for N. However, it will be appreciated that the accumulated electric charge can be reduced to a half when N is equal to 2, or N=2. Additionally, the accumulated electric charge may be reduced to less than a half if the two anode segments are provided with respective current limiting resistors.

While the maximum possible value that can be selected for N depends on the limitative precision for preparing the apparatus, it should be noted that the irregular brightness distribution due to a voltage drop can be effectively suppressed when a single pixel is made to correspond to an electrode segment disposed opposite to it. Thus, when m×1 pixels are arranged into a matrix, a number equal to m×1 is preferably selected for N to make N=m×1.

It is easy to divide the anode into the number of electron-emitting devices that are driven simultaneously on a line by line basis to achieve the above described effect of reducing fluctuations due to a discharge current.

Figure 1:
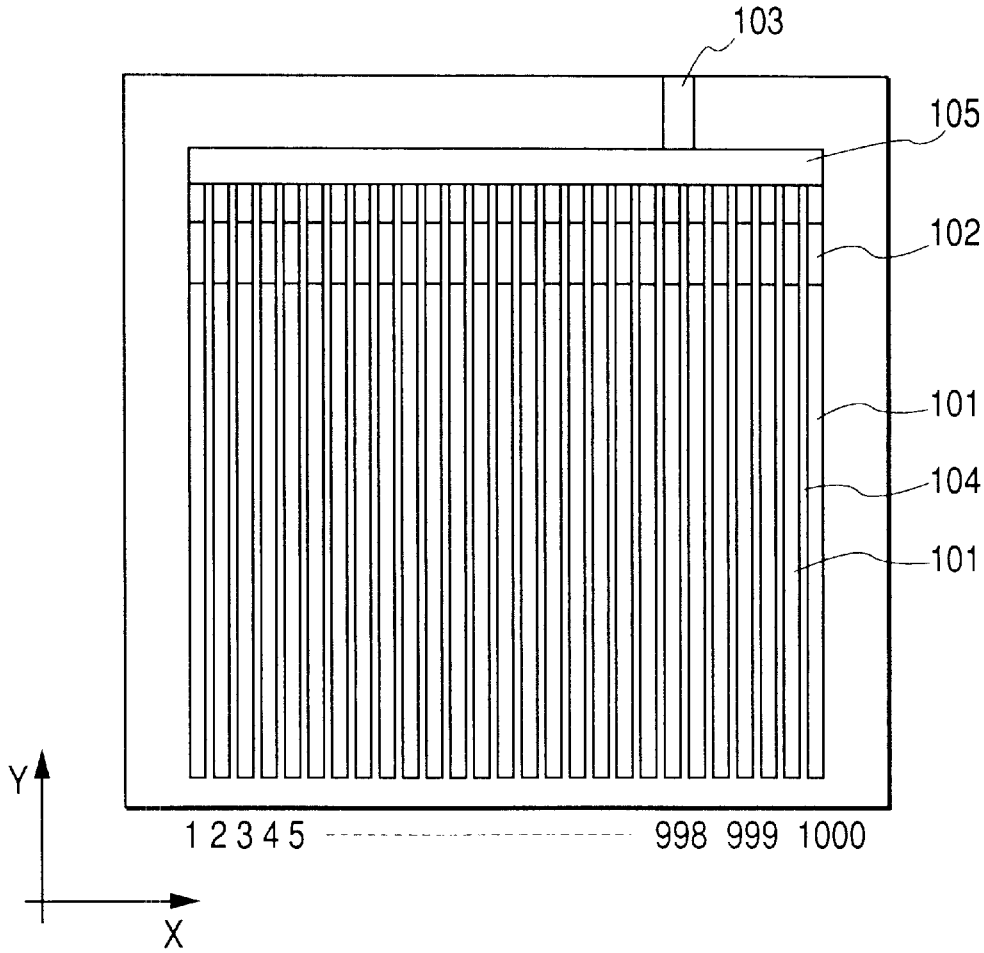
FIG. 1 is a schematic plan view of a face plate that can be used for an electron emission apparatus according to the invention.

For example, referring to FIG. 1, for driving 1,000 devices simultaneously, the ITO electrode on the face plate operating as anode is divided into 1,000 segments as denoted by 1 through 1,000 in FIG. 1, which are then aligned with the electron emitting spots 1 through 1,000 on the common electrodes (scan electrodes) (see e.g., v004) of the electron source, or the rear plate, to produce a hermetically sealed display panel as shown in FIG. 17.

The segments of the divided ITO 101 on the face plate are connected together with a common electrode 105 by way of an electrically highly resistive film 102 arranged on the same substrate (see FIG. 1) and a high voltage is applied to the terminal 103 and the common electrode 105 to accelerate electrons emitted from the electron source. The electric resistance among the ITO segments is preferably equal to or greater than that of the highly resistive film 102, although it may well be between 1/100 to 1/10 of the resistance of the film without giving rise to any problem. The electric resistance is not subjected to any upper limit.

Note, however, if a rectangularly parallelepipedic face plate is divided to produce a m×1 matrix and all the electrode segments are not located along the edges, the wires extending up to the segments that are not located along the edges may be arranged in the matrix. If, on the other hand, no such isolated segments are produced by selecting a value equal to or less than 2 for m or 1, no such wires are required and the resistors and the electrodes to be drawn out to the outside can be easily prepared.

The number of segments of the divided anode of the face plate may not necessarily be equal to the rows of electron-emitting devices of the rear plate. For example, the anode may be divided into segments that correspond to four electron emitting spots 1 through 4, 5 through 8, . . . respectively to reduce the number of segments.

Figure 5:
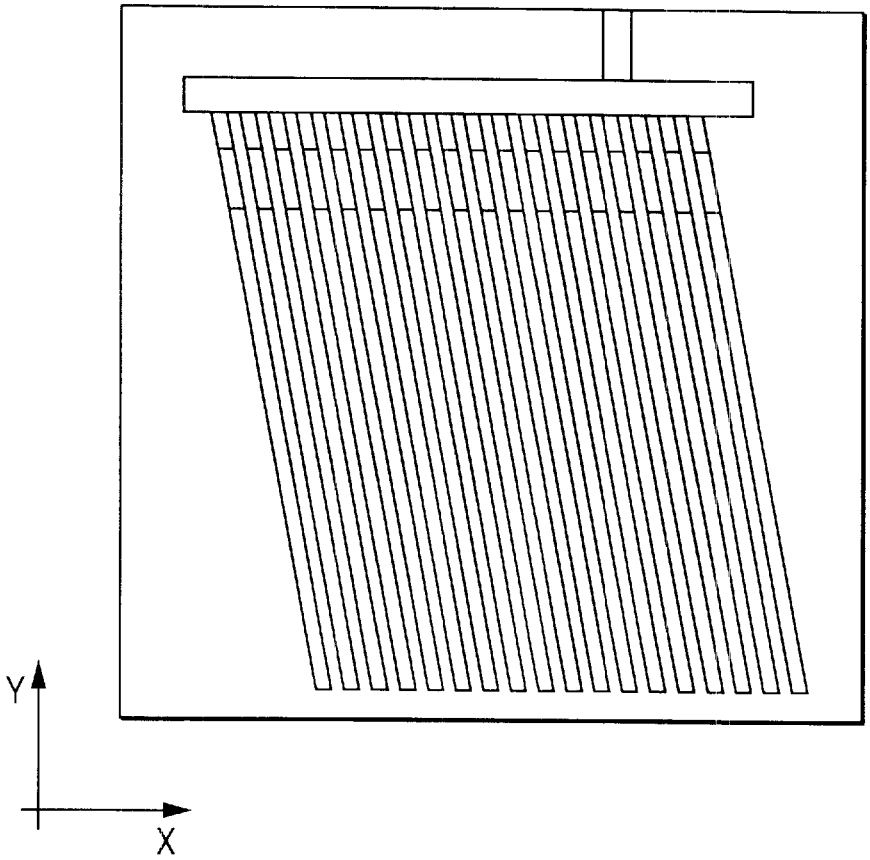
FIG. 5 is a schematic plan view of a face plate obtained by modifying that of FIG. 1.

While the anode is typically divided along a direction perpendicular to the device rows and pixels are arranged continuously on each segment to facilitate the designing procedure, the anode may alternatively be divided along a direction inclined relative to the device rows as shown in FIG. 5.

When 1,000 devices are driven simultaneously on a line by line basis and the emission current of each device is between 1 and 10 $\mu$A, an electric resistance between 0.1 and 1,000 MΩ is preferably selected. The practical upper limit for the electric resistance should be such that no irregular brightness distribution is observed when the voltage drop is between Va and a fraction of Va.

Where the fluorescent body is lined with a metal back to a thickness between 1,000 and 2,000 angstroms according to the common practice, the transmittivity of accelerated electrons will be close to 1 to realize a high light emission efficiency when the acceleration voltage is about 10 kV. If an electron emission apparatus is designed to accelerate electrons by an acceleration voltage of 10 kV and the voltage drop for the acceleration voltage of 10 kV is assumed to be about 1 kV by rule of thumb, limit combinations such as <10 $\mu$A×100 MΩ, 1 $\mu$A×1,000 MΩ>may feasibly be used. The lower limit of the electric resistance may be such that the devices are not destroyed nor subjected to visible damages by an electric current that almost flows as DC. For example, an electric current of 100 mA can remarkably destroy a device with 0.1 MΩ and Va=10 kV, although a smaller resistance may be selected if no destruction occurs to the devices because destruction appears as a function of the characteristics of the electron-emitting devices, the wiring resistance and the switching resistance of the scan electrode and the signal electrode. Thus, while the resistance to be added will feasibly be between 0.01 MΩ and 10 GΩ, a preferable range may be between 1 MΩ and 100 MΩ.

In view of the fact that 256 gradations are typically specified for TV sets and other quality image display apparatus, it is important to suppress the brightness irregularity below that level. More specifically, in order to reduce the brightness irregularity below the level corresponding to the 256 gradations or 0.4%, the fluctuations in the anode voltage and hence the voltage drop due to the resistance should be less than 0.4%. In other words, when the segments of a divided anode are connected to a resistor and driven by common wires, the voltages for accelerating electrons to be applied to the common wires should not show noticeable variances within the voltage range used for actually accelerating electrons. When, on the other hand, the segments are not connected to common wires, the voltages should be regulated so as not to show noticeable variances. Assuming that the apparatus is designed to operate only within a range where the brightness is linearly proportional to the accelerating voltage and the number of pixels that emit light simultaneously on a segment of the divided anodes is n when an accelerating voltage is V and if the permissible voltage drop is ΔV, then ΔV/V should be 0.004 or less. Then, when the resistance connected to the anode is R and the emission current of a device is Ie, $$\Delta V = R \times n \times Ie$$

and hence $$R = 0.004 \times V/(n \times Ie).$$

Since the smallest number of pixels that emit light simultaneously is 2 and hence $$R \leqq 0.002 \times V/Ie.$$

Thus, if Va=10 kV and Ie=5 $\mu$A, $$R \leqq 4\ \text{M}\Omega.$$

Similarly, if n is equal to 3, $$R \leqq 2.67\ \text{M}\Omega.$$

For displaying images by the driving devices with a simple matrix wiring arrangement, a line-sequential scanning technique is popularly used. For line-sequential scanning, the acceleration electrode is divided along a direction perpendicular to the scan wires to be used for scanning for the purpose of the invention. Then, the effect of the voltage drop due to the resistance connected to the divided acceleration electrode that is exerted on the brightness distribution is determined by the number of electron-emitting devices connected to a scan wire or n. Therefore, obviously a large resistance R can be connected when the acceleration electrode is divided into segments.

Additionally, in view of the costly popular practice of preparing thin film resistors that requires the use of laser trimming and a long manufacturing cycle time to achieve a precision level of 0.4%, an electron emission apparatus according to the invention is provided with means for selecting different drive parameters for each group of elements disposed vis-a-vis a segment of the acceleration electrode divided to correct variances in the brightness due to the variances of the resistors connected to the divided acceleration electrode.

An anti-charge film is used for the spacers of an electron emission apparatus according to the invention. It is an electroconductive film that coats the insulator substrate of each spacer to remove the electric charge accumulated on the surface of the insulator substrate. The surface resistance of an anti-charge film is preferably less than $10^{12}$ Ω, more preferably less than $10^{11}$ Ω. A anti-charge film with a low resistance level is effective for electric discharge.

In an image-forming apparatus comprising spacers coated with an anti-charge film, the surface resistance of the spacer should be found within a range that is feasible in terms of anti-charge effect and power consumption. The lower limit of the surface resistance of the anti-charge film is a function of the power consumption rate of the spacer. While the use of an anti-charge film with a low electric resistance is advantageous from the viewpoint of quickly removing the electric discharge accumulated in the spacer, such a film will make the spacer consume power at an enhanced rate. A semiconductor film is preferable relative to a metal film having a low specific resistance when used as the anti-charge film of spacers because an anti-charge film having a relatively low specific resistance will be required to be extremely thin if used in an electron emission apparatus. Generally speaking, a thin film that can be used for anti-charge applications will be in an island state and show an unstable resistance when the thickness is less than $10^2$ angstroms depending on the surface energy of the material of the thin film, the level of adhesion to the substrate and the temperature of the substrate. Such a thin film will be poorly reproducible on a commercial basis.

Therefore, the use of a semiconductor material having a specific resistance greater than a metal conductor and smaller than an insulator material is a preferable choice for the purpose of the invention. However, such a material more often than not shows a negative temperature coefficient of resistance (TCR). When the temperature coefficient of resistance is negative, the resistance of the anti-charge film falls as the surface temperature is raised by the power consumed on the surface of the spacer so that electricity can flow excessively to give rise to a thermal run away if the surface temperature rise continues. However, no thermal run away will occur so long as the rate of heat generation or that of power consumption is balanced with the rate of heat emission. Additionally, a thermal run away can hardly occur when the temperature coefficient of resistance of the material of the anti-charge film has a small absolute value.

In an experiment using an anti-charge film with a TCR of −1%, a thermal run away was observed when electricity continuously flowed through the spacer with a power consumption rate exceeding about 0.1 $W/cm^2$ on the part of the spacer, although the appearance of thermal run away may depend on the profile of the spacer, the voltage Va applied to the spacer and the temperature coefficient of resistance of the anti-charge film. The surface resistance with which the power consumption rate does not exceed 0.1 $W/cm^2$ is $10\times Va^2$ Ω or more. Thus, the anti-charge film formed on the spacer preferably shows a surface resistance between $10\times Va^2$ Ω and $10^{11}$ Ω.

As described above, the thickness of the anti-charge film formed on the insulator substrate of a spacer is preferably greater than $10^2$ angstroms. The anti-charge film can be subjected to a large stress and apt to come off from the substrate when the film thickness exceeds $10^4$ angstroms. Additionally, such a thick film will need a long film forming time at the cost bf productivity. All in all, the thickness of the anti-charge film is preferably between $10^2$ and $10^4$ angstroms, more preferably between $2.0\times10^2$ and $5.0\times10^3$ angstroms. The specific resistance of the anti-charge film is the product of the surface resistance and the film thickness. Thus, for the purpose of the invention, the specific resistance of the anti-charge film is preferably between $10^{-5}\times Va^2$ and $10^7$ Ωcm and more preferably between $2\times10^{-5}\times Va^2$ and $10^6$ Ωcm in order to realize a surface resistance and a film thickness that are advantageous for an electron emission apparatus of the type under consideration.

The acceleration voltage Va applied to electrons in an image-forming apparatus is greater than 100 V and the use of a voltage of 1 kV will be necessary for achieving a satisfactory brightness. If Va=1 kV, the specific resistance of the anti-charge film is preferably between 10 and $10^7$ Ωcm. Additionally, the spacer may be provided with a stripe-shaped contact electrode of a conductor metal film in order to establish an excellent electric contact between the anode and the wire electrode. Specifically, the anti-charge film is provided as a first member having a first electroconductivity and the contact electrode is provided as a second member having a second electroconductivity in order to improve the electrical connection between the anti-charge film and the anode or wire electrode (metal film).

In an image-forming apparatus according to the invention, spacers are arranged in such a way that they do not bridge any segments of the divided anode to prevent short-circuiting from taking place on the part of the divided anode.

If spacers are arranged to bridge segments of the divided anode, a contact electrode as described above is formed on each spacer without giving rise to any short-circuiting on the part of the divided anode.

For example, a contact electrode having a surface resistance between $10^{-1}$ and $10^{-2}$ Ω will be made to take a form of islands at the side of the divided anode. The anti-charge film will show a surface resistance between $10^8$ and $10^{11}$ Ω and prevents electric short-circuiting among the islands of the contact electrode and among the segments of the divided anode. Spacers may be arranged in position and assembled by means of a conventional technique of using a profiling jig without requiring alignment if the islands of the contact electrode have a width smaller than the gap between any adjacent segments of the divided anode. If the pitch of arranging the islands of the contact electrode is smaller than the height of the spacer, they will not exert significantly any adverse effect on the trajectories of emitted electrons and, therefore, such an arrangement is particularly advantageous for the purpose of the invention.

An image-forming apparatus comprising a face plate that carries thereon segments of a divided anode commonly connected by way of a current limiting resistor and a light emitting section adapted to emit light when irradiated with electron beams can be made to display bright and clear images without distortions when spacers having a configuration as described above are used in it. Such an image-forming apparatus will show a long service life as the elements of the apparatus are protected against destruction.

Figure 29:
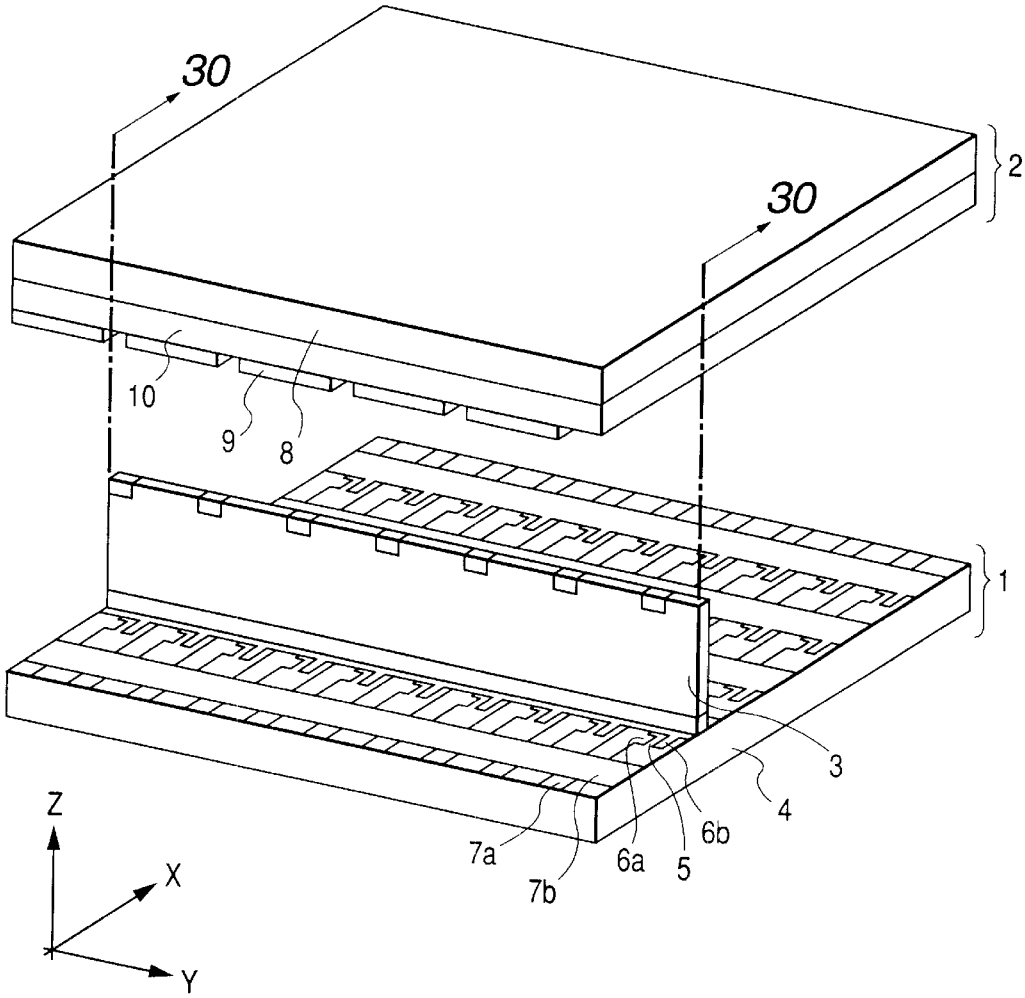
FIG. 29 is an exploded schematic perspective view of an image-forming apparatus according to the invention.
Figure 30:
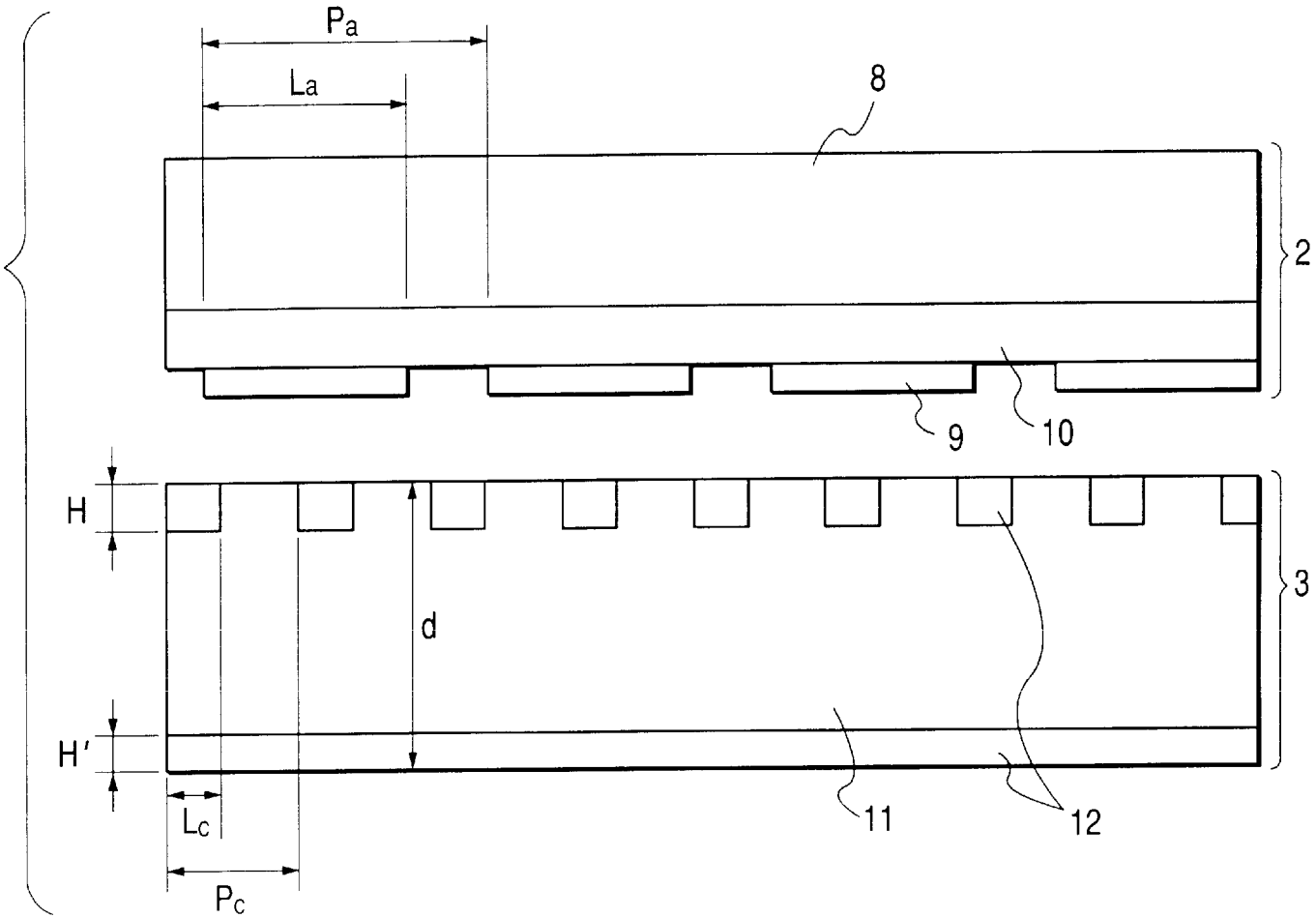
FIG. 30 is a schematic cross sectional view of the image-forming apparatus of FIG. 29.

FIG. 29 is an exploded schematic perspective view of an image-forming apparatus according to the invention and comprising spacers. FIG. 30 is a schematic cross sectional view of the image-forming apparatus of FIG. 29 taken along line 30—30 in FIG. 29.

Referring firstly to FIG. 29, the apparatus comprises a rear plate 1 that is an electron source substrate, a face plate 2 operating as an anode, spacers 3 (only one of them being shown), a substrate 4 operating as a base plate of the rear plate 1, electron-emitting devices 5, each having a pair of device electrodes 6*a* and 6*b* for applying a voltage to the electron-emitting device 5, scan electrodes 7*a* and signal electrodes 7*b* connected to the respective device electrodes 6*a* and 6*b*, a substrate 8 operating as a base plate of the face plate 2, segments 9 of a metal back and a fluorescent body 10. Referring to FIG. 30, the spacer shown carries thereon an anti-charge film 11 for providing the spacer with a certain degree of electroconductivity to alleviate the electric charge that can be accumulated there, a contact electrode 12 for improving the electric contact of the film 11 with the anode 9 and the wires arranged on the rear plate. Also referring to FIG. 30, the spacer has height d which represents the distance between the face plate and the rear plate and the contact electrode has height H at the face plate side and height H' at the rear plate side. The contact electrode is realized in the form of islands at the face plate side arranged regularly at a pitch of Pc, each having a width of Lc. The metal back 9 is divided into segments arranged regularly at a pitch of Pa, each having a width of La. While the rear plate 1 and the spacers 3 are connected in the illustrated apparatus, the face plate 2 and the spacers 3 may alternatively be connected to each other after applying insulating frit glass to the face plate 2.

The rear plate 1 is an electron source substrate including a substrate 4 on which a large number of electron-emitting devices 5 are arranged. Materials that can be used for the substrate 4 include quarts glass, glass containing impurities such as Na to a reduced concentration level, soda lime glass, glass substrate realized by forming an $SiO_2$ layer on soda lime glass, ceramic substances such as alumina, and Si substrate. When the substrate 4 is used for a large display panel, it is preferably made of soda lime glass, potassium substituted glass or a glass substrate formed by producing an $SiO_2$ layer on soda lime glass by means of a liquid phase growth technique, a sol-gel technique or a sputtering technique because such a substrate can be prepared relatively at low cost. The electron-emitting devices 5 are surface conduction electron-emitting devices.

Figure 31:
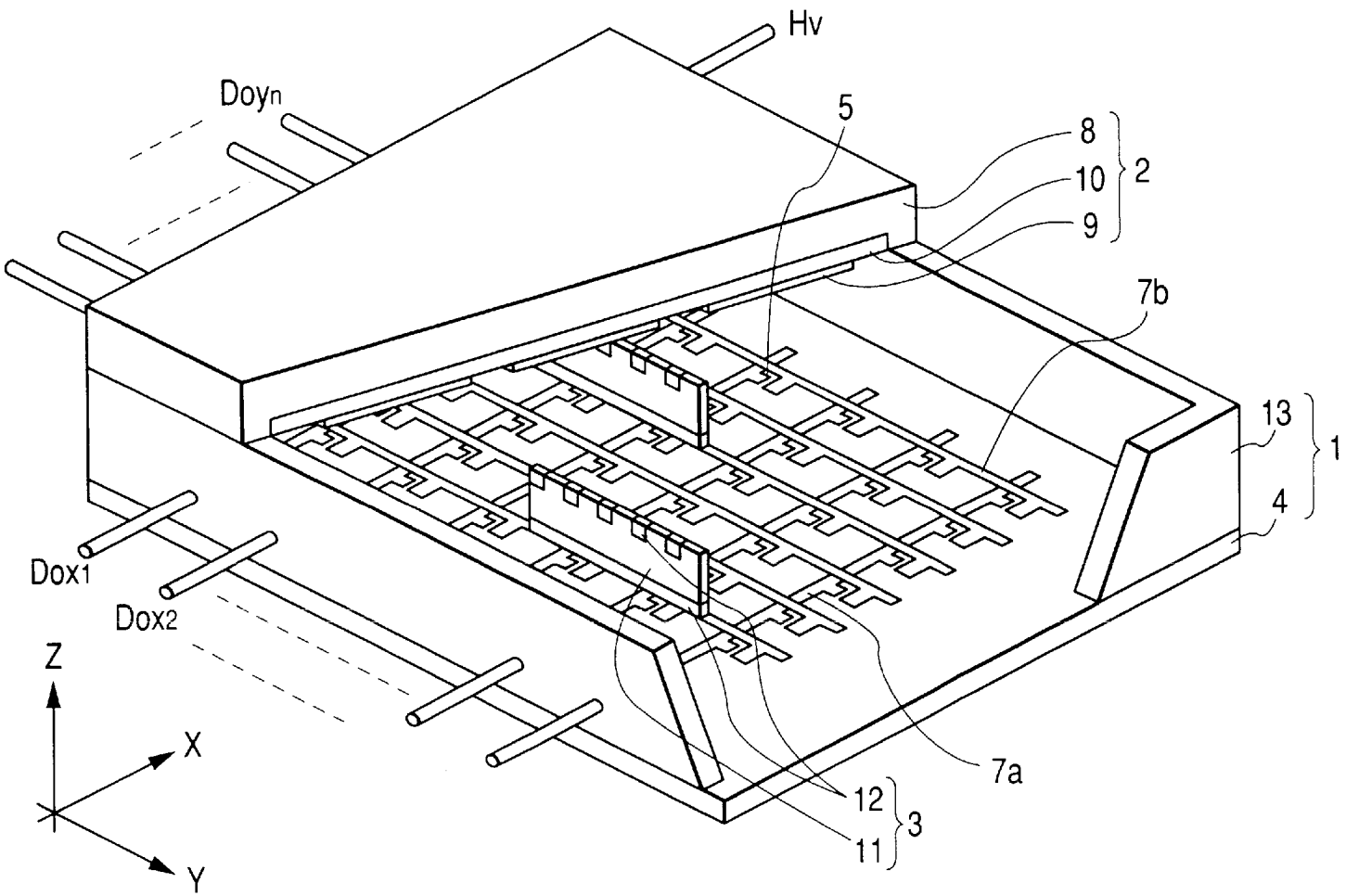
FIG. 31 is a partly cut out exploded schematic perspective view of the image-forming apparatus of Example 13 as will be described hereinafter.

FIG. 31 is a partly cut out exploded schematic perspective view of an image-forming apparatus according to the invention and prepared in Example 13 as will be described hereinafter. FIGS. 32A to 32E are schematic partial plan views of the electron source of the image-forming apparatus of FIG. 31, illustrating different manufacturing steps thereof. Note that in FIGS. 31 and 32A to 32E, those components that are same as those in FIGS. 29 and 30 are denoted respectively by the same reference symbols. Referring to FIG. 32E, reference numerals 31 and 32 respectively denote an electroconductive thin film and an electron-emitting region. The electroconductive thin film 31 is preferably a film of electroconductive fine particles with a film thickness between 10 and 500 angstroms. Materials that can be used for the electroconductive thin film 31 include various conductors and semiconductors. Materials that can preferably be used for the electroconductive thin film include Pd, Pt, Ag, Au and PdO prepared by baking organic compounds containing respective nobles metals of Pd, Pt, Ag and Au. The electron-emitting region 32 is part of the electroconductive thin film 31 and comprises an electrically highly resistive fissure, in which electroconductive fine particles with a particle diameter between several angstroms and hundreds of several angstroms that contain the elements of the electroconductive thin film 31, carbon and carbon compounds are found.

While the device electrodes 6*a* and 6*b* may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, Au, $RuO_2$, Pd—Ag and the like and glass, transparent conducting materials such as $In_2O_3$—$SnO_2$, and semiconductor materials such as polysilicon.

Electron-emitting devices may be arranged on a substrate in a number of different ways. The illustrated arrangement is referred to as a simple matrix arrangement, where a plurality of electron-emitting devices 5 are arranged in rows along an X-direction and columns along an Y-direction to form a matrix, the X- and Y-directions being perpendicular to each other. The electron-emitting devices on a same row are commonly connected to an X-directional wire 7*a* by way of one of the electrodes, or electrode 6*a*, of each device while the electron-emitting devices on a same column are commonly connected to a Y-directional wire 7*b* by way of the other electrode, or electrode 6*b*, of each device. Both the X-directional wires 7*a* and the Y-directional wires 7*b* are typically produced from an electroconductive metal by means of vacuum evaporation, printing or sputtering. These wires may be designed appropriately in terms of material, thickness and width. An interlayer insulation layer 14 is a layer of an insulator material such as glass or ceramics also formed by means of vacuum evaporation, printing or sputtering. It may be formed on the entire surface or part of the surface of the substrate 4 carrying thereon the X-directional wires 7*a* to a desired profile. The thickness, material and manufacturing method of the interlayer insulation layer are so selected as to make it withstand the potential difference between any of the X-directional wires 7*a* and any of the Y-directional wires 7*b* observable at the crossing thereof. The X-directional wires 7*a* are electrically connected to a scan signal application means (not shown) for applying a scan signal to select rows of surface conduction electron-emitting devices 5 running along the X-direction. On the other hand, the Y-directional wires 7*b* are electrically connected to a modulation signal generation means (not shown) for applying a modulation signal to modulate each of the columns of surface conduction electron-emitting devices 5 running along the Y-direction according to the input signal. Note that the drive signal to be applied to each surface conduction electron-emitting device is expressed as the difference voltage of the scan signal and the modulation signal applied to the device.

With the above arrangement, each of the devices can be selected and driven to operate independently by means of a simple matrix drive arrangement.

Alternatively, electron-emitting devices may be arranged in parallel and connected at the opposite ends thereof to form rows of electron-emitting devices (along the row direction) and driven by a control electrode (also referred to as grid) arranged above the electron-emitting devices in a direction perpendicular to the row direction (column direction) that controls electrons emitted from the electron-emitting devices. Such arrangement is referred to as a ladder-like arrangement, although the present invention is not limited to the above listed arrangements.

The face plate 2 operates as an anode prepared by forming a metal back 9 and an fluorescent film 10 on the surface of a substrate 8. The substrate 8 is preferably made of a transparent material that shows a mechanical strength and heat-related physical properties similar to those of the substrate 4 of the rear plate. More specifically, when it is used for a large display panel, it is preferably made of soda lime glass, potassium substituted glass or a glass substrate formed by producing an $SiO_2$ layer on soda lime glass by means of a liquid phase growth technique, a sol-gel technique or a sputtering technique.

The metal back 9 is divided into stripe-shaped segments by patterning using photolithography in such a way that the segments runs in parallel with the Y-directional wires 7*b* and therefore perpendicular to the X-directional wires 7*a* in order to minimize the voltage drop and each of the stripe-shaped segments is provided with a drawn-out portion commonly connected to the counterparts of the other segments by way of a current limiting resistor of about 100 MΩ, to which a high positive voltage Va is applied from an external power source. The segments of the divided anode are arranged at a pitch of Pa and each of the segments has a width of La, which are defined by the formulas below in terms of the number of devices of the image-forming apparatus and the pitch Px at which the X-directional wires are arranged.

$$Pa=n\cdot Px \text{ (n: a natural number smaller than 100) } 10^{-6}\ m \leqq Pa-La \leqq 10^{-4}\ m$$

Electrons emitted from the electron-emitting devices 5 are drawn to the face plate 2 and accelerated to collide with the fluorescent film 10. Then, bright spots are produced on the fluorescent film 10 by striking electrons if the electrons have sufficient energy. Generally speaking, a fluorescent body used in the CRT of a color TV set produces effective bright spots in color when irradiated with electrons that are accelerated by an acceleration voltage of several kilovolts to tens of several kilovolts. Fluorescent bodies that can be used for CRTs perform excellently although they are available at relatively low cost. Therefore such a fluorescent body can advantageously be used for the purpose of the invention. When a metal back is used for the anode, the brightness of the display screen can be improved as the metal back mirror reflects the component of light emitted from the fluorescent body and directed toward the rear plate 1 and the fluorescent body can be protected against damages that can be produced by negative ions generated within the envelope and colliding with the fluorescent body. When a transparent electrode is used and the support member and the transparent electrode are to be electrically connected with each other, the fluorescent body located between the transparent electrode and the support member can interfere with the electric connection. However, the fluorescent body will be crushed by the pressure difference between the outside and the inside of the envelope to realize the intended electric connection so that the arrangement of the fluorescent body between the transparent electrode and the support member may not provide any problem. Alternatively, the fluorescent body may be removed from between the transparent electrode and the support member.

Referring to FIG. 31, outer frame 13 is connected to the rear plate 1 and the face plate 2 to form an envelope. The outer frame 13 may be bonded to the rear plate 1 and the face plate 2 by means of frit glass if the rear plate 1, the face plate 2 and the outer frame 13 are made of glass, although the technique to be used for bonding them may vary depending on their materials. The spacers 11 are used to make the envelope withstand the atmospheric pressure and provide a substantially even distance d between the rear plate 1 and the face plate 2. Note that the distance d should be made sufficiently large so that no electric discharge may take place due to the high voltage Va in the vacuum within the envelope. On the other hand, electrons emitted from each of the electron-emitting devices 5 will spread within a limited angle so that neighboring pixels may be irradiated with electrons from different origins to give rise to blurred images and mixed colors if an excessively large value is selected for the distance d. Therefore, the distance d or the height of the spacers is preferably between hundreds of several micrometers and several millimeters when Va is between several kilovolts and tens of several kilovolts.

Now, a method of preparing spacers for the purpose of the invention will be described.

Firstly, contact electrodes of an electroconductive metal are formed on a cleaned glass substrate by vacuum evaporation, sputtering, printing or pulling.

It is desirable that the size of the islands of contact electrodes meets the following requirements as expressed by using the symbols shown in FIG. 30.

Firstly, the requirement that no islands of the contact electrodes bridge any of the stripe-shaped segments of the divided anode regardless of the mode of alignment will be $$Lc<Pa-La \quad (1).$$

Secondly, the requirements for suppressing any uneven distribution of an electric field that can give rise to an uneven distribution of bright spots among the elements due to the islands of contact electrodes will be $$Pc \leqq Px \leqq Pa \quad (2)$$

and $$H<<d \quad (3).$$

It is desirable that the size of the stripe-shaped contact electrodes arranged at the rear plate side meet the second requirement above.

$$H'<<d \quad (4)$$

Then, an anti-charge film is formed on each of the spacers provided with a contact electrode by vacuum deposition, sputtering, printing or pulling.

The surface resistance Rs of the anti-charge film will be required to be $$10^8\ \Omega<Rs<10^{11}\ \Omega.$$

The lower limit is selected to avoid any short-circuiting between segments of the anode and reduce the power consumption, whereas the upper limit is selected to achieve an anti-charge effect of the spacers.

When the above requirements are met, an image-forming apparatus that shows an evenly distributed strength withstanding electric discharges and uniform trajectories of emitted electrons can be prepared without specifically aligning the spacers and the face plate.

Now, the present invention will be described further by way of examples.

Throughout the drawings used for the examples, scan wires are arranged in parallel with the X-direction and signal wires are arranged in parallel with the Y-direction.

EXAMPLE 1

Figure 3:
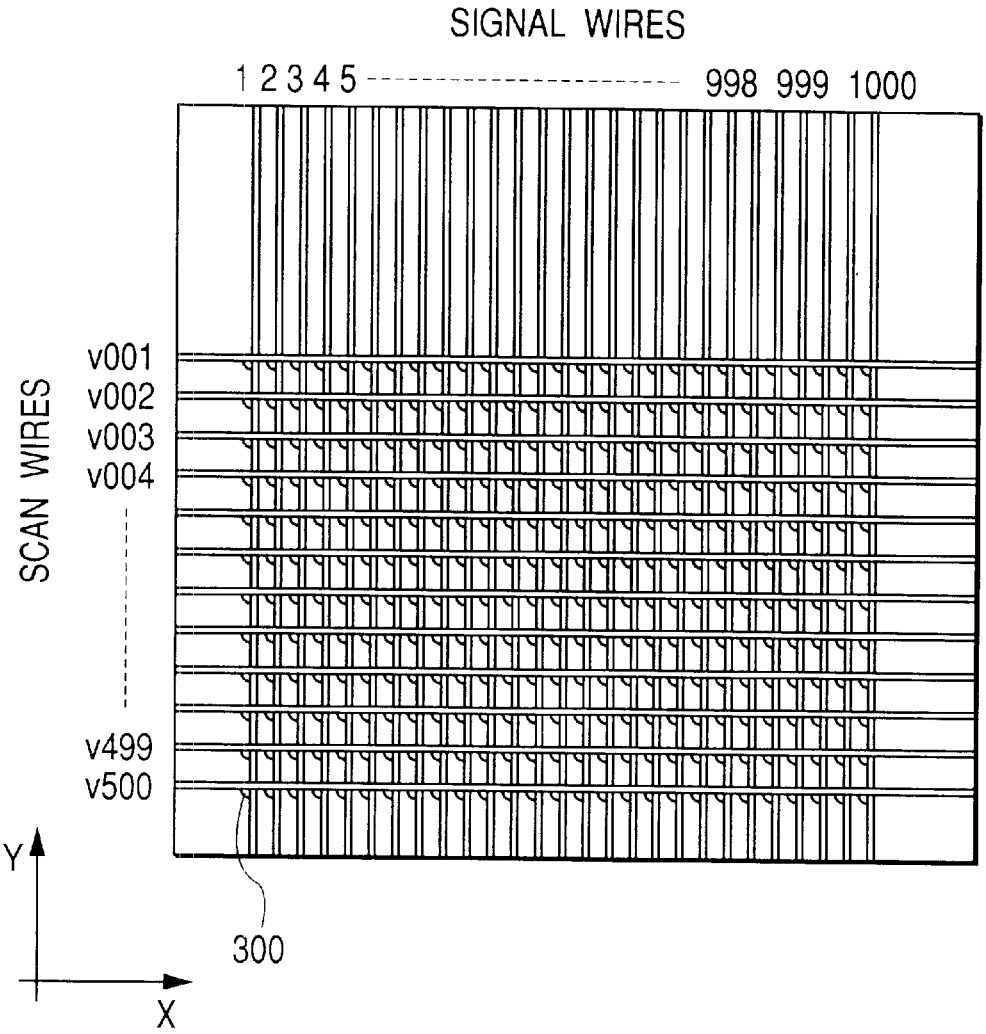
FIG. 3 is a schematic plan view of a rear plate that can be used for an electron emission apparatus according to the invention.

An image-forming apparatus comprising electron-emitting devices and having a configuration as described earlier by referring to FIG. 17 was prepared. The multiple-device electron source arranged on the rear plate of the apparatus was an SCE electron source (as will be described in greater detail hereinafter) provided with a matrix wiring arrangement as shown in FIG. 3. The electron source was so designed that 1,000 devices connected by a common wire were line-sequentially driven to operate. The electron source had a total of 1,000×500 electron emitting spots. On the other hand, the face plate of the apparatus was produced by forming uniformly an ITO film on a glass substrate, which ITO film was then divided into stripe-shaped segments (101) at a pitch of 230 μm (for 1,000 lines) by photolithography and bundled together at an end thereof by way of a resistor of 100 MΩ (a patterned NiO film (102)) so that a high voltage may be applied via a terminal 103.

Figure 2A:
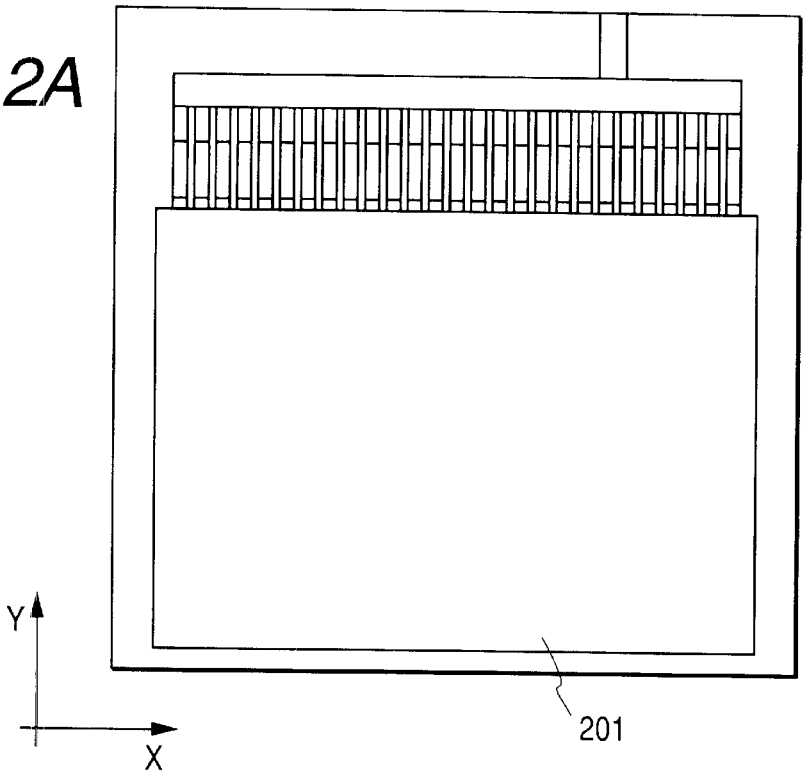
FIGS. 2A and 2B are schematic plan views of two alternative arrangements of a face plate with a fluorescent body applied thereto, the face plate of FIG. 1 or that of FIG. 5.
Figure 2B:
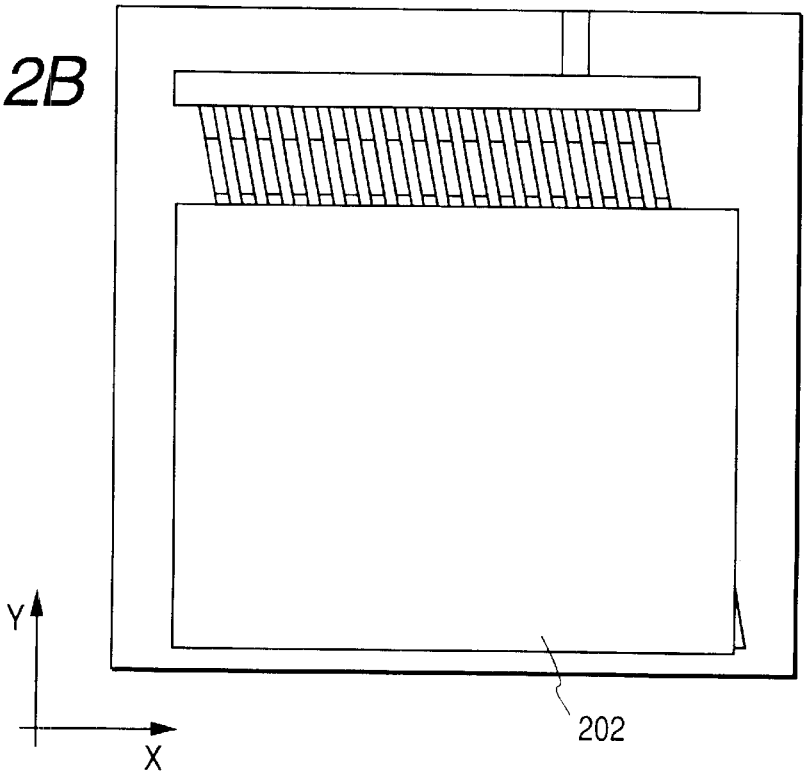

Then, referring to FIGS. 2A and 2B, a fluorescent body of (Cu doped) ZnS 201, 202 was applied to the segmented ITO film and baked to produce a face plate for applying a high positive voltage to the cold cathode multiple-device electron source (rear plate).

The common wires v001, v002, . . . v500 of the rear plate and the isolated ITO wires 101 of the face plate were arranged to rectangularly intersect each other when viewed from above. In this example, the common wires v0001, v0002, . . . , v500 were scan wires and the 1,000 devices on each of the wires may be made to emit electrons simultaneously, although the area in which the electric current flows through each of the anode is limited by dividing the anode in a direction not parallel to the direction along which the devices that may be driven simultaneously are arranged (and the scan wires are running).

Figure 4:
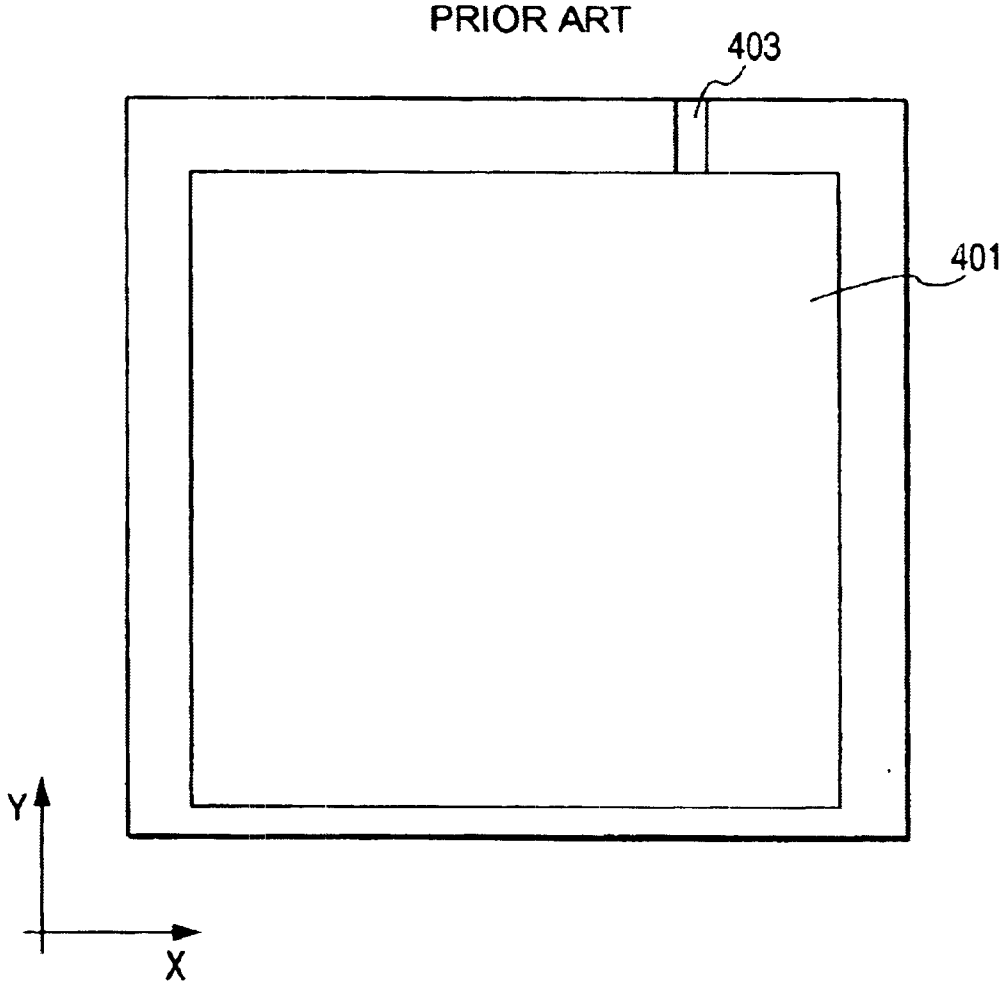
FIG. 4 PRIOR ART
FIG. 4 is a schematic plan view of a known face plate (illustrated for comparison).

The face plate and the rear plate shown respectively in FIGS. 1 and 3 were separated from each other by a distance of 2 mm to which a high voltage Va of 5 kV was applied. The line-sequential drive operation was realized at a rate of 30

μsec. per line conforming to the TV rate. The effect of electric discharges between the rear plate and the face plate was observed by reducing the level of vacuum inside the image-forming apparatus. As a result of observing the external circuits and detecting bright spots on the fluorescent body, it was confirmed that electric discharges occurred at a rate of twice per hour, although no significant degradation was observed on the brightness of the pixels due to the electric discharges. To the contrary, an image-forming apparatus prepared for the purpose of comparison and comprising an ITO film on the face plate that was not divided into segments (FIG. 4) showed a remarkable degradation of the pixels arranged along the vertical and horizontal wires in terms of brightness. In FIG. 4, reference numerals 401 and 403 respectively denotes the ITO film and the drawn out electrode of the apparatus.

Figure 12A:
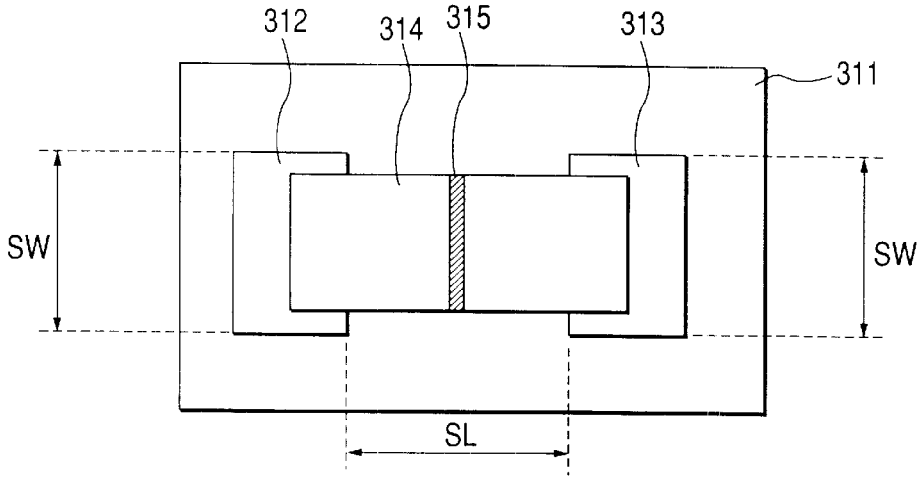
FIGS. 12A and 12B are schematic views of a surface conduction electron-emitting device that can be used for the purpose of the invention.
Figure 12B:
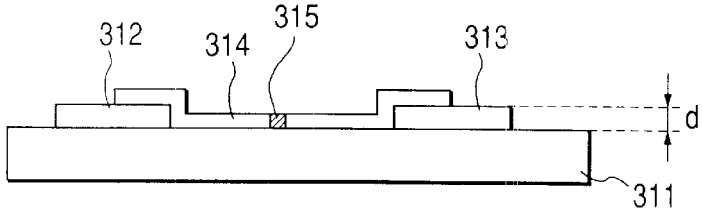

Now, the surface conduction (SCE) electron-emitting devices used in this example will be described. FIGS. 12A and 12B schematically illustrate a plane type surface conduction electron-emitting device that can be used for the purpose of the invention. FIG. 12A is a plan view and FIG. 12B is a cross sectional view. Referring to FIGS. 12A and 12B, the device comprises a substrate 311, a pair of device electrodes 312 and 313, an electroconductive thin film 314 and an electron-emitting region 315.

Materials that can be used for the substrate 311 include quartz glass, glass containing impurities such as Na to a reduced concentration level, soda lime glass, glass substrate realized by forming an $SiO_2$ layer on soda lime glass by means of sputtering, ceramic substances such as alumina as well as Si. While the oppositely disposed device electrodes 312 and 313 may be made of any highly conducting material, preferred candidate materials include metals such as Ni, Cr, Au, Mo, W, t, Ti, Al, Cu and Pd and their alloys, printable conducting materials made of a metal or a metal oxide selected from Pd, Ag, $RuO_2$, Pd-Ag and glass, transparent conducting materials such as $In_2O_3$—$SnO_2$ and semiconductor materials such as polysilicon.

The distance SL separating the device electrodes, the length SW of the device electrodes, the contour of the electroconductive film 314 and other factors for designing a surface conduction electron-emitting device according to the invention are determined depending on the application of the device. The distance SL separating the device electrodes 312 and 313 is preferably between several thousand angstroms and several hundred micrometers and, still preferably, between several micrometers and tens of several micrometers depending on the voltage to be applied to the device electrodes and the field strength available for electron emission.

The length SW of the device electrodes 312 and 313 is preferably between several micrometers and several hundreds of micrometers depending on the resistance of the electrodes and the electron-emitting characteristics of the device. The film thickness d of the device electrodes 312 and 313 is between several hundred angstroms and several micrometers. A surface conduction electron-emitting device that can be used for the purpose of the invention may have a configuration other than the one illustrated in FIGS. 12A and 12B. It may be prepared by laying a thin film 314 including an electron-emitting region on a substrate 311 and then a pair of oppositely disposed device electrodes 312 and 313 on the thin film.

The electroconductive thin film 314 is preferably a fine particle film in order to provide excellent electron-emitting characteristics. The thickness of the electroconductive thin film 314 is determined as a function of the stepped coverage of the electroconductive thin film on the device electrodes 312 and 313, the electric resistance between the device electrodes 312 and 313 and the parameters for the forming operation that will be described later as well as other factors and is preferably between several angstroms and several thousand angstroms and more preferably between ten angstroms and five hundred angstroms. The electroconductive thin film 314 normally shows a resistance Rs between $10^2$ and $10^7$ Ω/□. Note that Rs is the resistance defined by R=Rs (l/tw), where t, w and l are the thickness, the width and the length of the thin film respectively. Also note that, while the forming process is described by way of an electric energization forming process for the purpose of the present invention, it is not limited thereto and may include a process where a fissure is formed in the thin film to produce a high resistance region there.

The electroconductive thin film 314 is made of fine particles of a material selected from metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon.

The term of "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between several angstroms and several thousand angstroms and preferably between ten angstroms and two hundred angstroms. Since the term "fine particle" is frequently used herein, it will be described in greater depth below.

Usually, a small particle is referred to as a "fine particle" and a particle smaller than a fine particle is referred to as an "ultrafine particle". A particle smaller than an "ultrafine particle" and constituted by several hundred atoms is referred to as a "cluster".

However these definitions are not rigorous and the scope of each term can vary depending on the particular aspect of the particle to be dealt with. An "ultrafine particle" may be referred to simply as a "fine particle" as in the case of this patent application. "The Experimental Physics Course No. 14: Surface/Fine Particle" (ed., Koreo Kinoshita; Kyoritu Publication, Sep. 1, 1986) describes as follows.

"A fine particle as used herein referred to a particle having a diameter somewhere between 2 to 3 μm and 10 nm and an ultrafine particle as used herein means a particles having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p. 195, 11.22–26)

Additionally, "Hayashi's Ultrafine Particle Project" of the New Technology Development Corporation defines an "ultrafine particle" as follows, employing a smaller lower limit for the particle size.

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of an atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p. 2, 11.1–4). Taking the above general definitions into consideration, the term "fine particle" as used herein refers to an agglomerate of a large number of atoms and/or molecules having a diameter with a lower limit between several angstroms and ten angstroms and an upper limit of several micrometers.

The electron-emitting region 315 is part of the electroconductive thin film 314 and comprises an electrically highly resistive fissure, although its performance is dependent on the thickness and the material of the electroconductive thin film 314 and the energization forming process which will be described hereinafter. The electron emitting region 315 may contain in the inside electroconductive fine particles having a diameter between several angstroms and several hundred angstroms, which electroconductive fine particles may contain all or part of the elements that were used to prepare the thin film 314 including the electron emitting region. The electron emitting region 315 and part of the thin film 314 surrounding the electron emitting region 315 may contain carbon and carbon compounds.

Figure 13A:
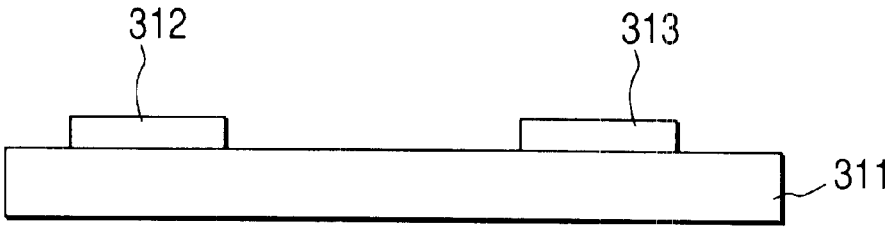
FIGS. 13A, 13B and 13C are schematic cross sectional views of a surface conduction electron-emitting device that can be used for the purpose of the invention, illustrating different manufacturing steps thereof.
Figure 13B:
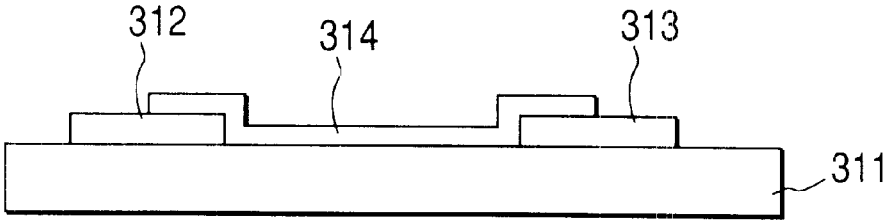
Figure 13C:
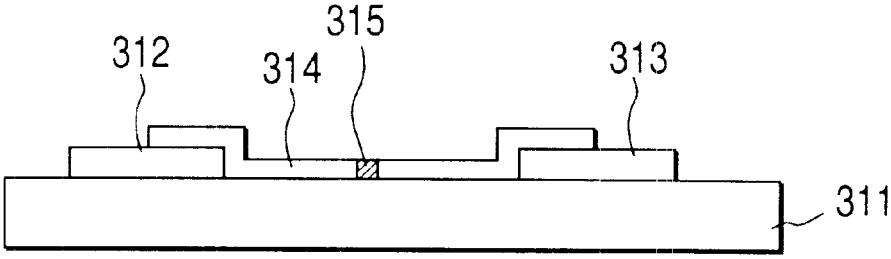

While various methods may be conceivable for manufacturing a surface conduction electron-emitting device, FIGS. 13A to 13C illustrate a typical one of such methods.

Now, a method of manufacturing a surface conduction electron-emitting device according to the invention will be described by referring to FIGS. 13A to 13C. Note that the components that are the same as those in FIGS. 12A and 12B are denoted respectively by the same reference symbols.

1) After thoroughly cleansing a substrate 311 with detergent, pure water and organic solvent, the material of the device electrodes is deposited on the substrate 311 by means of vacuum deposition, sputtering or some other appropriate technique for a pair of device electrodes 312 and 313, which are then produced by photolithography (FIG. 13A).

2) An organic metal thin film is formed on the substrate 311 carrying thereon the pair of device electrodes 312 and 313 by applying an organic metal solution and leaving the applied solution for a given period of time. The organic metal solution may contain as a principal ingredient any of the metals listed above for the electroconductive thin film 314. Thereafter, the organic metal thin film is heated, baked and subsequently subjected to a patterning operation, using an appropriate technique such as lift-off or etching, to produce an electroconductive thin film 314 (FIG. 13B). While an organic metal solution is used to produce a thin film in the above description, an electroconductive thin film 314 may alternatively be formed by vacuum evaporation, sputtering, chemical vapor phase deposition, dispersed application, dipping, spinner or some other technique.

Figure 6A:
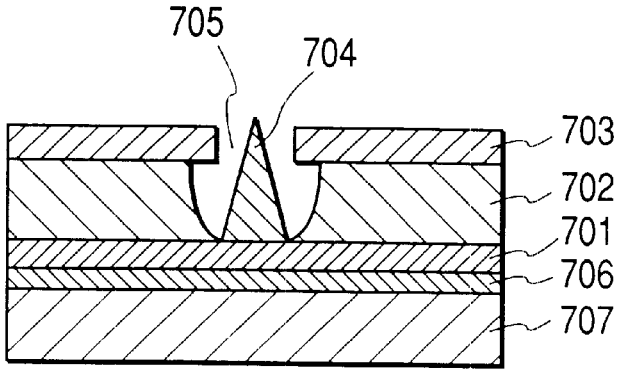
FIGS. 6A, 6B and 6C are schematic views of an array of cold cathode devices (part of a rear plate) that are not surface conduction electron-emitting devices.
Figure 6B:
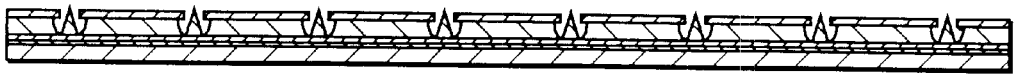

3) Thereafter, the device electrodes 312 and 313 are subjected to a process referred to as "forming". Here, an electric energization forming process will be described as a choice for forming. More specifically, the device electrodes 312 and 313 are electrically energized by means of a power source (not shown) until an electron emitting region 5 is produced in a given area of the electroconductive thin film 314 to show a structure produced by modifying that of the electroconductive thin film 314 (FIG. 13C). In other words, the electroconductive thin film 314 is locally and structurally destroyed, deformed or transformed to produce an electron emitting region 5 as a result of an electric energization forming process. FIGS. 6A and 6B shows two different pulse voltages that can be used for electric energization forming.

The voltage to be used for electric energization forming preferably has a pulse waveform. A pulse voltage having a constant height or a constant peak voltage may be applied continuously as shown in FIG. 14A or, alternatively, a pulse voltage having an increasing height or an increasing peak voltage may be applied as shown in FIG. 14B.

Figure 14A:
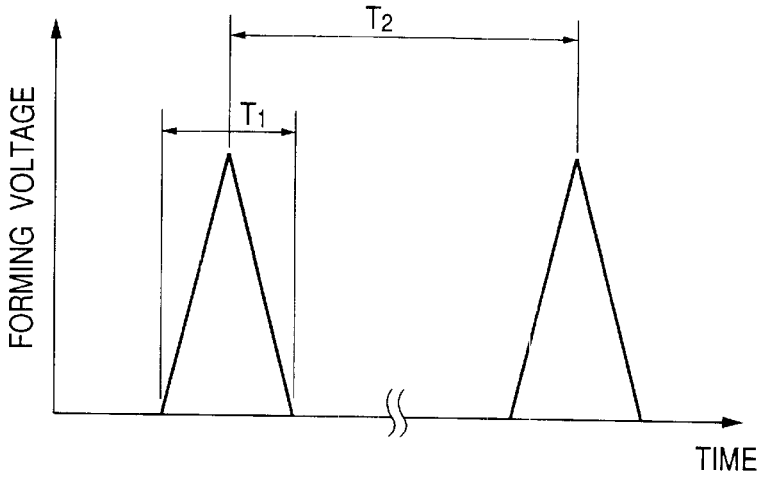
FIGS. 14A and 14B are schematic waveforms of two different voltages that can be used for energization forming for the purpose of the invention.

In FIG. 14A, the pulse voltage has a pulse width T1 and a pulse interval T2, which are typically between 1 $\mu$sec. and 10 m sec. and between 10 $\mu$sec. and 100 m sec. respectively. The height of the triangular wave (the peak voltage for the electric energization forming operation) may be appropriately selected depending on the profile of the surface conduction electron-emitting device. The voltage is typically applied for tens of several minutes. Note, however, that the pulse waveform is not limited to a triangular or rectangular waveform, and some other waveform may alternatively be used.

Figure 14B:
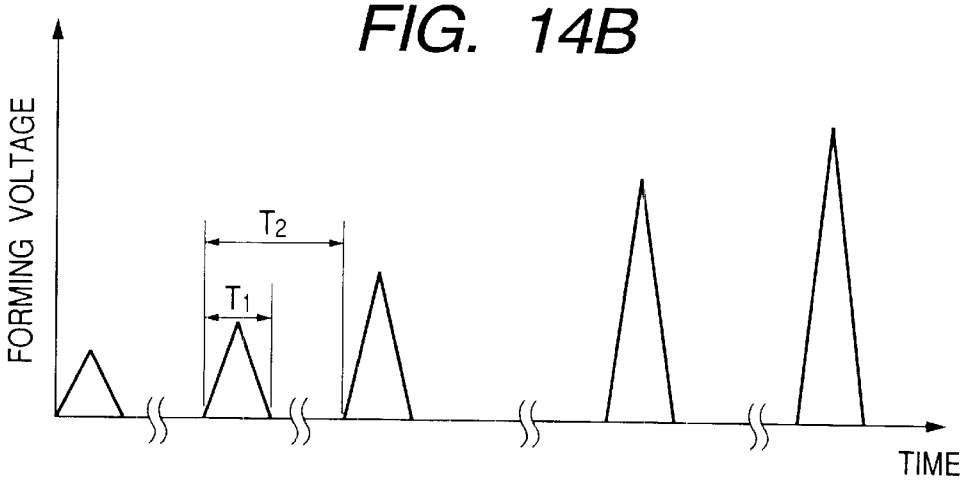

In FIG. 14B, the pulse voltage has an width T1 and a pulse interval T2 that are substantially similar to those of FIG. 14A. The height of the triangular wave (the peak voltage for the electric energization forming operation) is increased at a rate of, for instance, 0.1 V per step.

The electric energization forming operation will be terminated by measuring the current running through the device electrodes when a voltage that is sufficiently low and cannot locally destroy or deform the electroconductive thin film is applied to the device during an interval T2 of the pulse voltage. Typically the electric energization forming operation is terminated when a resistance greater than 1 M ohms is observed for the device current running through the electroconductive thin film 314 while applying a voltage of approximately 0.1 V to the device electrodes.

4) After the electric energization forming operation, the device is subjected to an activation process. An activation process is a process by means of which the device current If and the emission current Ie are changed remarkably.

In an activation process, a pulse voltage may be repeatedly applied to the device in an atmosphere of the gas of an organic substance as in the case of electric energization forming process. The atmosphere may be produced by utilizing the organic gas remaining in the vacuum envelope of the image-forming apparatus after evacuating the chamber by means of an oil diffusion pump or a rotary pump or by sufficiently evacuating a vacuum envelope by means of an ion pump and thereafter introducing the gas of an organic substance into the vacuum. The gas pressure of the organic substance is determined as a function of the profile of the electron-emitting device to be treated, the profile of the vacuum envelope, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_n H_{2n}$ such as ethylene and propylene, benzene, toluene, methanol, ethanol, formaldehyde, acetaldehyde, acetone, methylethylektone, methylamine, ethylamine, phenol, formic acid, acetic acid and propionic acid. As a result of an activation process, carbon or a carbon compound is deposited on the device out of the organic substances existing in the atmosphere to remarkably change the device current If and the emission current Ie. The end of the activation process will be determined by observing the device current If and the emission current Ie of the device. The pulse width, the pulse interval and the pulse wave height of the voltage applied to the device will be selected appropriately.

Besides the above listed organic substances, inorganic substances such as carbon monoxide (CO) may also be used for the activation process.

For the purpose of the present invention, carbon and a carbon compound include graphite (so called HOPG, PG or GC). HOPG refers to graphite having a perfect graphite structure and PG refers to graphite having a slightly disturbed graphite structure with a crystal particle diameter of about 200 angstroms, whereas GC refers to graphite having a more disturbed graphite structure with a crystal particle diameter of about 20 angstroms. They also include noncrystalline carbon (amorphous carbon, a mixture of amorphous carbon and fine graphite crystal) and the thickness of the deposit of such carbon or a carbon compound is preferably less than 500 angstroms and more preferably less than 300 angstroms.

5) An electron-emitting device that has been treated in an energization forming process and an activation process is then preferably subjected to a stabilization process. This is a process for removing any organic substances remaining in the vacuum envelope. The pressure in the vacuum envelope is referably lower than 1 to $3\times10^{-7}$ Torr and more preferably lower than $1\times10^{-8}$ Torr. The vacuuming and exhausting equipment to be used for this process preferably does not involve the use of oil so that it may not produce any evaporated oil that can adversely affect the performance of the performance of the treated device during the process. Thus, the use of a sorption pump or an ion pump may be a preferable choice. The vacuum envelope is preferably evacuated after heating the entire chamber so that the molecules of the organic substances adsorbed by the inner walls of the vacuum envelope and the electron-emitting device in the chamber may also be easily eliminated. While the vacuum envelope is preferably heated to 80 to 200° C. for more than 5 hours in most cases, other heating conditions may alternatively be selected depending on the size and the profile of the vacuum envelope and the configuration of the electron-emitting device(s) in the chamber as well as other considerations.

After the stabilization process, the atmosphere for driving the electron-emitting device or the electron source is preferably the same as the one when the stabilization process is completed, although a lower pressure may alternatively be used without damaging the stability of operation of the electron-emitting device or the electron source if the organic substances in the chamber are sufficiently removed. By using such an atmosphere, the formation of any additional deposit of carbon or a carbon compound can be effectively suppressed to consequently stabilize the device current If and the emission current Ie.

EXAMPLE 2

(The Use of Divided and Isolated Metal Back Segments of Al)

Figure 15:
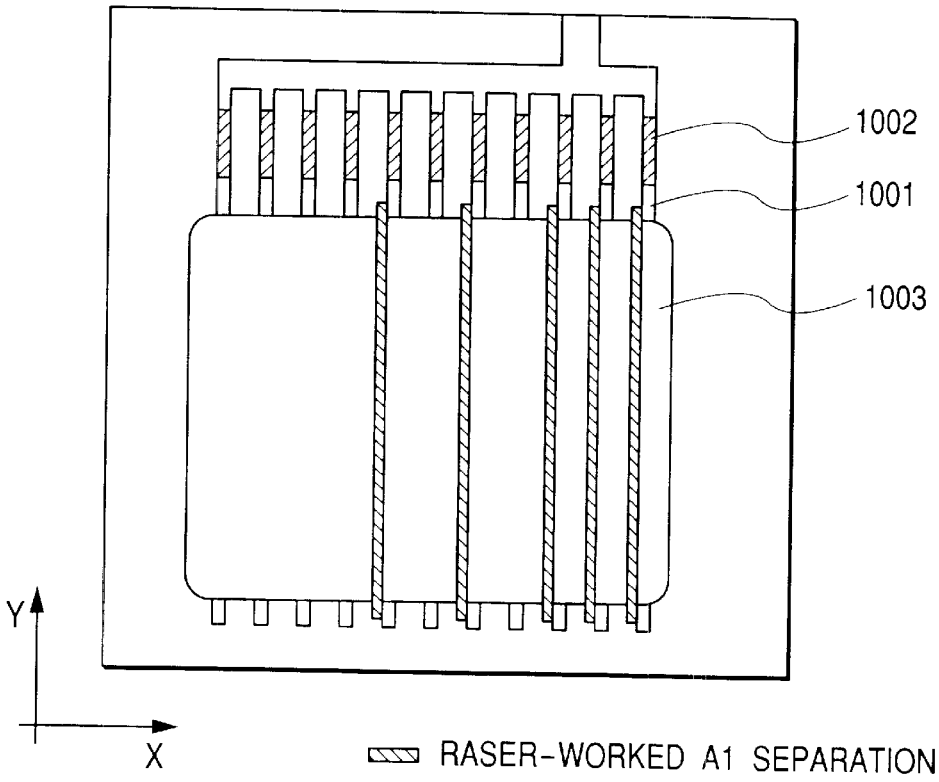
FIG. 15 is a schematic plan view of a face plate provided with an aluminum metal back that can be used for the purpose of the invention.

In this example, electroconductive black stripes (BSs) (1001) (containing carbon by 60% and water glass by 40% in a dispersed state) were formed on the glass substrate of the face plate by screen printing as shown in FIG. 15. Each of the stripes had a width of 100 μm and a thickness of 10 μm. The stripes were arranged at a pitch of 230 μm. The resistance of the stripes was 150 Ω/□.

Thereafter, stripes of $RuO_2$ (1002) were formed as a high resistance body by printing. Each of them showed a width of 100 μm, a length of 750 μm and an electric resistance of 10 MΩ. Then, R, G and B stripes were formed to fill the gaps among the BSs to a thickness of 10 μm by applying respective fluorescers P22 normally used for CRTs and baking the materials. Subsequently, a metal back of Al (1003) was formed by firstly producing an acrylic resin layer by dipping and then an Al layer to a thickness of 1,000 angstroms by evaporation and baking. Finally, the intended face plate was prepared by dividing the Al film into isolate segments, using a laser beam from the Al side.

The face plate was bonded to a rear plate that is the same as the one used in Example 1 to produce a panel, which was then subjected to a discharge resisting test. As a result of the test, it was confirmed that electric discharges occurred at a rate of twice to five times per hour, although no significant degradation was observed on the luminance of the pixels due to the electric discharges to prove the effect of remarkable reducing damages due to electric discharges as compared with the use of a face plate where isolated Al film segments are not arranged. For the purpose of comparison, isolating gaps were formed in different ways, where they were arranged for every line, every 10 lines and every 100 lines to find that the effect of reducing damages due to electric discharges was remarkable when Al film segments had a narrow width (FIG. 15 schematically shows the operation using a laser beam).

More specifically, no remarkable degradation was observed in the luminance of the pixels when isolating gaps were arranged for every line and every 10 lines, whereas several pixels were degraded (in terms of brightness) when isolating gaps were arranged for every 100 lines.

In an image-forming apparatus prepared for the purpose of comparison without dividing the Al film into isolated segments showed a remarkable degradation of the pixels arranged along the vertical and horizontal wires in terms of brightness as in Example 1.

EXAMPLE 3

(The Use of Oblique Al Evaporation)

Figure 16A:
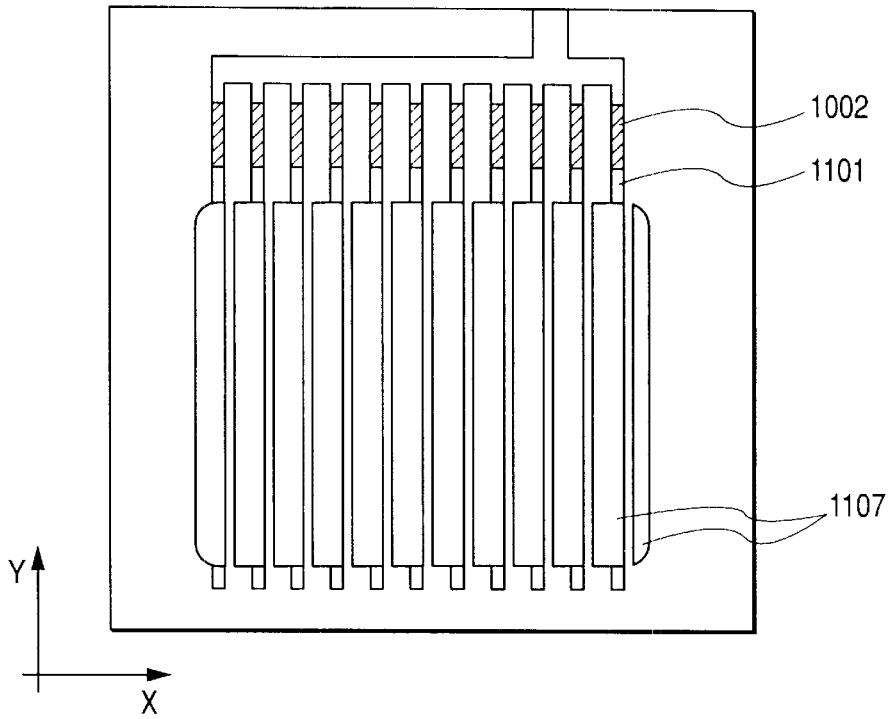
FIGS. 16A and 16B are a schematic plan view and a schematic cross sectional view, respectively, of another face plate that can be used for the purpose of the invention.
Figure 16B:
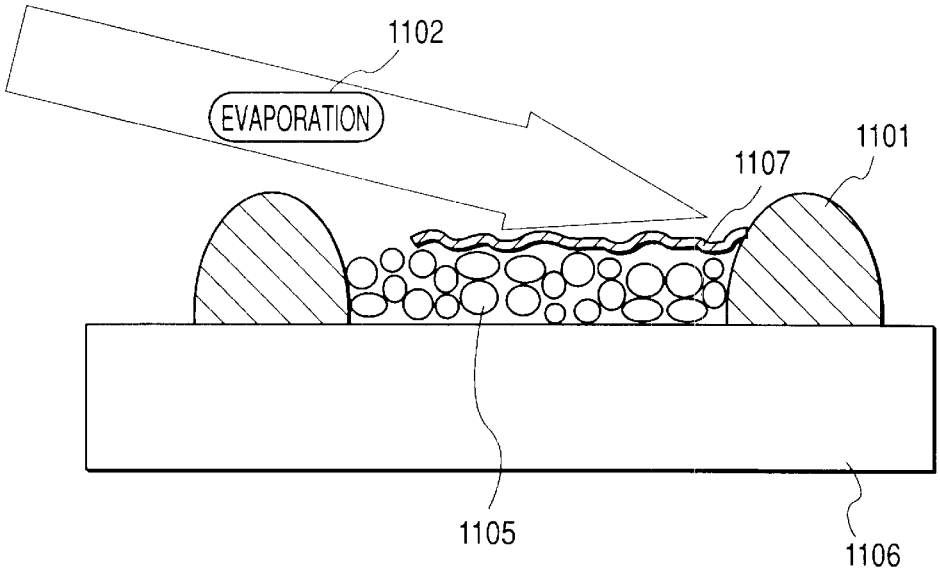

In this example, after forming a resin layer by dipping as in Example 2, an Al layer was formed by means of oblique Al evaporation as shown in FIGS. 16A and 16B. In FIGS. 16A and 16B, there are shown a fluorescent body 1105, a glass substrate 1106 of the face plate and an Al film 1107 formed by evaporation.

The BSs 1101 were made to show a height of 25 μm to produce a shadow of an Al beam 1102 as shown in FIG. 16B. Isolated segment stripes of Al film 1107 were formed by causing an Al beam to obliquely strike the face plate. After baking, it was confirmed that most (more than 90%) of the devices were electrically isolated for each line by more than 100 MΩ and then the prepared face plate was hermetically bonded to a rear plate. The devices were subjected to an activation process and then tested for the resistance against electric discharges as in Example 1 to find out a remarkable improvement as compared with a specimen comprising no isolated segments of Al film. More specifically, while it was confirmed that electric discharges occurred at a rate of one to three times per hour, no significant degradation was observed on the luminance of the pixels due to the electric discharges. To the contrary, an image-forming apparatus prepared for the purpose of comparison showed a remarkable degradation of the pixels arranged along the vertical and horizontal wires in terms of brightness. This example proved that the anode (metal back) was effective to a certain extent if it is not completely divided into isolated stripes probably because the accumulated electric charge is reduced to some extent by such insufficient isolation.

EXAMPLE 4

In this example, electroconductive black stripes (BSs) (containing carbon by 60% and water glass by 40% in a dispersed state) were formed on the glass substrate of the face plate by screen printing as shown in FIG. 15. Each of the stripes had a width of 100 μm and a thickness of 10 μm. The stripes were arranged at a pitch of 230 μm. The resistance of the stripes was 150 Ω/□. Thereafter, a stripe of $RuO_2$ was formed as a high resistance body by printing. It showed a width of 100 μm, a length of 750 μm and an electric resistance of 10 MΩ. Then, GREEN fluorescer (ZnS, additive of Cu doped $In_2O_3$, specific resistance $10^9$ Ωcm) treated for reduced resistance was applied to the entire surface to a thickness of 10 μm. The electroconductive BSs were separated by the resistance of 10 MΩ of $RuO_2$ and that of 300 MΩ of the electroconductive fluorescer arranged between adjacent BSs. An image-forming apparatus was prepared and then tested for the resistance against electric discharges as in Example 1 to find out a remarkable effect like the patterned and isolated ITO stripes in Example 1. The specific resistance of ZnS not treated for reduced resistance was $10^{12}$ Ωcm and the charge-up phenomenon was observed, if slightly, and the displayed images were less agreeable when such fluorescer was used, although the effect of resistance against electric discharges was observable. Thus, it was proved that metal back segments isolated by 1 to 100 MΩ on the face plate anode are effective for the purpose of the invention as described earlier.

EXAMPLE 5

(The Use of a Flat Film Resistor)

In this example, a transparent electroconductive film of Sb-doped $In_2O_3$ was formed to show a sheet resistance of 100 kΩ/□ on a glass substrate of the face plate.

Then, the film was divided into stripes by patterning, each anode stripe 1 having a resistance of 100 MΩ, as in Example 1 and then a printed Ag electrode 103 and an fluorescent body (not shown) were formed on the drawn out position of the anode and baked (FIG. 1). Note that the anode of this example showed a significant resistance and took the role of a resistor to be connected to it so that no separated resistor 102 was arranged.

The prepared face plate was then hermetically bonded to a rear plate to produce a display panel as in Example 1. The resistance against electric discharges was stronger than the specimen prepared for comparison and comprising a flat low resistance ITO film as shown in FIG. 4. The uneven brightness distribution due to a voltage drop was permissible for practical applications. The simultaneous emission current was ΣIe=0 to 1 mA during a line-sequential drive test and the uneven brightness distribution due to the voltage drop in the applied DC voltage was permissible.

EXAMPLE 6

Field emission type electron-emitting devices were used for the electron-emitting devices of this example.

Figure 6C:
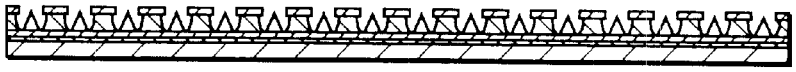

Referring to FIGS. 6A to 6C, a cathode film 706, an amorphous Si resistor film 701, an $SiO_2$ insulation film 702, a gate film 703 were formed sequentially on a glass substrate 707 of the rear plate. Thereafter, a 2 μm diameter hole was cut through the gate film by dry etching and only the $SiO_2$ layer was selectively removed by dry etching. Then, an Ni cathode wiring film was formed on the gate and an Mo film 704 was formed for the cold cathode by rotary oblique evaporation. The Mo film on the gate was removed by lifting off the nickel to produce an FE type electron source. Each electron-emitting unit of the electron source had a profile as shown in FIG. 6A.

1 to 2,000 electron-emitting devices were used for a pixel and a cathode side electron-emitting source of 1,000×500 devices was prepared for the rear plate. A face plate carrying a fluorescer applied by the method of Example 1 was also prepared and bonded to the rear plate to produce a display panel.

A voltage of 600 V was applied between the face plate and the rear plate and a plane display was realized by selectively driving necessary pixels by way of cathode wires and a gate electrode. While a display panel prepared for the purpose of comparison and comprising a face plate where the ITO of the anode was not divided into segments (FIG. 4) showed remarkable degradation due to electric discharges at the gate electrode and the tip of the Mo cathode, the face plate carrying a segmented ITO film showed damages due to electric discharges that were remarkably alleviated to prove the effect of the present invention. More specifically, the luminance of the pixels was not remarkably degraded due to electric discharges in a given period of time in the display panel comprising segmented ITO film, whereas a luminance reduction by more than 50% was observed at 20 pixels due to electric discharges in the display panel prepared for the purpose of comparison.

EXAMPLE 7

In this example, an ITO film was formed on a glass substrate as in Example 1 and divided into isolated segments that were arranged at a pitch of 230 μm (for 1,500 lines) and bundled at an end thereof by a resistor of 100 MΩ (formed by segmented $RuO_2$ produced by screen printing) so as to make it possible to apply a high voltage.

Then, an insulating black stripe was formed into each groove separating the segments of ITO film by printing and fluorescers (P22) of RGB were applied cyclically on the isolated ITO stripes 101 and baked. After forming an Al metal back, it was also segmented into stripes on the BSs by means of a laser beam to produce a color face plate to be used for applying a high anode voltage to a cold cathode multiple-device electron source (rear plate), which will be described hereinafter (FIG. 1).

A total of 1,500×500 SCE electron-emitting devices were formed on the rear plate and common wires were arranged perpendicularly relative to the isolated ITO stripe wires on the face plate in such a way that the electron-emitting devices and the corresponding RGB fluorescers were accurately aligned relative to each other.

The face plate and the rear plate were separated by 3 mm and a high voltage Va of 8 kV was applied in a scrolling manner at a rate of 30 μsec. per line, which is same as the TV rate, for line-sequential drive. Electric discharges were generated between the rear plate and the face plate and detected by observing external circuits and detecting bright spots on the fluorescent body by means of a CCD camera. While electric discharges were observed at a rate of up to 5 discharges per hour in the initial stages, no significant degradation was observed on the luminance of the pixels. To the contrary, an image-forming apparatus prepared for the purpose of comparison and comprising an ITO film on the face plate that was not divided into segments showed a remarkable degradation of the pixels arranged along the vertical and horizontal wires in terms of brightness.

EXAMPLE 8

The face plate of this example had a structure as will be described below.

Figure 20:
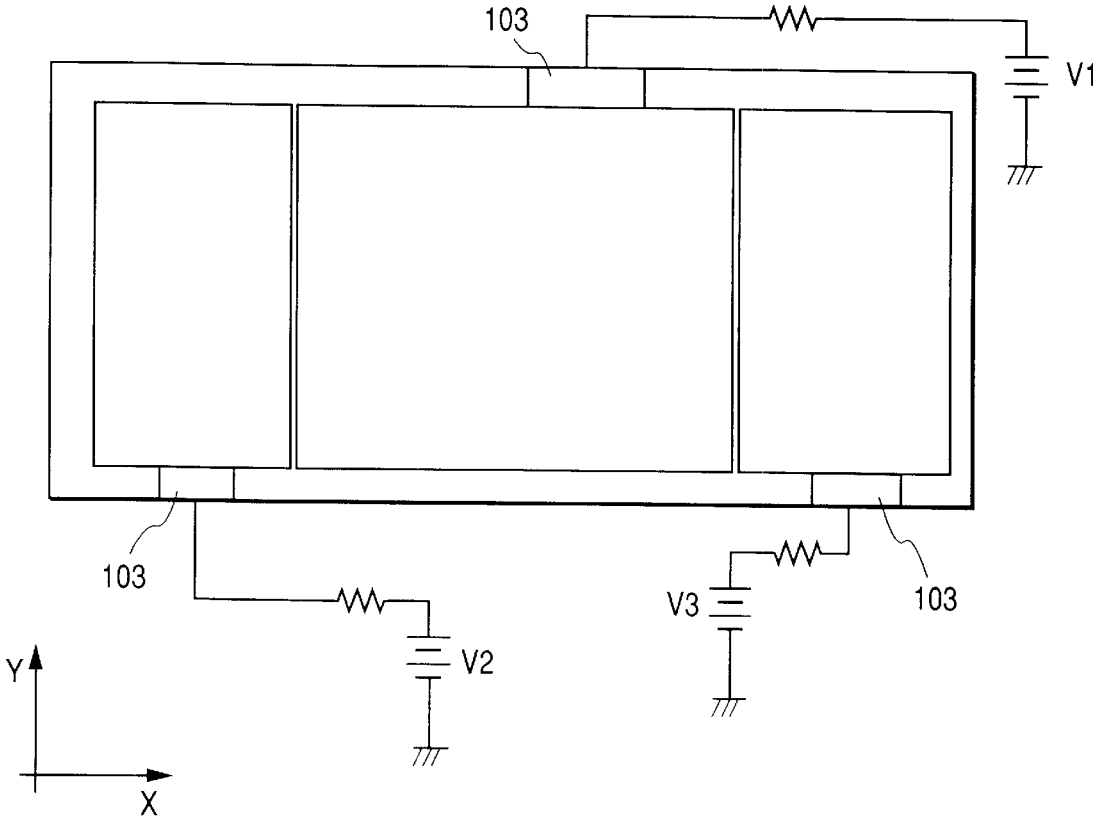
FIG. 20 is a schematic plan view of the face plate of Example 8 as will be described hereinafter.
Figure 21:
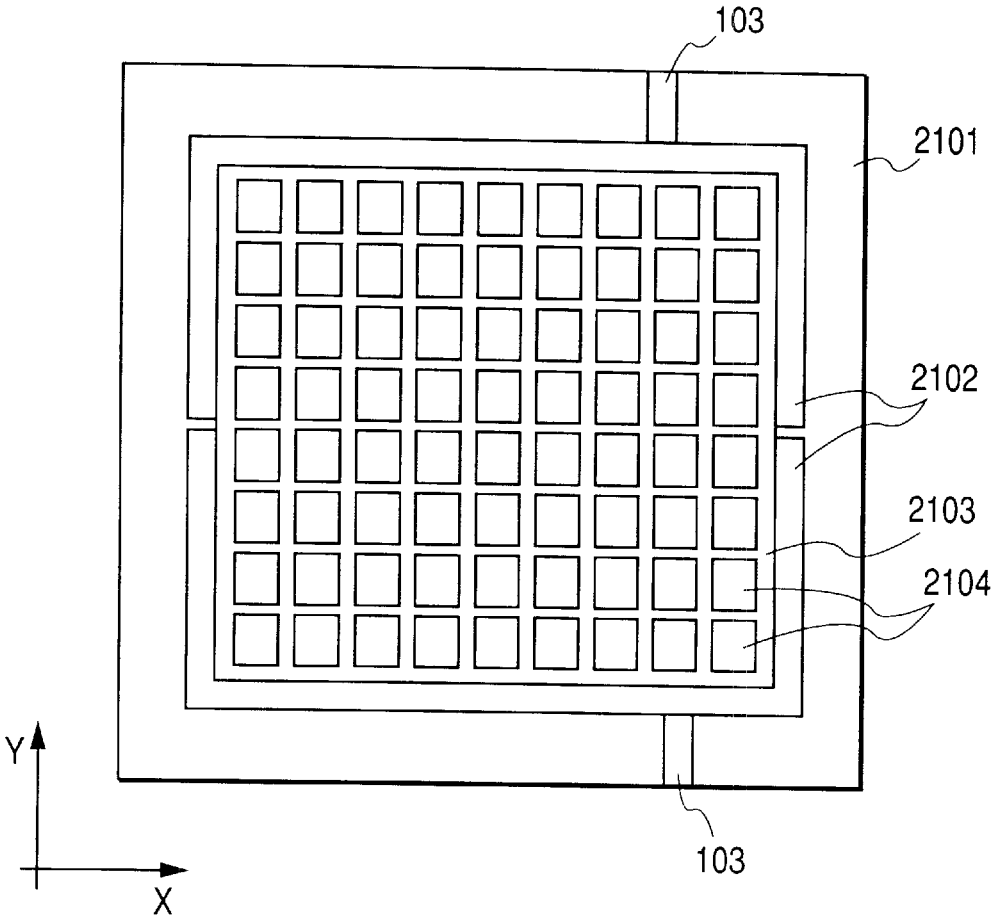
FIG. 21 is a schematic plan view of the face plate of Example 9 as will be described hereinafter.

Referring to FIG. 20, three drawn out Ag wires 103 were formed on the glass substrate of the face plate by printing.

Then, insulating black stripes were formed both horizontally and vertically. Each of the horizontal stripes had a width of 100 μm and a thickness of 10 μm. The stripes were arranged at a pitch of 282 μm. Each of the vertical stripes had a width of 300 μm and a thickness of 10 μm. The stripes were arranged at a pitch of 842 μm. The drawn out wires were connected to power sources V1, V2 and V3 by way of resistors 3 respectively to apply respective acceleration voltages to the drawn out wires. The resistors had respective resistances of 10.1 MΩ, 10.3 MΩ and 10.4 MΩ. Then, R, G and B stripes were formed to fill the gaps among the BSs to a thickness of 15 μm by applying respective fluorescers P22 normally used for CRTs and baking the materials. Subsequently, a metal back of Al was formed (by firstly producing an acrylic resin layer by dipping and then an Al layer to a thickness of 1,000 angstroms by evaporation and baking). The face plate had a display area with an aspect ratio of about 16:9.

Finally, the intended face plate was prepared by dividing the Al film into three isolate segments along the 320th vertical black stripes from both the left and right side edges, using a laser beam from the Al side.

The rear plate carried a total of 2,556×480 SCE electron-emitting devices.

The face plate and the rear plate were aligned and hermetically bonded in such a way that the electron-emitting devices and the corresponding RGB fluorescers were accurately aligned relative to each other. The face plate and the rear plate were separated by 3 mm and a high voltage Va of 8 kV was applied in a scrolling manner at a rate of 30 μsec. per line, which is same as the TV rate, for line-sequential drive.

When the face plate was made to emit light over the entire surface and the brightness was observed by means of a CCD camera, the area corresponding to the acceleration electrode, or the drawn out electrode, connected to the resistor with the highest resistance showed a relatively poor brightness to reflect the variances in the resistance. However, the differences in the brightness among the segmented electrodes could be suppressed under the allowance of measurement by regulating the outputs of the high voltage sources.

Electric discharges were generated between the rear plate and the face plate and detected by observing external circuits and detecting bright spots on the fluorescent body by means of a CCD camera. While electric discharges were observed at a rate of up to 5 discharges per hour in the initial stages, no significant degradation was observed on the brightness of the rear plate side elements.

When NTSC images having an aspect ratio of 4:3 were displayed at the center of the display screen by reducing the high voltage to 0.3 kV in the surrounding zone, the number of discharges was reduced down to twice per hour and no electric discharges were observed in the surrounding zone. Additionally, no significant degradation was observed on the luminance of the pixels.

EXAMPLE 9

The multiple-device electron source of the rear plate of this examples was an SCE electron source with a matrix wiring arrangement, which was adapted to be driven line-sequentially by a unit of 1,500 devices. The number of electron emitting spots was 1,500×500.

On the other hand, the face plate was prepared by forming an ITO film 2102 on a glass substrate 2101 that was divided into two segments and provided with a drawn out electrode 103, to which a high voltage was applied by way of an external resistor (not shown) of 10 kΩ.

Then, insulating black stripes were formed vertically and horizontally on the ITO film by printing. Each of the stripes had a width of 100 μm and a thickness of 10 μm. The stripes were arranged at a pitch of 282 μm (not shown). Then, R, G and B stripes (2103) were formed to fill the gaps among the BSs to a thickness of 15 μm by applying respective fluorescers P22 normally used for CRTs, to which a certain degree of electroconductivity was provided (by using an additive of $In_2O_3$, specific resistance $10^9$ Ωcm), and baking the materials. Subsequently, a metal back of Al (2104) was formed (by firstly producing an acrylic resin layer by dipping and then an Al layer to a thickness of 1,000 angstroms by evaporation and baking). Finally, the intended color face plate was prepared by dividing the Al film into isolate segments along the black stripes, using a laser beam, in order to apply a high anode voltage to the cold cathode multiple-device electron source (rear plate).

Figure 22:
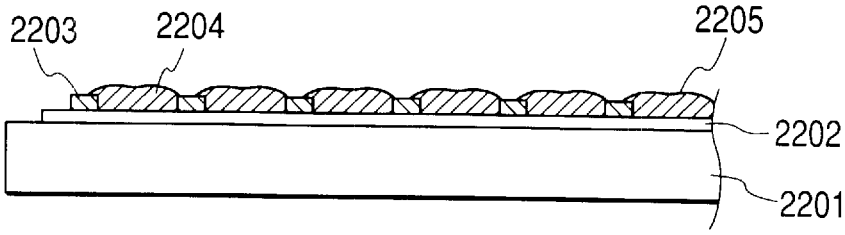
FIG. 22 is a schematic partial cross sectional view of the face plate of Example 9.

FIG. 22 schematically shows a cross sectional view of the face plate of this example.

Referring to FIG. 22, it comprised a glass substrate 2201, an ITO film 2202, black stripes 2203, fluorescent bodies 2204, and a metal back 2205. The metal back was insulated and isolated from the black stripes for each pixel by the resistance of the florescent bodies so that, when electric discharges occurred, the electric current that was generated by the small electric charge accumulated in each capacitance component of the metal back corresponding to a single pixel flowed out but the electric current supplied by the power source was limited by the resistance of the fluorescent bodies and the external resistance and, therefore, would not destroy the devices. A face plate was also prepared by using electrically non-conductive fluorescers and bound to be effective for suppressing the electric current due to electric discharges, although the brightness was slightly reduced to the electric charge of the face plate.

The face plate and the rear plate were aligned and hermetically bonded in such a way that the electron-emitting devices and the corresponding RGB fluorescers were accurately aligned relative to each other.

The face plate and the rear plate were separated by 3 mm and a high voltage Va of 8 kV was applied in a scrolling manner at a rate of 30 μsec. per line, which is the same as the TV rate, for line-sequential driving, Electric discharges were generated between the rear plate and the face plate and detected by observing external circuits and detecting bright spots on the fluorescent body by means of a CCD camera. While electric discharges were observed at a rate of up to 8 discharges per hour in the initial stages, no significant degradation was observed on the luminance of the pixels. To the contrary, an image-forming apparatus prepared for the purpose of comparison and comprising an ITO film on the face plate that was not divided into segments showed a remarkable degradation of the pixels arranged along the vertical and horizontal wires in terms of brightness.

EXAMPLE 10

The multiple-device electron source of the rear plate of this example was an SCE electron source with a matrix wiring arrangement, which was adapted to be driven line-sequentially by a unit of 2,556 devices. The number of electron emitting spots was 2,556×480.

Figure 23:
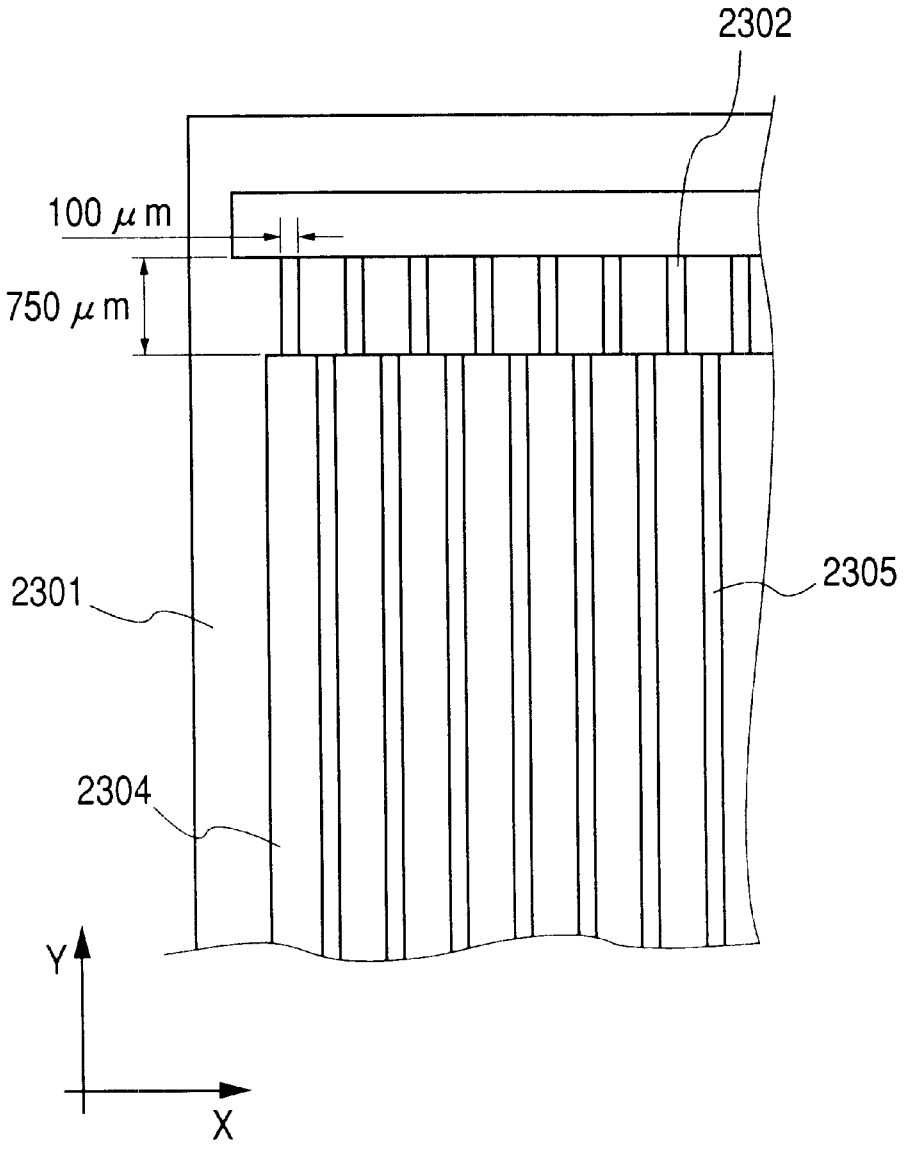
FIG. 23 is an enlarged schematic partial plan view of the face plate of Example 10 as will be described hereinafter.

On the other hand, FIG. 23 shows an enlarged partial cross sectional view of the face plate.

A drawn out wire 2303 of Ag was formed on a glass substrate 2301 of the face plate by printing. Then, insulating black stripes 2305 were formed by screen printing. Each of the stripes had a width of 100 μm and a thickness of 10 μm. The stripes were arranged at a pitch of 282 μm (not shown). Thereafter, a stripes of $RuO_2$ (2302) was formed as high resistance body by printing. It showed a width of 100 μm, a length of 750 μm and an electric resistance of 100 MΩ.

Figure 24:
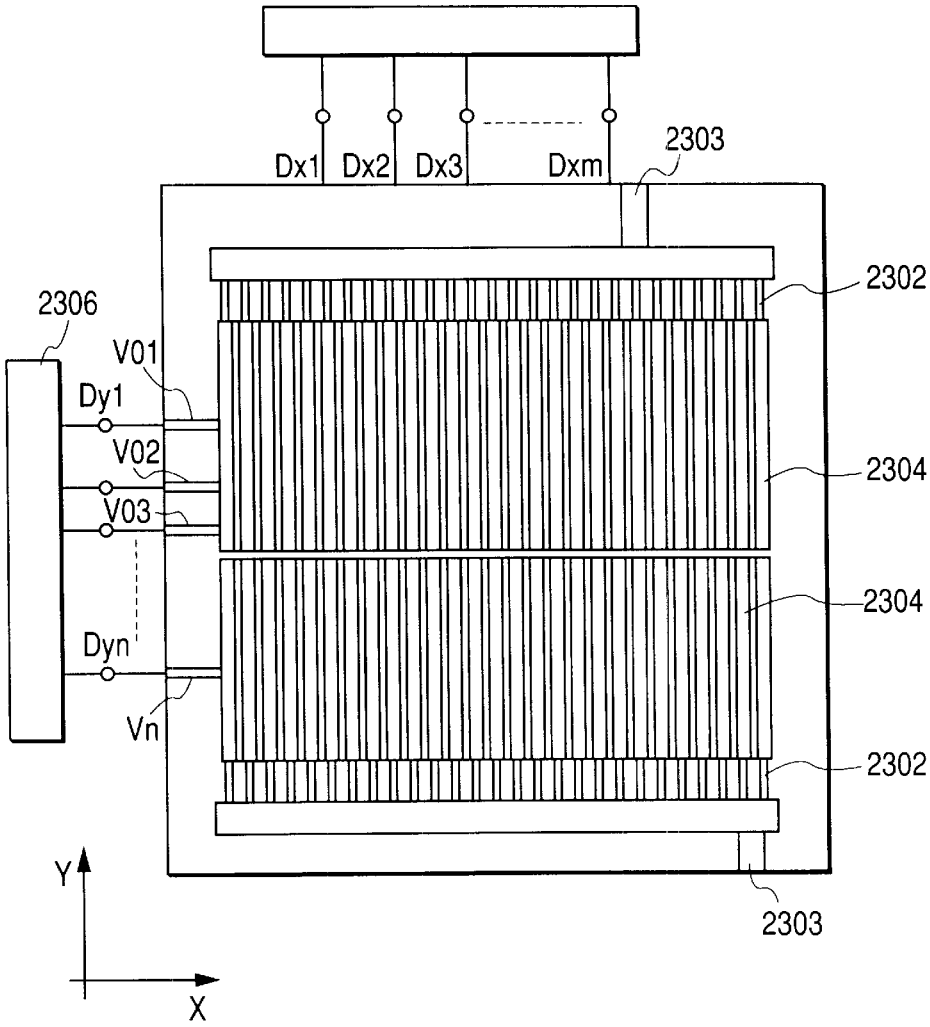
FIG. 24 is a schematic plan view of the face plate of Example 10.

Then, R, G and B stripes were formed to fill the gaps among the BSs to a thickness of 15 μm by applying respective fluorescers P22 normally used for CRTs and baking the materials. Subsequently, a metal back of Al (2304) was formed (by firstly produced an acrylic resin layer by dipping and then an Al layer to a thickness of 1,000 angstroms by evaporation and baking). Finally, the intended color face plate was prepared by dividing the Al film into isolate segments along the black stripes, using a laser beam, and then dividing it further into two in a direction perpendicular to the scanning lines as shown in FIG. 24, which shows the face plate laid on the rear plate. Thus, the metal back of the face plate operating as acceleration electrode was divided into stripes having a width that corresponds to each of the electron-emitting devices.

The common wires v01, v02, . . . and the isolated stripes of aluminum of the metal back 2304 were arranged to rectangularly intersect each other as shown in FIG. 24.

The wires of the display panel were connected to the external circuit by way of terminals D×1 to D×m (m=2,556) and Dy1 through Dyn (n=480).

The output of the scanning circuit 2306 is connected to the terminals Dy1 through Dyn of the rear plate to drive the common wires v01, v02, . . . in a scrolling manner at a rate of 30 μsec, 60 Hz.

The scanning circuit 2306 comprised a total of n switching devices in the inside, each of which was adapted to select one of the two output voltages Vs and Vsn of a DC voltage source (not shown) and electrically connect it to the terminals Dy1 through Dyn of the display panel. Each of the switching devices was adapted to switch its output from potential Vs to Vns or vice versa according to control signal Tscan transmitted from a timing signal generator circuit 2607.

Figure 26:
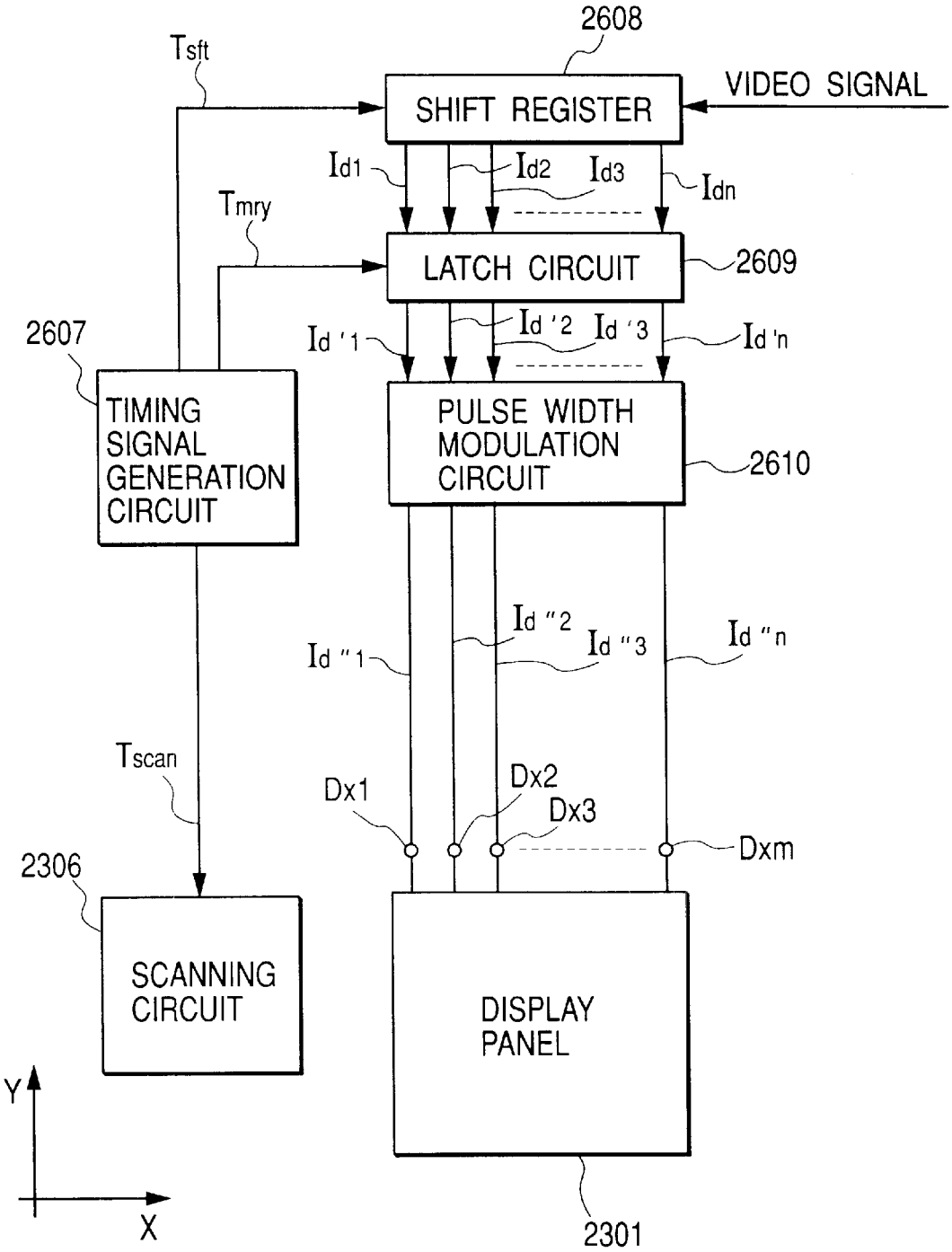
FIG. 26 is a schematic diagram showing the flow of a video input signal for Example 10 as will be described hereinafter.

The input video signal flows through the apparatus as described below by referring to FIG. 26.

The input signal is a composite video signal, which is then separated into a luminance signal and horizontal and vertical synchronous signals (HSYNC, VSYNC) for three primary colors by a decoder. The timing signal generator circuit 2607 generates various timing signals in synchronism wit the HSYNC and VSYNC signals.

The image data (luminance data) of the signal is then entered to a shift register. The shift register 2608 carries out for each line a serial/parallel conversion on the video signals that are fed in one time series basis in accordance with control signal (shift clock) Tsft fed from the control circuit 2607. A set of data for a line that has undergone a serial/parallel conversion (and corresponds to a set of drive data for n electron-emitting devices) is sent out of the shift register to a latch circuit 2609 as n parallel signals Idl through Idn.

The latch circuit 2609 is in fact a memory circuit for storing a set of data for a line, which are signals Idl through Idn, for a required period of time according to control signal Tmry coming from the control circuit 203. The stored data are sent out as I'dl through I'dn and fed to a pulse width modulating circuit 2601.

The pulse width modulation circuit 2601 is in fact a signal source for generating a voltage pulse having a given wave height according to the image data I'dl through I'dn and modulates the length of the voltage pulse corresponding to the input data.

The pulse width modulation circuit 2601 then outputs drive pulses I"dl through I"dn having a pulse width corresponding to the intensity of the video signals. More specifically, the higher the luminance level of the video data, the greater the width of the output voltage pulse. For example, it may output a voltage pulse having a wave height of 7.5 V and a duration of 30 μsec. for the maximum luminance. The output signals I"dl through I"dn are then applied to the terminals Dy1 through Dyn of the display panel 101.

In the display panel fed with the voltage output pulse, only the surface conduction electron-emitting devices of the line selected by the scanning circuit are driven to emit electrons for a period corresponding to the pulse width of the applied voltage.

When a high voltage Va of 5 kV is applied between the face plate and the rear plate, emitted electrons are accelerated to collide with the fluorescent body and causes the latter to emit light. Then, an image is displayed two-dimensionally as lines sequentially selected by the scanning circuit are scanned.

Electric discharges were generated between the rear plate and the face plate and detected by observing external circuits and detecting bright spots on the fluorescent body by means of a CCD camera. While electric discharges were observed at a rate of up to 3 discharges per hour in the initial stages, no significant degradation was observed on the luminance of the pixels. To the contrary, an image-forming apparatus prepared for the purpose of comparison and comprising an ITO film on the face plate that was not divided into segments showed a remarkable degradation of the pixels arranged along the vertical and horizontal wires in terms of brightness.

Each of the pixels of RGB arranged in correspondence with a segmented acceleration electrode showed a constant luminance value to a same input signal regardless of the light emitting operation of the remaining pixels.

For example, when a value of 240 was specified for R and the intensity of emitted light of G and B were changed to find out that R did not change its luminance.

EXAMPLE 11

(Correction of Variances in the Performance Due to the Use of a Plurality of Anodes)

In this example, a rear plate that is the same as that of Example 1 was used.

On the other hand, the pitch of dividing the ITO film of the face plate was modified to a pitch of 230×5 μm and the segments of ITO film was bundled at an end and connected to a high voltage source by way of respective resistors of 100 MΩ (NiO films prepared by patterning).

No special attention was paid on the precision of individual high resistance films.

The 100 MΩ resistors showed deviations up to about 5%.

Then, fluorescer ZnS (Cu doped) was applied to the segmented ITO film and baked to produce a face plate as an anode for applying a high voltage to the cold cathode multiple-device electron source (rear plate).

In this example, the variances in the performance of the segmented electrode regions were corrected to provide a desired state by controlling the conditions for driving the electron-emitting devices adapted to emit electrons to the respective electrode regions. To be more accurate, the variances in the performance of the segmented electrodes were minimized. Such variances in the performance can be reflected to the light emitting characteristics of the individual regions. The conditions for driving the electron-emitting devices can be controlled by controlling of the voltage to be applied to the electron-emitting devices and the waveform of the signal for modulating the pulse width in terms of the duration of voltage application.

In this example, a ROM 2711 was arranged to select the intensity of the drive current for every five lines of the drive circuit to be used with the modulation wires of the rear plate. After preparing the display panel, it was driven to emit light over the entire surface and observed by a CCD camera to find deviations in the luminance up to about 5% as in the case of the resistors. The corrected values were then stored in the ROM and the display panel was driven to operate once again. Then, the variances in the brightness among the segmented electrodes could be suppressed under the allowance of measurement.

Figure 27:
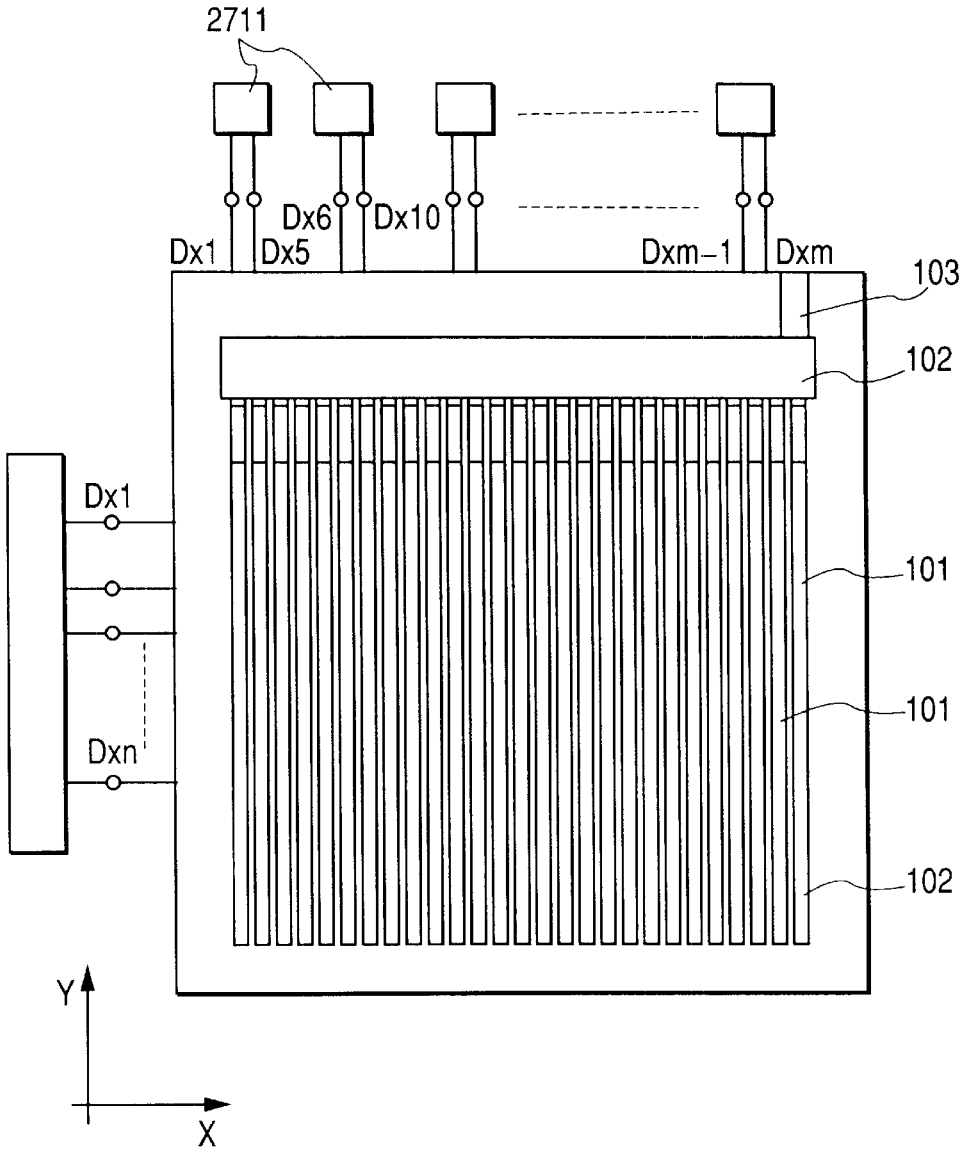
FIG. 27 is a schematic plan view of the face plate of Example 11 as will be described hereinafter.

A high voltage Va of 5 kV was applied between the drawn out section 103 of FIG. 27 and the rear plate separated by 2 mm in a scrolling manner at a rate of 30 $\mu$msec. per line, which is the same as the TV rate, for line-sequential drive. Electric discharges were detected by observing external circuits and detecting bright spots on the fluorescent body by means of a CCD camera. While electric discharges were observed at a rate up to 2 discharges per hour, no significant degradation was observed on the luminance of the pixels.

EXAMPLE 12

In this example, a rear plate same as that of Example 1 except that the scan wires and the signal wires were turned upside down was used.

On the other hand, the face plate of this example was prepared by forming insulating black stripes on a glass substrate at a pitch of 230×3 $\mu$m (for 1,000 lines) by printing and then a patterned $RuO_2$ film (resistor of 2.6 MΩ) was formed as shown in FIG. 1.

Then, fluorescers (P22) of RGB were applied cyclically between the isolated black stripes and baked. After forming an Al metal back, it was also segmented into stripes every two BSs by means of a laser beam to produce a color face plate to be used for applying a high anode voltage to a cold cathode multiple-device electron source (rear plate). Thus, the isolated segments of the metal back was arranged on the face plate with a width corresponding to three electron-emitting devices for 1 pixel unit of RGB.

The common wires v011, v012, . . . and the isolated stripes of aluminum of the metal back 2304 were arranged to rectangularly intersect each other.

Figure 28:
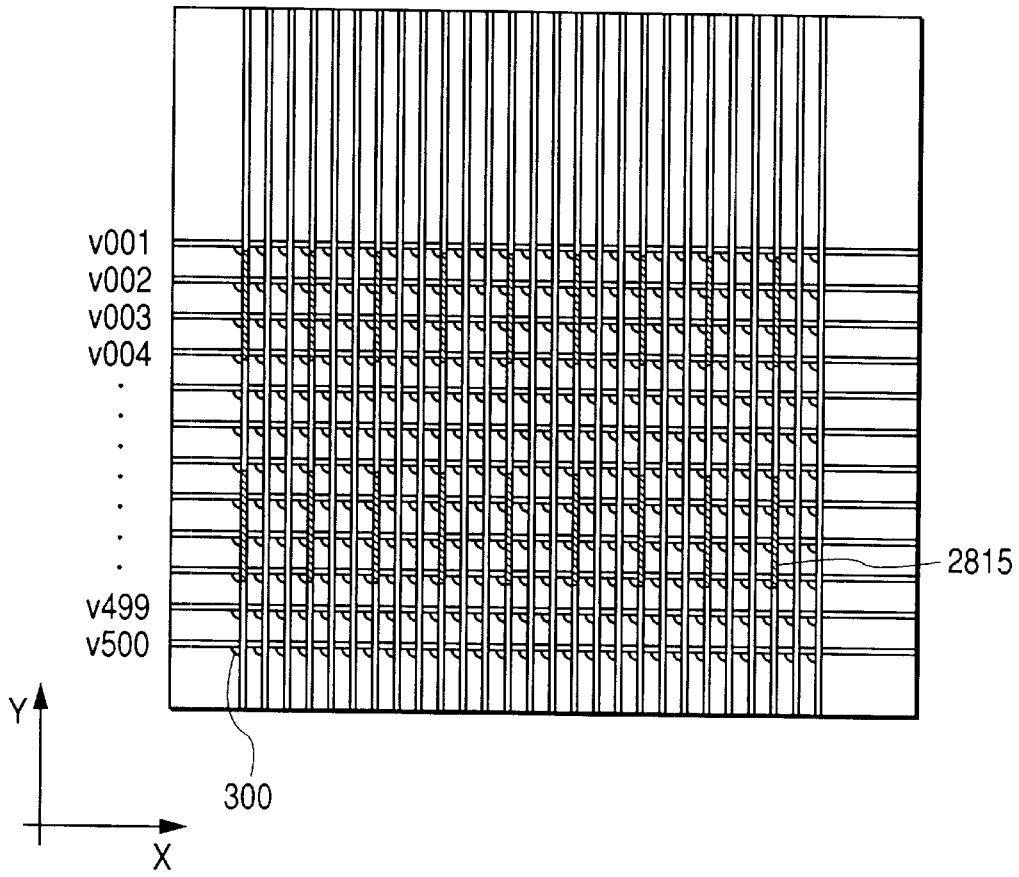
FIG. 28 is a schematic plan view of the rear plate of Example 12 as will be described hereinafter.

FIG. 28 shows a schematic plan view of the rear plate.

Spacers 2815 were arranged along the column wires of the rear plate without bridging any of the isolated segments of the metal back on the face plate with electroconductive frit glass (not shown) prepared by mixing an electroconductive material such as an electroconductive filler or metal and interposed therebetween. The necessary electric connections were established by baking the frit glass at 400 to 500° C. in the atmosphere when hermetically bonding the vacuum envelope.

For driving the display panel line-sequentially in a scrolling manner at a rate of 30 $\mu$msec. per line, which is the same as the TV rate, only the surface conduction electron-emitting devices connected to the line selected by the scanning circuit were made to emit light for a period corresponding to the pulse width of the applied voltage.

A high voltage Va of 5 kV was applied between the face plate and the rear plate to accelerate emitted electrons that collided with the fluorescent body to cause the latter to emit light. Then, an image is displayed two-dimensionally as lines sequentially selected by the scanning circuit are scanned.

Electric discharges were generated between the rear plate and the face plate and detected by observing external circuits and detecting bright spots on the fluorescent body by means of a CCD camera. While electric discharges were observed at a rate of up to 3 discharges per hour in the initial stages, no significant degradation was observed on the luminance of the pixels.

Each of the pixels of RGB arranged in correspondence with a segmented acceleration electrode showed a constant luminance value to a same input signal regardless of the light emitting operation of the remaining pixels.

For example, when a value of 240 was specified for R and the intensity of emitted light of G and B were changed to find out that R did not change its luminance.

On the other hand, a display panel comprising an $RuO_2$ film with 5 MΩ for the high resistance of the face plate was prepared and driven to find an improved performance for electric discharges, although variances in the luminance were visually observed.

EXAMPLE 13

The image-forming apparatus of this example as shown in FIG. 31 has a basic configuration that is the same as that of FIGS. 29 and 30. Note that the components in FIG. 31 that are same as those of FIGS. 29 and 30 are denoted respectively by the same reference symbols.

Figure 32A:
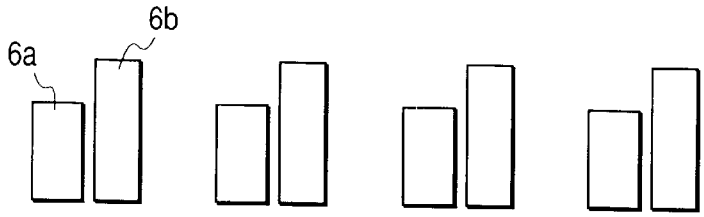
FIGS. 32A, 32B, 32C, 32D and 32E are schematic partial plan views of the electron source of the image-forming apparatus of Example 13, illustrating different manufacturing steps thereof.
Figure 32B:
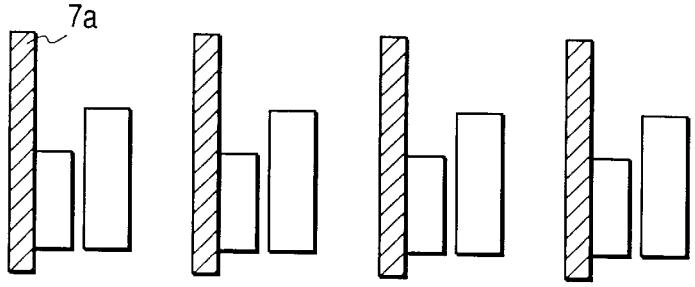
Figure 32C:
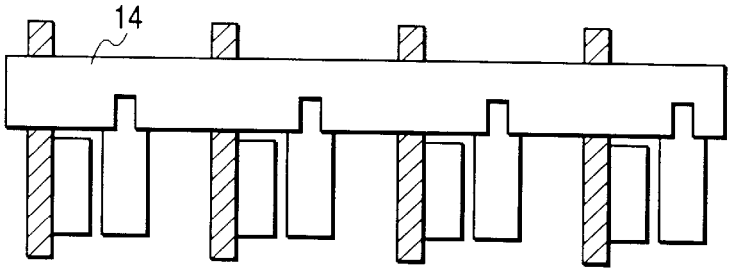
Figure 32D:
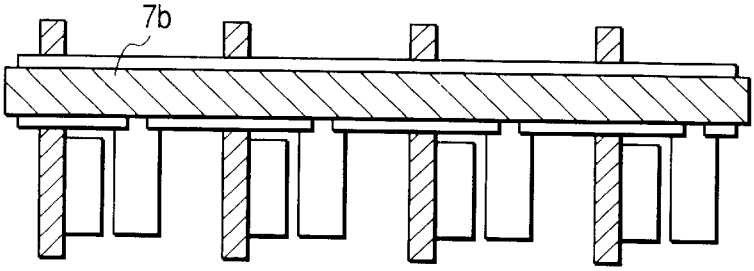
Figure 32E:
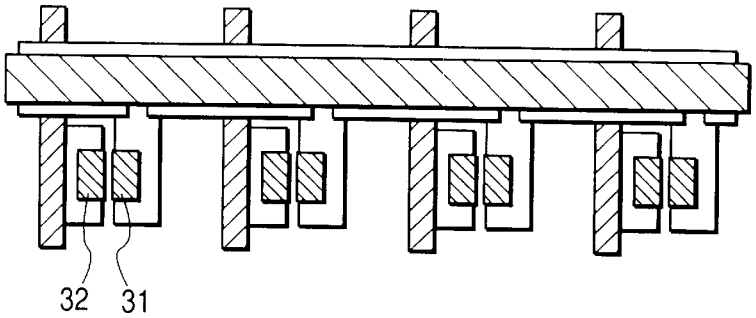
Figure 33A:
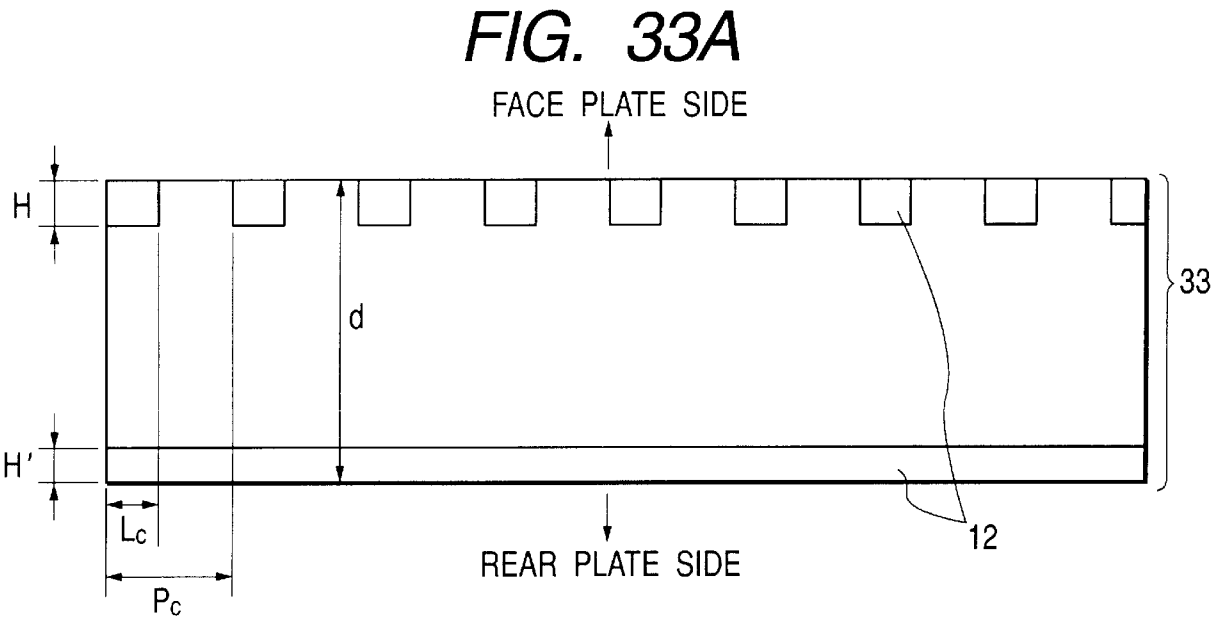
FIGS. 33A and 33B are schematic lateral views of one of the spacers used in Example 13.
Figure 33B:
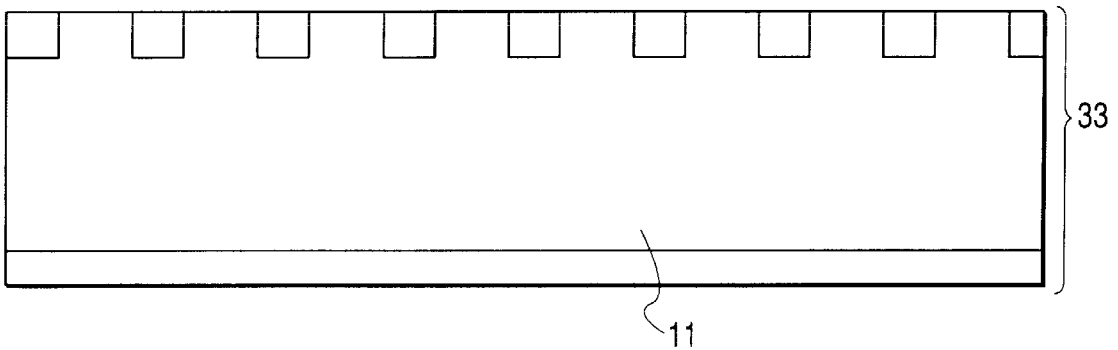
Figure 34:
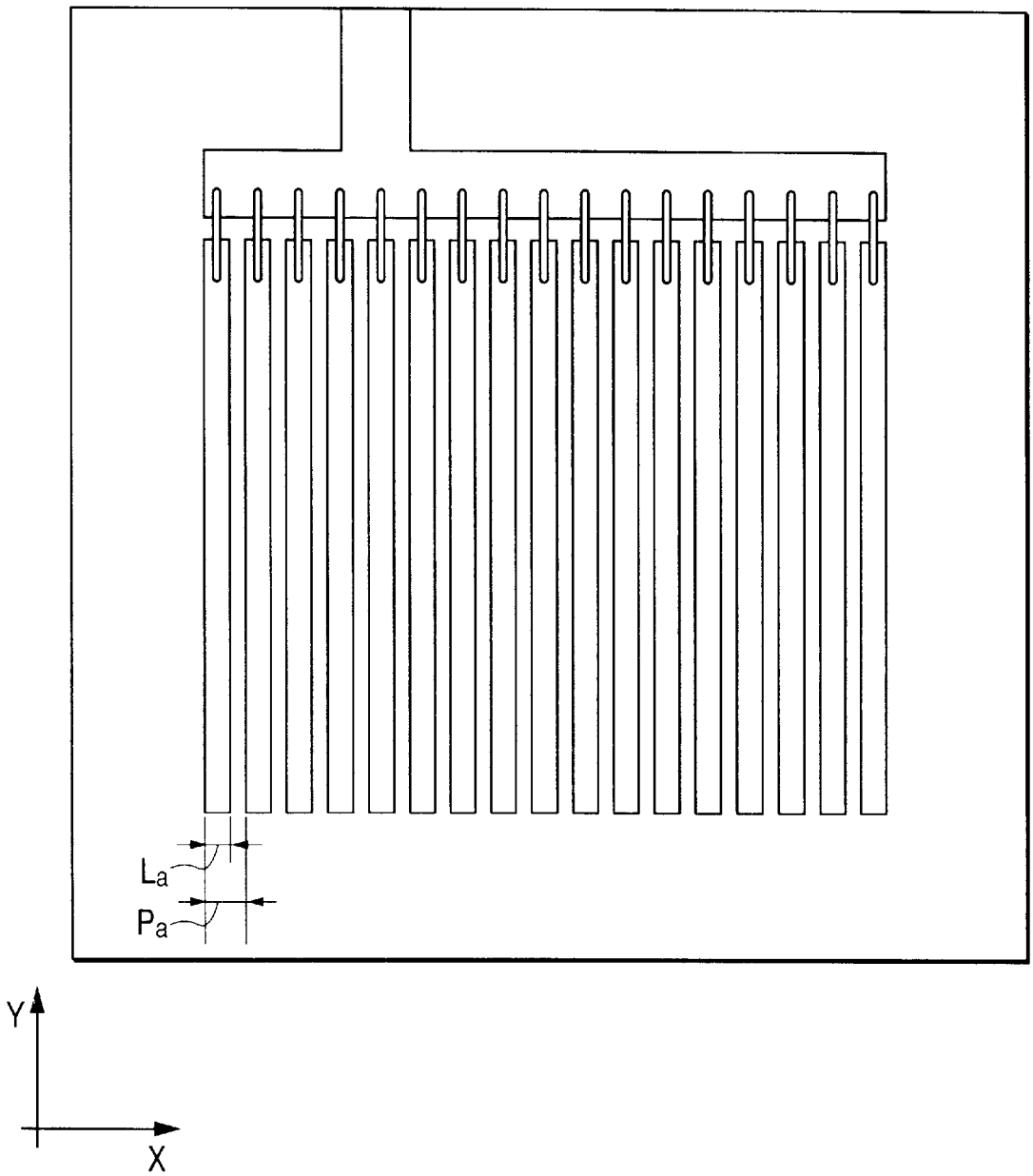
FIG. 34 is a schematic plan view of the face plate of Examples 13 and 14.
Figure 35A:
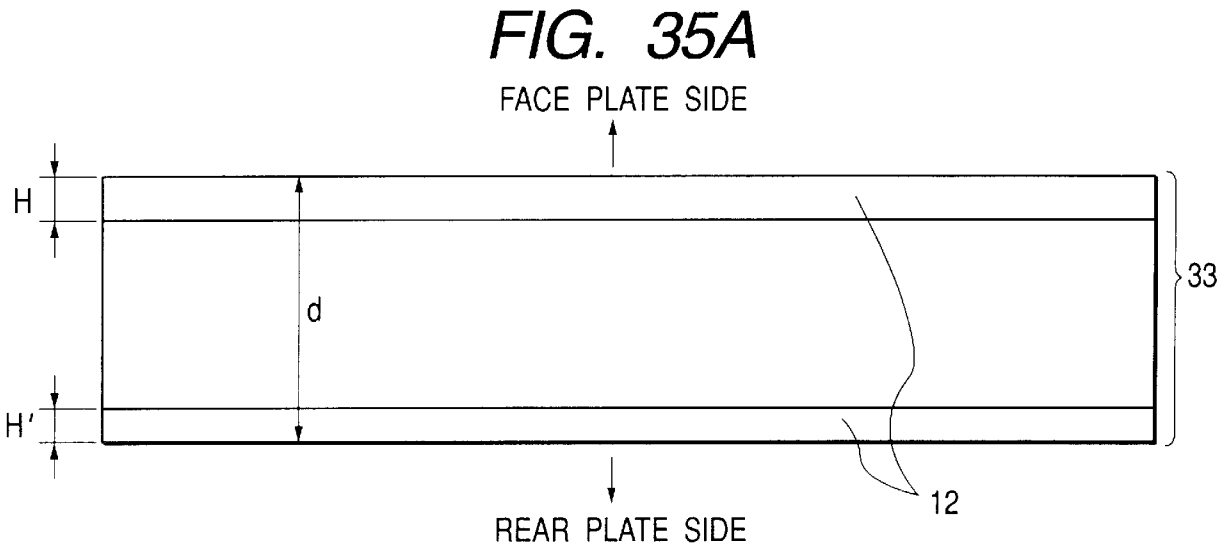
FIGS. 35A and 35B are schematic lateral views of one of the spacers used in the Comparative Example.
Figure 35B:
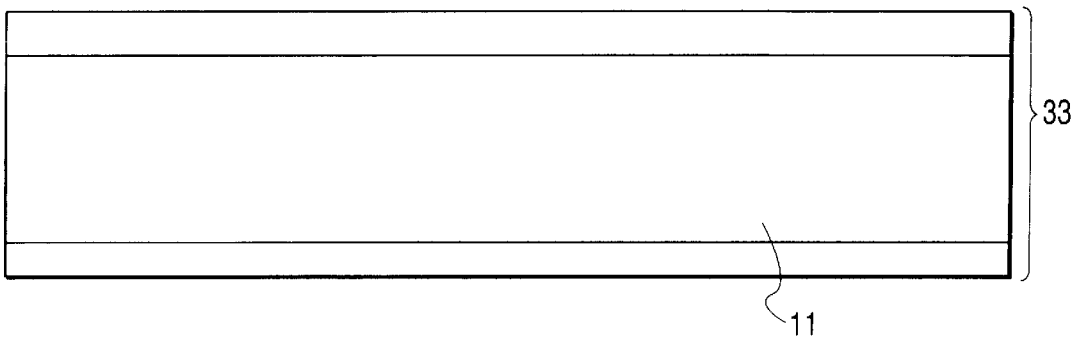

FIGS. 32A to 32E illustrate the process of manufacturing the electron source of the image-forming apparatus of this example and FIGS. 33A and 33B illustrate the process of manufacturing the spacers, whereas FIG. 34 shows the configuration of the face plate.

Now, the basic configuration and the steps of manufacturing the image-forming apparatus will be described by referring to FIGS. 32A to 32E, 33A and 33B and 34. Note that FIGS. 32A to 32E are enlarged schematic partial views, showing a few electron-emitting devices and the neighboring areas, although the image-forming apparatus of this example comprises a large number of surface conduction electron-emitting devices arranged to form a simple matrix.

Step-a (FIG. 32A)

For each electron-emitting device, a pair of device electrodes 6*a*, 6*b* were formed on a soda lime glass substrate by offset printing. A MOD thick film paste containing Pt as metal ingredient was used in this step. After the printing operation, the substrate was dried at 70° C. for 10 minutes and baked at a peak temperature of 550° C., which lasted for 8 minutes. After the printing and baking operation, the film thickness was found to be up to 0.3 $\mu$m.

Step-b (FIG. 32B)

Then, an electrode wiring layer (signal side) 7*a* was formed by thick film screen printing. Thick film paste NP-4035CA containing Ag available from Noritake Co., Ltd. was used. The paste was then baked, keeping a peak temperature of 400° C. for about 13 minutes, to produce a 0.7 $\mu$m thick film after the printing and baking operation.

Step-c (FIG. 32C)

An interlayer insulation layer 14 was prepared by thick film screen printing, using paste containing PbO as principal ingredient and a glass binding agent mixed therewith. The paste was then baked, keeping a peak temperature of 480° C.

for about 13 minutes, to produce a 36 μm thick film after the printing and baking operation. Note that the insulation layer was formed by printing and baking three times in order to ensure the insulation between the upper and lower layers. Note that a film formed from a thick film paste is typically porous and the pores are filled to make the film highly insulating by repeating the printing and baking operation to fill the pores.

Step-d (FIG. 32D)

An electrode wiring layer (scanning side) 7*b* was formed by thick film screen printing. Thick film paste NP-4035CA containing Ag available from Noritake Co., Ltd. was used. The paste was then baked, keeping a peak temperature of 400° C. for about 13 minutes, to produce a 11 μm thick film after the printing and baking operation. A matrix wiring arrangement was completed by this step.

Step-e (FIG. 32E)

A mask having an opening that bridged the device electrodes 6*a* and 6*b* was used for the electroconductive thin film 31 of the electron-emitting device in this step. A Cr film was deposited by vacuum evaporation to a film thickness of 100 nm and patterned, using the mask. Then, organic Pd (ccp 4230: trade name—available from Okuno Pharmaceutical Co., Ltd.) was applied thereon by means of a rotating spinner and baked at 300° C., for 10 minutes. As a result, an electroconductive thin film 31 containing Pd in the form of fine particles as principal ingredient and having a film thickness of 10 nm and a surface resistance of $5\times10^4$ Ω/□was produced.

The Cr film and the baked electroconductive thin film 31 were etched by an acidic etchant to produce a pattern having an intended profile.

Step-f

Then, spacers were prepared.

For each of the spacers, firstly, a substrate of soda lime glass (height: 3.8 mm, thickness: 200 μm, length: 20 mm) was provided. The substrate was then subjected to a process of forming a silicon nitride film as Na blocking layer to a thickness of 0.5 μm and a film of nitride of Cr and Al alloy thereon. The film of nitride of Cr and Al alloy of this example was formed by sputtering Cr and Al targets simultaneously in an atmosphere of a mixture or argon and nitrogen by means of a sputtering system. The composition of the produced film was regulated by controlling the power fed to the respective targets to provide the film with an optimal resistance level. The substrate was connected to a grounding terminal at room temperature. The produced film of nitride of Cr and Al alloy showed a film thickness of 200 nm, a specific resistance of $2.4\times10^5$ Ωcm (surface resistance of $1.2\times10^{10}$ Ω). The temperature coefficient of resistance of the film material was−0.5% and no thermal run away was observed with Va=5 kV.

A contact electrode 12 of Al was then formed on the substrate by using a mask in order to ensure the connection between the X-directional wires and the divided anode on the face plate.

The belt-like contact electrode located at the rear plate side to contact with the corresponding X-directional wires had a height of H*=50 μm, whereas the stripe-shaped contact electrode located at the face plate side to contact with the divided anode had a height of H=50 μm and a width of Lc=40 μm. The stripes were arranged at a pitch of Pc=145 μm ((=Px/2)=(Pa/2)). The segments of the divided anode, or transparent electrode, had a width of La=240 μm and were arranged at a pitch of Pa=290 μm. Thus, the stripe-shaped contact electrode was more adapted to satisfy the requirement of not short-circuiting a plurality of lines of the segmented anode and that of not generating an uneven electric field that can give rise to impermissible variances of luminance among the devices.

Step-g

Then, electroconductive frit was applied to the electrode wire 7*b* and provisionally baked. The electroconductive frit was prepared by stirring and mixing a powdery mixture of an electroconductive filler material and frit glass with a solution of terpineol/erubasite and applied by means of a dispenser. The dispenser was provided with a nozzle having an orifice of 175 μm and used at room temperature with a discharge pressure of 2.0 kgf/cm$^2$ and a nozzle-wire gap of 150 μm to produce a width of up to 150 μm for the applied frit, although the conditions under which such frit is applied by means of a dispenser may vary depending on its viscosity.

Provisional baking as used herein refers to a process of evaporating, dissipating and burning the vehicle containing an organic solvent and a resin binding agent. With provisional baking, frit glass is baked in the atmosphere or in an nitrogen atmosphere at temperature lower than the softening temperature of the frit glass.

Step-h

The spacer was connected to the rear plate by baking the frit glass at 410° C. for 10 minutes in the atmosphere or in an nitrogen atmosphere, aligning them by means of a profiling jig (not shown).

Step-i

Then, the prepared spacers 3 and the rear plate 1 were combined with an outer frame 13. Note that frit glass was applied in advance to the junctions of the rear plate 1 and the outer frame 13. The face plate 2 (prepared by forming an fluorescent film 10 and a metal back on the inner surface of a glass substrate 8) was placed in position by way of the outer frame 13. Frit glass was also applied in advance to the junctions of the face plate 2 and the outer frame 13. The combined rear plate 1, outer frame 13 and face plate 2 were heated at 100° C. for 10 minutes in the atmosphere, then at 300° C. for 1 hour and finally at 400° C. for 10 minutes to hermetically bond them.

Referring to FIG. 34, segments of the divided anode were arranged on the face plate and commonly connected to each other by way of a current limiting resistor of 100 MΩ made of ruthenium oxide ($RuO_2$) or boroilicate glass and a fluorescent film (not shown) was arranged thereon. The segments of the divided anode, each having a width of La=240 μm, were formed by patterning and arranged at a pitch of Pa=290 μm.

While the fluorescent film may be made of a fluorescing material if it is used for displaying black and white images, stripes of fluorescers were used in this example. More specifically, black stripes were arranged so as not to short-circuit the segments of the anode and the gaps were filled with the fuorescers of three primary colors. The black stripes were made of a material containing graphite as a principal ingredient. A slurry technique was used for applying the fluorescers to the glass substrate 8.

Then, a metal back was formed on the surface of the fluorescent film by firstly smoothing the inner surface of the prepared fluorescent film (a process also referred to as "filming") and forming an Al layer thereon by vacuum evaporation. The flat and even film of the metal back was then cut along the black stripes formed between the segments of the anode by irradiating Nb/YAG laser (532 nm) in order to prevent any electric short-circuiting from taking place. Adjacently located segments of the metal back were separated by a gap of 50 μm just as the stripe-shaped transparent electrode.

When bonding the above components, they were aligned carefully in order to make the fluorescers of the primary colors accurately positioned relative to the corresponding electron-emitting devices.

The inside of the completed glass envelope was then evacuated by way of an exhaust pipe (not shown), using a vacuum pump and, when a sufficient degree of vacuum was obtained, a given voltage was applied to the electrodes 6*a*, 6*b* of the electron-emitting devices 5 by way of the external terminals Dox1 through Doxm and Doy1 through Doyn to make the electroconductive thin films 31 of the devices subjected to a forming operation and produce respective electron-emitting regions 32. Then, toluene was introduced into the display panel through the exhaust pipe of the panel by means of a slow leak valve to drive all the electron-emitting devices 5 under an atmosphere less than $1.0\times10^{-5}$ torr for an activation process.

Thereafter, the inside was evacuated to a pressure level of about $1.0\times10^{-6}$ torr and the exhaust pipe (not shown) was molten and closed by means of a gas burner to hermetically seal the envelope.

Finally, a gettering operation was conducted with high frequency heating in order to maintain the degree of vacuum within the envelope after it was sealed.

The finished image-forming apparatus was then driven to operate by applying scan signals and modulation signals to the electron-emitting devices from a signal generating means (not shown) by way of the external terminals Dx1 through Dxm and Dy1 through Dyn to make then emit electrons, which were then accelerated by applying high voltage Va to the transparent electrode by way of the high voltage terminal Hv and eventually collided with the fluorescent film 10 to make the latter become energized and emit light to display images.

The image-forming apparatus of this example was driven by high voltage Va=5.5 kV to display clear images stably without variances in the luminance. Additionally, the pixels of the image-forming apparatus did not show any degradation in terms of luminance even when electric discharge occurred between the face plate and the rear plate so that the apparatus could enjoy a long service life.

EXAMPLE 14

The steps of Example 13 were followed in the example except Step-f.

Step-f

Spacers were prepared in a manner as described below.

For each of the spacers, firstly, a substrate of soda lime glass (height: 3.8 mm, thickness: 200 μm, length: 20 mm) was provided. The substrate was then subjected to a process of forming a silicon nitride film as a Na blocking layer to a thickness of 0.5 μm and a film of nitride of Cr and Al alloy thereon. The film of nitride of Cr and Al alloy of this example was formed by sputtering Cr and Al targets simultaneously in an atmosphere of a mixture or argon and nitrogen by means of a sputtering system. The composition of the produced film was regulated by controlling the power fed to the respective targets to provide the film with an optimal resistance level. The substrate was connected to a grounding terminal at room temperature. The produced film of nitride of Cr and Al alloy showed a film thickness of 200 nm, a specific resistance of $2.4\times10^{5}$ Ωcm (surface resistance of $1.2\times10^{10}$ Ω). The temperature coefficient of resistance of the film material was −0.5% and no thermal run away was observed with Va=5 kV.

A contact electrode 12 of Al was then formed on the substrate by using a mask in order to ensure the connection between the X-directional wires and the divided anode on the face plate.

The belt-like contact electrode located at the rear plate side to contact with the corresponding X-directional wires had a height of H*=50 μm, whereas the island-shaped contact electrode located at the face plate side to contact with the divided anode had a height of H=50 μm and a width of Lc=40 μm. The islands were arranged at a pitch of Pc=290 μm (=Px=(Pa/5)). The segments of the divided anode, or transparent electrode, had a width of La=1,400 μm and were arranged at a pitch of Pa=1,450 μm. Thus, the island-shaped contact electrode was more adapted to satisfy the requirement of not short-circuiting a plurality of lines of the segmented anode and that of not generating an uneven electric field that can give rise to impermissible variances of luminance among the devices.

While the fluorescent film may be made of a fluorescing material if it is used for displaying black and white images, stripes of fluorescers were used in this example. More specifically, insulting black stripes, each having a width of 50 μm, were arranged at a pitch of 1,450 μm so as not to short-circuit the segments of the anode and the gaps were filled with the fluorescers of three primary colors. The black stripes were made of a material containing graphite as principal ingredient. A slurry technique was used for applying the fluorescers to the glass substrate 8.

A current limiting resistor of 20 MΩ made of ruthenium oxide ($RuO_2$) or borosilicate glass and a metal back was formed thereon. More specifically, the metal back was formed on the inner surface of the fluorescent film by firstly smoothing the inner surface of the prepared fluorescent film (a process also referred to as "filming") and forming an Al layer thereon by vacuum evaporation. The flat and even film of the metal back was then cut along the black stripes formed between the segments of the anode by irradiating Nb/YAG laser (532 nm) in order to prevent any electric short-circuiting from taking place. Adjacently located segments of the metal back were separated by a gap of 50 μm. Thus, a divided anode was formed only from stripes of metal back, each having a width of La=1,450 μm, arranged at a pitch of 1,450 μm, which were commonly drawn out by way of a current limiting resistor of 20 MΩ to provide a face plate.

The inside of the completed glass envelope was then evacuated by way of an exhaust pipe (not shown), using a vacuum pump and, when a sufficient degree of vacuum was obtained, the electron-emitting devices were subjected to a process of forming and activation.

Finally, the inside of the envelope was evacuated again and the envelope was hermetically sealed before conducting a gettering operation.

The finished image-forming apparatus was then driven to operate by applying scan signals and modulation signals to the electron-emitting devices from a signal generating means (not shown) by way of the external terminals Dxl through Dxm and Dyl through Dyn to make them emit electrons, which were then accelerated by applying high voltage Va to the transparent electrode by way of the high voltage terminal Hv and eventually collided with the fluorescent film 10 to make the latter become energized and emit light to display images.

The image-forming apparatus of this example was driven by high voltage Va=5.5 kV to display clear images stably without variances in the luminance. Additionally, the pixels of the image-forming apparatus did not show any degradation in terms of luminance even when electric discharges occurred between the face plate and the rear plate so that the apparatus could enjoy a long service life.

Comparative Example 1 Relating to Example 13

In this example, the steps of Example 13 were followed except Steps-f, g and h.

Step-f

For each of the spacers, firstly, a substrate of soda lime glass (height: 3.8 mm, thickness: 200 μm, length: 20 mm) was provided. Then, a film of nitride of Cr and Al alloy was formed by sputtering Cr and Al by means of a sputtering system. The film was formed by sputtering Cr and Al targets simultaneously in an atmosphere of a mixture of argon and nitrogen. The composition of the produced film was regulated by controlling the power fed to the respective target to provide the film with an optimal resistance level. The substrate was connected to a grounding terminal at room temperature. The produced film of nitride of Cr and Al alloy showed a film thickness of 200 nm, a specific resistance of $2.4\times10^5$ Ωcm (surface resistance of $1.2\times10^{10}$ Ω).

A contact electrode 12 of Al was then formed on the substrate by using a mask in order to ensure the connection between the X-directional wires and the divided anode on the face plate.

The belt-like contact electrode located at the rear plate side to contact with the corresponding X-directional wires had a height of H*=50 μm, whereas the stripe-shaped contact electrode located at the face plate side to contact with the divided anode had a height of H=200 μm. The segments of the divided anode had a width of La=240 μm and were arranged at a pitch of Pa=290 μm as in Example 13.

Step-g

Then, electroconductive frit was applied to the electrode wire 7*b* and provisionally baked. The electroconductive frit was prepared by a stirring and mixing a powdery mixture of an electroconductive filler material and frit glass with a solution of ternpineol/erubasite and applied by means of a dispenser. The dispenser was provided with a nozzle having an orifice of 175 μm and used at room temperature with a discharge pressure of 2.0 kgf/cm$^2$ and a nozzle-wire gap of 150 μm to produce a width of up to 150 μm for the applied frit, although the conditions under which such frit is applied by means of a dispenser may vary depending on its viscosity.

Provisional baking as used herein refers to a process of evaporating, dissipating and burning the vehicle containing an organic solvent and a resin binding agent. With provisional baking, frit glass is baked in the atmosphere or in an nitrogen atmosphere at temperature lower than the softening temperature of the frit glass.

Step-h

The spacer was connected to the rear plate by baking the frit glass at 410° C. for 10 minutes in the atmosphere or in a nitrogen atmosphere, aligning them by means of a profiling jig (not shown).

As a result, a plurality of the lines of the divided anode were short-circuited by the belt-like contact electrodes on the face plate side. To be more accurate, a total of 69 lines of the divided anode were short-circuited. When compared with Example 12, the accumulated electric charge was raised to about 100 times of that of Example 12 from the viewpoint of the surface area of the anode.

Then, the prepared spacers 3 and the rear plate 1 were combined with an outer frame 13. Note that frit glass was applied in advance to the junctions of the rear plate 1 and the outer frame 13. The face plate 2 (prepared by forming an fluorescent film 10 and a metal back on the inner surface of a glass substrate 8) was placed in position by way of the outer frame 13. Frit glass was also applied in advance to the junctions of the face plate 2 and the outer frame 13. The combined rear plate 1, outer frame 13 and face plate 2 were heated at 100° C. for 10 minutes in the atmosphere, then at 300° C. for 1 hour and finally at 400° C. for 10 minutes to hermetically bond them.

Then, the inside of the completed glass envelope was evacuated through an exhaust pipe of the envelope by means of a vacuum pump and, when a sufficient degree of vacuum was obtained in the inside, the apparatus was subjected to a forming and activation process as in Example 13. Finally, the inside of the envelope was evacuated again and the envelope was hermetically sealed before conducting a gettering operation.

The finished image-forming apparatus was then driven to operate and cause emitted electrons to collide with and excite the fluorescent film to emit light and display images.

Destructed devices were found due to electric discharges when the high voltage Va being applied to the image-forming apparatus of this comparative example was raised to 5.2 kV. Therefore, Va was lowered to 4.0 kV to evaluate the displayed image, which was found only poorly bright and colored. The image became disturbed within a few minutes and no stable images could be displayed.

Thus, destructed devices were observed in the image-forming apparatus of the comparative example due to electric discharges between the face plate and the rear plate. Therefore, it was not possible to prepare an image-forming apparatus that can display bright images and enjoy a long service life according to the manufacturing steps of this comparative example.

EXAMPLE 15

In this example, an image-forming apparatus comprising Spindt's field emission type (FE) electron-emitting devices was prepared.

The Spindt's FE electron-emitting devices used in this example were same as those used in Example 6.

A total of up to 2,000 electron-emitting devices were used for a pixel and a cathode side electron emission source 1,000×500 devices was prepared for the rear plate.

The face plate and the spacers of this example were the same as those of Example 12.

A voltage of Va=600 V was applied between the face plate and the rear plate, and necessary pixels were driven selectively through cathode wires and gate electrodes of the rear plate, to realize a flat display.

The image-forming apparatus of this example operated stably to display undistorted, bright and clear images when a high voltage of Va=600 V was applied. The elements, particularly the gate electrode and the front end of the Mo cathode, were not destroyed by electric discharges between the face plate and the rear plate to make the image-forming apparatus enjoy a long service life.

Comparative Example 2

The image-forming apparatus of this comparative example comparative example corresponds to that of Example 15 comprising Spindt's FE type electron-emitting devices.

The spacers of this comparative example were same as those of Comparative Example 1.

In the image-forming apparatus of this comparative example, some of the elements were destroyed and the gate electrode and the front end of the Mo cathode showed remarkable destruction due to electric discharges between the face plate and the rear plate. To be more accurate, a total of 20 pixels lose the luminance by more than 50% due to electric discharges and it was not possible to prepare an image-forming apparatus that can display bright images and enjoy a long service life according to the manufacturing steps of this comparative example.

To the contrary, the image-forming apparatus of this example operated stably to display undistorted, bright and clear images when a high voltage of Va=600 V was applied. The elements, particularly the gate electrode and the front end of the Mo cathode, were not destructed by electric discharges between the face plate and the rear plate to make the image-forming apparatus enjoy a long service life.

EXAMPLE 16

The spacers in this example were the same as those in the above comparative example.

Step-g

Electroconductive frit and non-electroconductive frit were combined (in a manner as described below) on the wires of the divided electrode of the face plate and provisionally baked.

Figure 36:
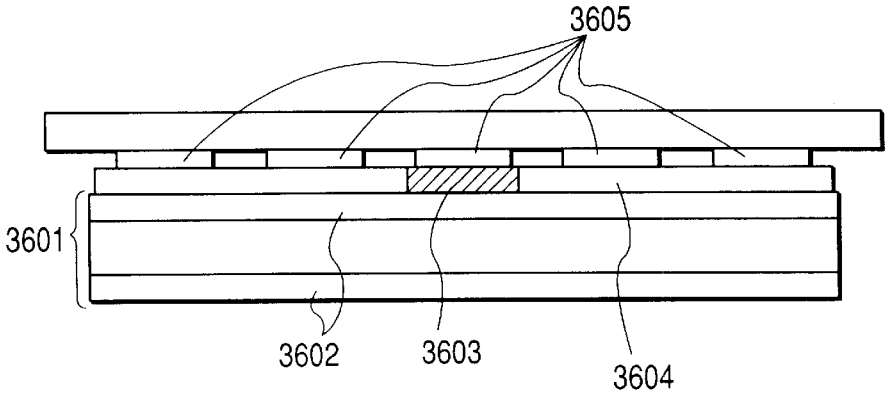
FIG. 36 is a schematic lateral view of one of the spacers used in Example 15 as will be described hereinafter, illustrating a manufacturing step thereof.

FIG. 36 shows how electroconductive frit and non-electroconductive frit were combined in this example. FIG. 36 is an enlarged schematic lateral view of the spacers used in this example showing the junction with the face plate after the provisional baking.

Referring to FIG. 36, contact electrodes 3602 were formed on the opposite sides of the spacer 3601. The spacer 3601 was electrically connected to a stripe of the metal back 3605 by a piece of electroconductive frit 3603 and electrically insulated from the other related stripes of the metal back by non-electroconductive frit. Since the spacer was held in good contact with the contact electrode at the face plate side, it showed a sufficient anti-charge effect. The stripes of the divided metal back were electrically insulated from each other and their respective capacitances were not changed by the spacers. Note that the fluorescers and the black stripes are omitted in FIG. 36 for simplicity.

Step-h

The spacers and the face plate were bonded together by baking them in the atmosphere or in a nitrogen atmosphere at 410° C. for 10 minutes, while being aligned by means of a profiling jig (not shown).

Then, the prepared envelope was hermetically sealed as in Step-i of Example 13.

The image-forming apparatus of this example operated stably to display undistorted, bright and clear images when a high voltage of Va=8 kV was applied. The pixels were not degraded by electric discharges between the face plate and the rear plate to make the image-forming apparatus enjoy a long service life.

EXAMPLE 17

In this example, a display apparatus comprising field emission type electron-emitting devices as in Example 6 and having a (diagonally) 14 inches long display screen (where fluorescers were arranged) was prepared. The image-forming apparatus of this example will be described below by referring to FIGS. 1, 25, 37 and 38.

Spacers were arranged between the face plate carrying thereon fluorescers and the rear plate carrying thereon a matrix of Spindt's field emission type electron-emitting devices in order to make the image-forming apparatus withstand the atmospheric pressure.

The face plate of the image-forming apparatus showed a plan view as illustrated in FIG. 1.

Figure 25:
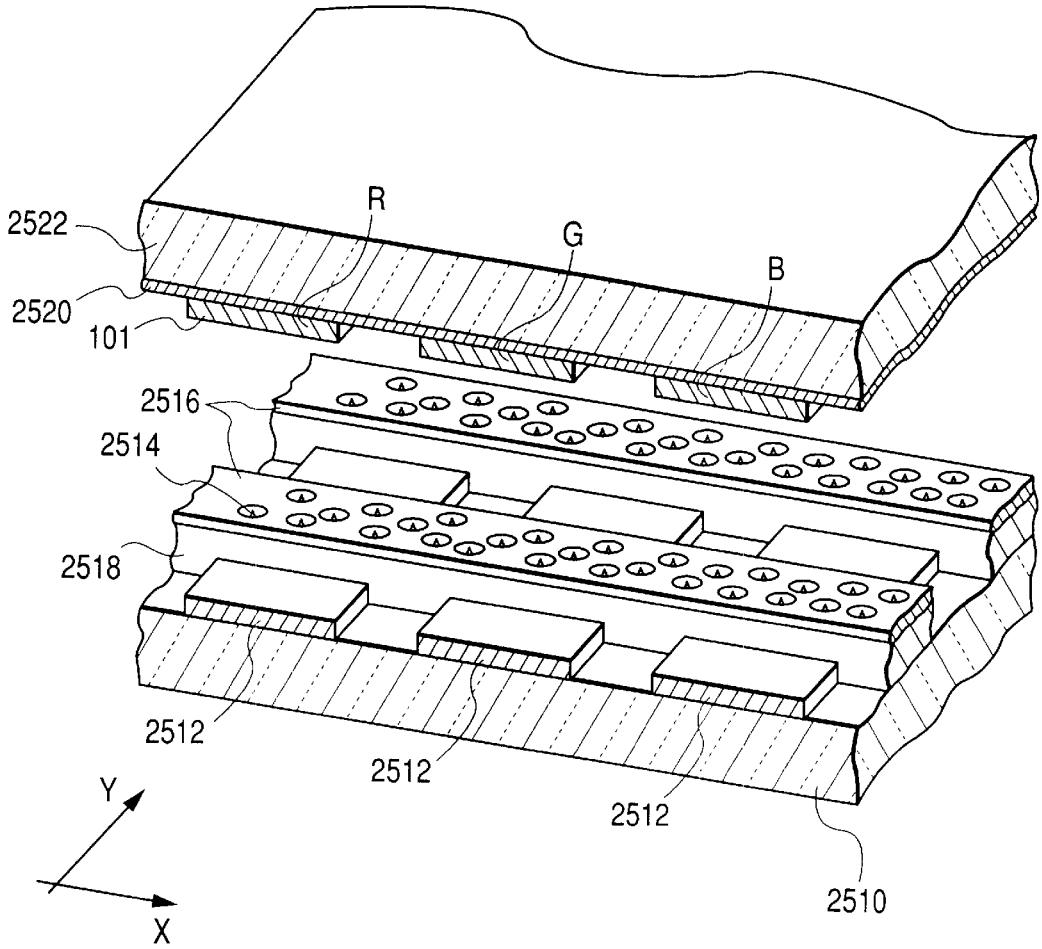
FIG. 25 is an exploded schematic perspective view of the face plate of Example 17 as will be described hereinafter, showing only part of it.

FIG. 25 shows an exploded schematic perspective view of the face plate of the image-forming apparatus of this example.

Figure 37:
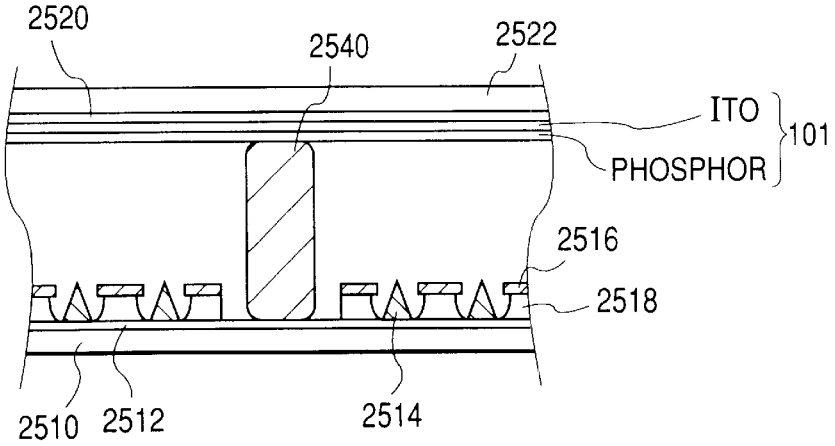
FIG. 37 is a schematic partial cross sectional view of the image-forming apparatus of Example 17 as will be described hereinafter.

FIG. 37 is a schematic partial cross sectional view of the image-forming apparatus of this example taken in parallel with the cathode wires (2512).

Figure 38:
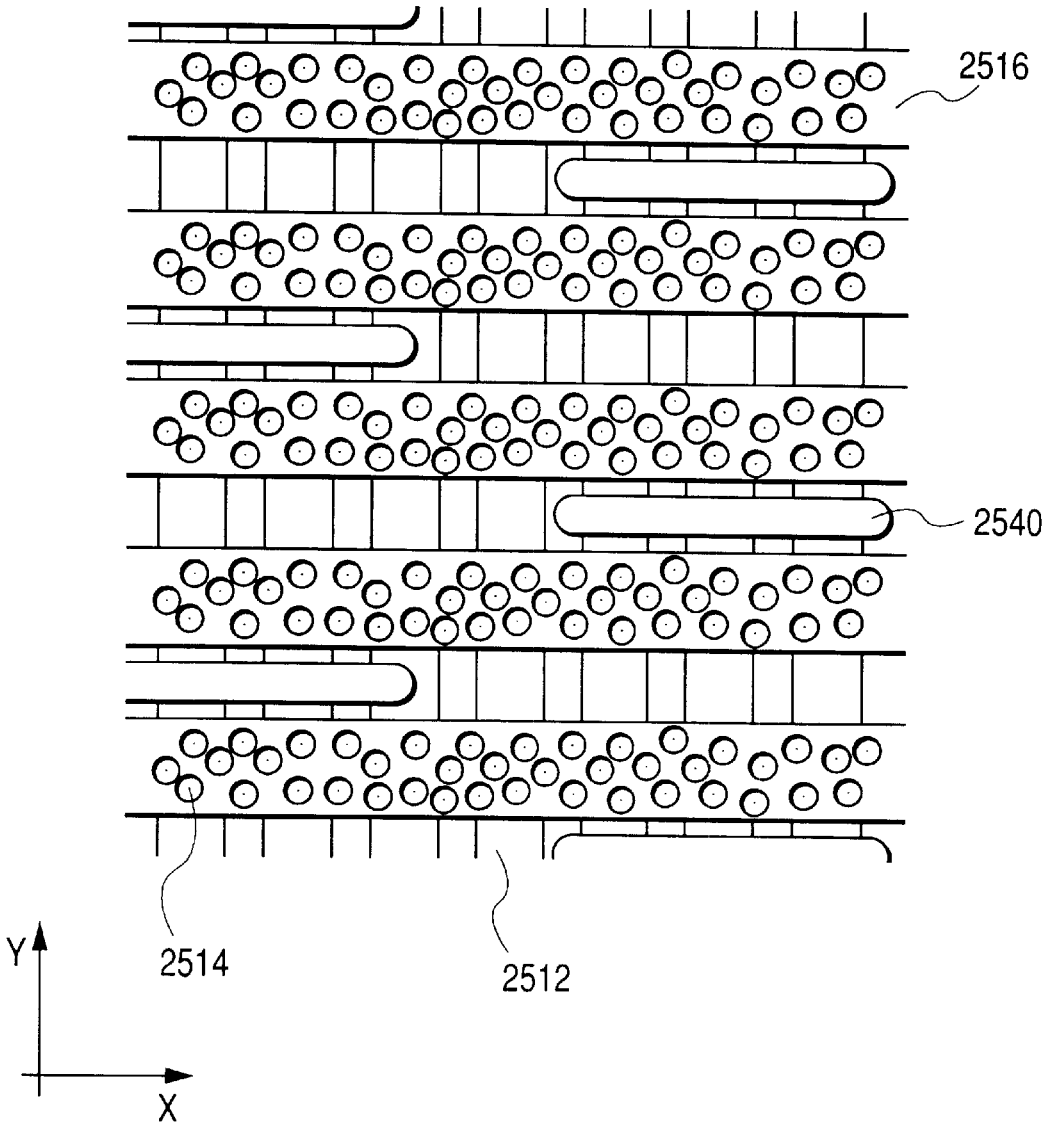
FIG. 38 is a schematic partial plan view of the rear plate of the image-forming apparatus of Example 17.

FIG. 38 is a schematic partial plan view of the rear plate of the image-forming apparatus of this example, showing that the spacer (2540) were securely arranged in place.

Referring to FIG. 1, the face plate had anode stripes (101) made of ITO and carrying thereon fluorescers, a high resistance film (NiO film) having an electric resistance of 100 MΩ a common electrode 105 and a high voltage terminal (103) drawn to the outside of the image-forming apparatus.

Referring to FIG. 25, there are shown a rear plate 2510 made of glass, cathode wires 2512 (signal wires running in Y-direction), an insulation layer 2518, gate wires 2516 (scan wires running in X-direction) and emitter chips (2514) made of Mo. Although not shown in FIGS. 37 and 38, about 300 emitter chips were formed at each of the crossings of the gate wires and the cathode wires. The emitters of each of the crossings were arranged to correspond to the fluorescers of three primary colors (R, G and B) formed on the face plate respectively. In FIG. 25, reference numeral 101 denotes the electroconductive anode stripes carrying fluorescers of three primary colors (R, G and B) respectively, reference numeral 2520 denotes another insulation layer and reference numeral 2522 denotes the glass face plate of the image-forming apparatus. As seen from FIG. 25, the gate wires (scan wires running in X-direction) and the anode stripes (101) (running in Y-direction) rectangularly intersect each other.

Referring to FIGS. 37 and 38, plate-shaped spacers (2540) were arranged along the X-direction. In other words, each of them bridged cathode wires and anode stripes (101).

As seen from FIGS. 37 and 38, each of the insulating spacers (2540) of the image-forming apparatus in this example was made of a piece of glass rounded at the edges and corners to eliminate any angular areas that can trigger an electric discharge and coated with polyimide film. The insulating spacers had a height of 1 mm between the face plate and the rear plate and a length of 4 mm along the X-direction. As seen from FIG. 38, the spacers were arranged in a zig-zag manner between the respective gate wires over the entire display area of the image-forming apparatus.

The image-forming apparatus was prepared in a manner as described below.

At the face plate side, electroconductive fluorescers of three primary colors (red, green and blue) (102) were formed by photolithography as in Example 1 on the ITO anode stripes arranged at a pitch of 100 μm.

At the rear plate side, on the other hand, about 300 emitter chips were formed at each of the crossings of the gate wires and the cathode wires by photolithography as in Example 6. Note that adjacent ones of the gate wires were separated at a pitch of 300 μm, while those of the cathode wires were separated by a gap of 100 μm.

Then, the above described insulating spacers were arranged respectively between the gate wires 2516 and bonded to the face plate by means of frit (not shown). Frit was applied to the side of each of the insulating spacers to be bonded to the face plate and then provisionally baked (to heat and drive off the organic substances contained in the frit).

Then, frit was also applied to the frame member (not shown) and baked and the frame member was fitted to the outer periphery of the rear plate rigidly carrying the spacers.

Then, the anode strips (101) arranged on the face plate and the cathode wires (2512) arranged on the rear plate were aligned to as to be located in parallel with each other and then heated and cooled in vacuum, while applying pressure toward the inside, to airtightly bond and seal the image-forming apparatus by means of frit. Thus, an image-forming apparatus was prepared and its inside was held to a high degree of vacuum.

Then, the image-forming apparatus comprising field effect type electron-emitting devices was connected to a drive circuit (not shown) and a high voltage of 3 kV was applied to the anode to drive the electron-emitting devices. No emission of light due to electric discharges was observed.

While the insulating spacers of this example had a plate-like profile, an image-forming apparatus was also prepared by replacing them by known filament-shaped insulating spacers having a diameter less than the gap separating any adjacently located cathode wires and arranged without bridging the cathode wires and the anode stripes. Again, no emission of light due to electric discharges nor any destruction on the part of the electron-emitting devices were observed when the image-forming apparatus was driven to operate in the same manner.

The present invention is described above in terms of an electron emission apparatus comprising electron-emitting devices, where the substrate carrying the electron-emitting devices including their electrodes and wires was used as a first electrode of the apparatus and another electrode disposed oppositely relative to the first electrode was divided into a number of stripes. However, various other arrangements for applying a voltage within the apparatus may alternatively be used for the purpose of the invention. The present invention is particularly advantageously applicable to a plane type display apparatus comprising a pair of oppositely disposed electrodes. It is also advantageously applicable to an arrangement where a high DC voltage or a voltage close to a DC voltage (but showing voltage changes due to modulation) is applied to the oppositely disposed electrodes.

As described above, an electron emission apparatus according to the invention can effectively suppress the adverse effect of electric discharges that can take place between the oppositely disposed electrodes of the apparatus. More specifically, the electrostatic capacitance between the electrodes can be minimized.

When the present invention is embodied as a voltage application apparatus, it can minimize the intensity of electric discharges. When it is embodied as an electron-emitting apparatus, the adverse effect of electric discharges to the electron-emitting devices can be reduced to make the apparatus highly durable and enjoy a long service life.

What is claimed is:

1. An electron emission apparatus comprising:

a first substrate carrying thereon electron-emitting devices;

an anode disposed opposite to said first substrate; and a power source for supplying a voltage to said anode to accelerate electrons emitted from said electron-emitting devices, wherein said anode is divided into a plurality of anode segments, each being connected to said power source by way of a resistor, and a constant voltage is applied to each of said plurality of anode segments.

2. An electron emission apparatus according to claim 1, wherein said anode is arranged on a second substrate disposed opposite said first substrate carrying thereon said electron-emitting devices, said electron emission apparatus further comprising a supporting member for securing a predetermined gap between said first and second substrates.

3. An electron emission apparatus according to claim 2, wherein said supporting member is adapted to conduct an electric current between said first and second substrates.

4. An electron emission apparatus according to claim 2, wherein said supporting member is electroconductive, and said supporting member is electrically connected to only one of said plurality of anode segments or not electrically connected to any of said plurality of anode segments.

5. An electron emission apparatus according to claim 4, wherein said supporting member comprises a first member having a first electroconductivity and a second member having a second electroconductivity, said supporting member being electrically connected to said only one of said plurality of anode segments or not electrically connected to any of said plurality of anode segments.

6. An electron emission apparatus according to claim 1, wherein a selected voltage is applied to each of said plurality of anode segments.

7. An electron emission apparatus comprising:

a first substrate carrying thereon electron-emitting devices;

an anode disposed opposite said first substrate; and a power source for supplying a voltage to accelerate electrons emitted from said electron-emitting devices, wherein said anode is divided into a plurality of anode segments, each being connected to said power source by way of a resistor, and a constant voltage is applied to each of said plurality of anode segments, wherein said anode is arranged on a second substrate disposed opposite said first substrate carrying thereon said electron-emitting devices, said electron emission apparatus further comprising a supporting member for securing a predetermined gap between said first and second substrates, and wherein said supporting member is arranged to bridge two or more of the plurality of anode segments and said supporting member comprises a first member having a first electroconductivity and two or more second members having a second electroconductivity, said two or more second members being electrically connected respectively to said two or more of the plurality of anode segments, said two or more second members being separated from each other, the second electroconductivity being higher than the first electroconductivity.

8. An electron emission apparatus comprising:

a first substrate carrying thereon electron-emitting devices;

an anode disposed opposite said first substrate; and a power source for supplying a voltage to accelerate electrons emitted from said electron-emitting devices, wherein said anode is divided into a plurality of anode segments, each being connected to said power source by way of a resistor, and a constant voltage is applied to each of said plurality of anode segments, wherein said anode is arranged on a second substrate disposed opposite said first substrate carrying thereon said electron-emitting devices, said electron emission apparatus further comprising a supporting member for securing a predetermined gap between said first and second substrates, and wherein said supporting member is arranged to bridge two or more of the plurality of anode segments and said supporting member comprises a first member having a first electroconductivity and a second member having a second electroconductivity, said second member being electrically connected to part of said two or more of the plurality of anode segments, the rest of said two or more anode segments being electrically insulated from said second member, the second electroconductivity being higher than the first electroconductivity.

9. An electron emission apparatus comprising:

a substrate carrying thereon electron-emitting devices;

an anode disposed opposite said substrate; and a power source for supplying a voltage to said anode to accelerate electrons emitted from said electron-emitting devices, wherein said anode is divided into a plurality of anode segments, each being connected to said power source by way of a resistor, and a selected constant voltage is applied to each of said plurality of anode segments.

10. An electron emission apparatus according to any of claims 1 and 9, wherein said plurality of anode segments and said resistor are arranged substantially on a same plane.

11. An electron emission apparatus according to any of claims 1 and 9, wherein said plurality of anode segments are arranged on said resistor.

12. An electron emission apparatus according to any of claims 1 and 9, wherein said electron-emitting devices are disposed such that a direction along which those that can be driven simultaneously are arranged is not parallel with a direction along which the anode is divided into the plurality of anode segments.

13. An electron emission apparatus according to any of claims 1 and 9, wherein each resistor has a resistance between 10 kΩ and 1 GΩ.

14. An electron emission apparatus according to any of claims 1 and 9, wherein each resistor has a resistance between 10 kΩ) and 4 MΩ.

15. An electron emission apparatus according to any of claims 1 and 9, wherein said electron-emitting devices are disposed such that, for the resistors having a resistance of R, each of the electron-emitting devices yields an emission current of Ie, the anode applies an acceleration voltage of V and the number of electron-emitting devices which emit an electron to one of the anode segments is n, and wherein $R \leqq 0.004 \times V/(n \times Ie)$.

16. An electron emission apparatus according to any of claims 1 and 9, wherein said electron-emitting devices are surface conduction electron-emitting devices.

17. An electron emission apparatus comprising:

a substrate carrying thereon electron-emitting devices;

an anode disposed opposite to said substrate; and a power source for supplying a voltage to said anode to accelerate electrons emitted from said electron-emitting devices, wherein said anode is divided into a plurality of anode segments, each being connected to each other by way of a resistor, and a constant voltage is applied to each of said plurality of anode segments by said power source.

18. An electron emission apparatus comprising:

a substrate carrying thereon electron-emitting devices;

an anode disposed opposite to said substrate; and a power source for supplying a voltage to said anode to accelerate electrons emitted from said electron-emitting devices, wherein said anode is divided into a plurality anode segments, each being connected to each other by way of a resistor, and each being connected to said power source, and wherein a selected constant voltage is applied to each of said plurality of anode segments.

19. An electron emission apparatus comprising:

a substrate carrying thereon a plurality of electron-emitting devices which are arranged in a matrix wiring arrangement, wherein each of said plurality of electron-emitting devices is connected with a modulation wire and a scan wire for line sequential scanning;

an anode disposed opposite to said substrate; and a power source for supplying a voltage to said anode for accelerating electrons emitted from said electron-emitting devices, wherein said anode is divided into a plurality of anode segments, each being connected to said power source by way of a resistor, a constant voltage is applied to each of said plurality of anode segments, and a direction along which the anode is divided into the anode segments is not parallel with the direction of said scan wires.

* * * * *

UNITED STATES PATENT AND TRADEMARK OFFICE

CERTIFICATE OF CORRECTION

PATENT NO. : 6,677,706 B1
DATED : January 13, 2004
INVENTOR(S) : Toshitami Hara et al.

It is certified that error appears in the above-identified patent and that said Letters Patent is hereby corrected as shown below:

Column 3,
Line 35, “destroys” should read -- destroy --.

Column 11,
Line 37, “reduced” should read -- reduce --

Column 15,
Line 41, “bf” should read -- of --.

Column 18,
Line 45, “runs” should read -- run --.

Column 25,
Line 22, “referably” should read -- preferably --.

Column 26,
Line 5, “isolate” should read -- isolated --.

Column 30,
Line 43, “driving,” should read -- driving. --.

Column 45,
Line 37, “10kΩ)” should read -- 10kΩ --.

Signed and Sealed this

Fifth Day of October, 2004

JON W. DUDAS
*Director of the United States Patent and Trademark Office*